US008066579B2

(12) United States Patent
Uto

(10) Patent No.: US 8,066,579 B2
(45) Date of Patent: Nov. 29, 2011

(54) PIN SETTER

(75) Inventor: Yoshitsugu Uto, Niwa-gun (JP)

(73) Assignee: C-Dic Co., Ltd., Ichinomiya-shi (JP)

( * ) Notice: Subject to any disclaimer, the term of this patent is extended or adjusted under 35 U.S.C. 154(b) by 10 days.

(21) Appl. No.: 12/671,062

(22) PCT Filed: Jul. 29, 2008

(86) PCT No.: PCT/JP2008/063596
§ 371 (c)(1),
(2), (4) Date: Jan. 28, 2010

(87) PCT Pub. No.: WO2009/017127
PCT Pub. Date: Feb. 5, 2009

(65) Prior Publication Data

US 2010/0197418 A1 Aug. 5, 2010

(30) Foreign Application Priority Data

| | | |
|---|---|---|
| Jul. 30, 2007 | (JP) | 2007-197440 |
| Jul. 30, 2007 | (JP) | 2007-197441 |
| Jul. 30, 2007 | (JP) | 2007-197442 |
| Jul. 30, 2007 | (JP) | 2007-197443 |
| Jul. 2, 2008 | (JP) | 2008-173749 |
| Jul. 2, 2008 | (JP) | 2008-173750 |
| Jul. 2, 2008 | (JP) | 2008-173751 |
| Jul. 2, 2008 | (JP) | 2008-173752 |
| Jul. 24, 2008 | (JP) | 2008-191240 |
| Jul. 24, 2008 | (JP) | 2008-191241 |
| Jul. 24, 2008 | (JP) | 2008-191242 |
| Jul. 24, 2008 | (JP) | 2008-191243 |

(51) Int. Cl.
*A63D 5/08* (2006.01)

(52) U.S. Cl. ..... 473/73; 473/94; 473/95; 473/102

(58) Field of Classification Search ..... 473/73, 473/94, 95, 96, 102, 104
See application file for complete search history.

(56) References Cited

U.S. PATENT DOCUMENTS 469,071 A * 2/1892 Warth ..... 473/104
693,382 A * 2/1902 Downey ..... 473/74
(Continued)

FOREIGN PATENT DOCUMENTS

CN 2234291 Y 9/1996
(Continued)

OTHER PUBLICATIONS

International Search Report from related PCT Application No. PCT/JP2008/063595 dated Sep. 2, 2008.
(Continued)

*Primary Examiner* — William Pierce
(74) *Attorney, Agent, or Firm* — Grossman, Tucker, Perreault & Pfleger, PLLC

(57) ABSTRACT

A pin setter applied to a bowling game machine in which a player rolling a ball toward a plurality of pins arranged in a standing manner on a lane thereby to knock down the plurality of pins. The pin setter that arranges the pins at predetermined positions includes a pin lifter that lifts the pin in a standing state up to the lane, a pin guide that keeps the pin lifted on the lane from falling down, and an evacuation mechanism that evacuates the pin guide from the lane.

10 Claims, 53 Drawing Sheets

U.S. PATENT DOCUMENTS

| | | | | | |
|---|---|---|---|---|---|
| 2,495,473 | A | * | 1/1950 | Peck | 473/74 |
| 2,621,961 | A | * | 12/1952 | Whipple et al. | 294/115 |
| 2,757,000 | A | * | 7/1956 | Dowd et al. | 473/73 |
| 2,947,541 | A | * | 8/1960 | Came et al. | 473/85 |
| 3,083,017 | A | * | 3/1963 | Bilowz | 473/73 |
| 3,317,207 | A | * | 5/1967 | Jark et al. | 473/73 |
| 3,497,219 | A | * | 2/1970 | Barry et al. | 473/95 |
| 5,039,095 | A | * | 8/1991 | Buckley | 473/95 |

FOREIGN PATENT DOCUMENTS

| | | |
|---|---|---|
| JP | 36-19063 | 10/1961 |
| JP | 47-003866 | 2/1972 |
| JP | 47-30446 | 11/1972 |
| JP | 47-030447 | 11/1972 |
| JP | 48-20654 | 3/1973 |
| JP | 47-024302 | 11/1973 |
| JP | 48-99291 | 11/1973 |
| JP | 48-100236 | 12/1973 |
| JP | 49-122966 | 10/1974 |
| JP | 49-128380 | 11/1974 |
| JP | 50-28857 | 8/1975 |
| JP | 2-96176 | 7/1990 |
| JP | 10-248995 | 9/1998 |
| JP | 11-333044 | 12/1999 |
| JP | 2002-119634 | 4/2002 |
| WO | 2005/000434 | 1/2005 |

OTHER PUBLICATIONS

International Search Report from corresponding PCT Application No. PCT/JP2008/063596 dated Sep. 2, 2008.

International Search Report from related PCT Application No. PCT/JP2008/063597 dated Sep. 2, 2008.

International Search Report from related PCT Application No. PCT/JP2008/063598 dated Sep. 2, 2008.

International Preliminary Report on Patentability dated Mar. 4, 2010 issued in related International Patent Application No. PCT/JP2008/063596.

Office Action from corresponding Chinese Application No. 200880101351.4 dated Dec. 6, 2010. An English translation is attached.

* cited by examiner

PIN SETTER

TECHNICAL FIELD

The present invention relates to a pin setter for bowling games. The invention is effective to be used in ordinary bowling games and bowling games which use a ball for billiards (BilliBow®).

BACKGROUND ART

For example, in the invention described in Patent Document 1, ten pins which are arranged to form a triangle are lifted from below of a lane by a pin lifter so that the ten pins are arranged at predetermined positions on the lane.

Patent Document 1: Unexamined Japanese Patent Publication No. 2002-119634

DISCLOSURE OF THE INVENTION

Problems to be Solved by the Invention

As an operation speed of the pin lifter is accelerated in order to quickly arrange the pins at the predetermined positions on the lane, it is highly probable that the pins arranged on the lane may fall down due to such as an inertial force which acts on the pins when the pin lifter is stopped, and fluctuation which occurs when the pin lifter is actuated.

One object of the invention, in view of the above problem, is to keep the pins arranged on the lane from falling down.

Means for Solving the Problem

In order to achieve the above object, a first aspect of the invention provides a pin setter applied to a bowling game machine in which a player rolls a ball toward a plurality of pins arranged in a standing manner on a lane thereby to knock down the plurality of pins arranged in a standing manner. The pin setter arranges the pins at predetermined positions on the lane and includes a pin lifter, a pin guide, and an evacuation mechanism. The pin lifter lifts the standing pin up onto the lane. The pin guide keeps the pins lifted on the lane from falling down. The evacuation mechanism evacuates the pin guide from the lane.

Accordingly, in the first aspect of the invention, the pins arranged on the lane can be kept from falling down.

In a second aspect of the invention, the pin lifter is configured to include a plurality of cylindrically formed cylinder portions and an ascending mechanism. The pins are loaded into the cylinder portions in a standing manner. The ascending mechanism lifts up the cylinder portions. Moreover, a loading gate is provided on a side surface of the cylinder portion.

Accordingly, in the second aspect of the invention, the pins can be loaded into the cylinder portions in a short amount of time.

More specifically, in the present invention, the cylinder portions are lifted to arrange the pins on the lane. Therefore, if the loading gate is provided on top of the cylinder portion, as in the invention described in Unexamined Japanese Patent Publication No. 2002-119634, the pin to be loaded into the cylinder portion next (next-to-be-loaded pin) has to wait in a waiting position off the loading gate in order to keep the next-to-be-loaded pin from interfering with the cylinder portion upon lifting the cylinder portion.

Thus, in the invention described in Unexamined Japanese Patent Publication No. 2002-119634, the next-to-be-loaded pin has to be moved from the waiting position to the loading gate upon loading the pin into the cylinder portion. Accordingly, even if the cylinder portion goes down, the pin is unable to be loaded into the cylinder portion immediately.

In contrast, in the second aspect of the invention, the loading gate is provided on the side surface of the cylinder portion. Thus, there is no need to keep the next-to-be-loaded pin waiting at the position off the loading gate to prepare for the next pin loading operation.

Accordingly, there is no necessity to move the pin from the waiting position to the loading gate at the next pin loading operation. The pin can be loaded into the cylinder portion almost as soon as the cylinder portion goes down. Therefore, the pin can be loaded into the cylinder portion in a short amount of time.

In a third aspect of the invention, a piston is provided which is displaceable inside the cylinder portion. After the cylinder portion and the piston move up in a unified manner by a predetermined amount, only the piston moves up to operate so as to push up the pin onto the lane through a hole provided in the lane.

Accordingly, after the pin is lifted to the vicinity of the lane while being kept from falling down in the cylinder portion, only the pin can be lifted onto the lane by the piston.

It is desirable that the hole in the lane is configured to be shut by the piston, as in a fourth aspect of the invention.

In a fifth aspect of the invention, the piston is configured to include a seat portion and a first elastic displacement portion. The seat portion comes into contact with the pin and shuts the hole. The first elastic displacement portion transmits to the seat portion an ascending force from the ascending mechanism and is elastically deformable in a displacement direction of the piston.

Accordingly, variations in dimension as well as variations in assembling dimension of the ascending mechanism and the seat portion can be absorbed by the first elastic displacement portion.

It is desirable that the pin guide is provided with a clamping portion that clamps the pin, as in a sixth aspect of the invention.

It is desirable that the pin guide is provided with a detector that detects presence/absence of the pin, as in a seventh aspect of the invention.

In an eighth aspect of the invention, the evacuation mechanism is configured to switch between a case where the pin guide is displaced in a vertical direction to keep the pin from falling down and a case where the pin guide is evacuated from the lane. The evacuation mechanism is also configured to include a second elastic displacement portion. The second elastic displacement portion interconnects the evacuation mechanism and the pin guide, and is elastically displaceable in a vertical direction.

Accordingly, in the eighth aspect of the invention, the pin guide can be reliably displaced in a vertical direction.

More specifically, if the pin guide moves down in a state in which the corresponding pin has fallen down, the pin guide interferes with the fallen pin. The pin guide is no longer able to be completely moved down and may negatively affect descending operation of other pin guides.

In the eighth aspect of the invention, even if the pin guide interferes with the fallen pin, the second elastic displacement portion can absorb the interference. Thus, the descending operation of other pin guides can be kept from being negatively affected.

The bowling game machine may have the following characteristics.

First, the number of components of the pin setter may be reduced to achieve a simple structure.

For this purpose, it is preferable that the pin setter applied to a bowling game machine in which a player rolls a ball toward a plurality of pins arranged in a standing manner on a lane to knock down the plurality of pins arranged in a standing manner, arranges the pins at predetermined positions, and includes a distribution shooter through which the pins are dropped in a sliding manner and guided to the predetermined positions.

Since the pins are dropped in a sliding manner through the distribution shooter and guided to the predetermined positions, the number of components of the pin setter can be reduced to achieve a simple structure, as compared to a structure in which the pins are fed and arranged at the predetermined positions one by one by an arm which stretches while swinging.

It is preferable that the same number of distribution shooters are provided as the pins arranged in a standing manner on the lane, and a feeder is provided which feeds the pins to the plurality of distribution shooters. It is further preferable that the feeder is able to feed the pins simultaneously to the plurality of distribution shooters.

Since the plurality of pins can be fed and arranged in a short amount of time, a processing speed of the pin setter can be enhanced.

As a particular structure for enabling the pins to be fed simultaneously to the plurality of distribution shooters, it is desirable that pin feeding gates of the plurality of distribution shooters are arranged substantially in a straight line, and the pins are fed to the respective pin feeding gates in a state in which the plurality of pins are arranged substantially in a straight line, as in the present embodiment.

It is also preferable that the number of components of a collection mechanism that collects the pins and the ball is reduced to achieve a simple structure.

For this purpose, the collection mechanism that collects the pins and the ball may be configured as follows.

It is preferable that the collection mechanism, applied to a bowling game machine in which a player rolls a ball toward a plurality of pins arranged in a standing manner on a lane to knock down the plurality of pins arranged in a standing manner, collects the pins and the ball and includes a pin collection mechanism and a conveyor. The pin collection mechanism includes a rotating body that rotates and collects the pins by rotation of the rotating body. The conveyance device conveys the ball which has reached a terminal end section of the lane and the pins which have been swept out to the terminal end section of the lane. It is preferable that the rotating body includes a pin transfer portion that transfers the pins, and a ball transfer portion that transfers the ball.

Accordingly, the number of components of the collection mechanism that collects the pins and the ball can be reduced to achieve a simple structure.

It is preferable that the rotating body is substantially formed into a plate, a side surface orthogonal to a rotation axis of the rotating body intersects with a horizontal plane, and the pin transfer portion is provided on an outer peripheral side of the rotating body than the ball transfer portion. It is preferable that a distance between an end portion on the collection mechanism side of the conveyance device and the rotating body is set to be smaller than a diameter of the ball and larger than a maximum diameter of the pin, and furthermore the end portion on the collection mechanism side of the conveyance device is set to be at a position higher than an upper end of the pin transfer portion and lower than an upper end of the ball transfer portion, in a vertical direction.

Accordingly, the pins drop through a gap between the conveyance device and the pin collection mechanism to be received in the pin transfer portion, and the ball does not drop through the gap to be received in the ball transfer portion.

Accordingly, even if the pins and the ball are conveyed together to the pin collection mechanism, both the pins and the ball can be collected separately.

The expression "a side surface orthogonal to a rotation axis of the rotating body intersects with a horizontal plane" includes both a case of vertically setting the side surface of the rotating body and a case of inclining the side surface with respect to a horizontal plane.

Moreover, it is preferable that the ball transfer portion is formed from a recess depressed in a direction parallel to the rotation axis from the side surface of the rotating body, and the side surface is inclined with respect to a horizontal plane so that an opening of the recess opens upward.

In this manner, the ball can be held with a bottom and an inner peripheral side surface of the recess. If the side surface of the rotating body is vertically set, a depth of the recess has to be increased since the ball needs to be held only with the inner peripheral side surface of the recess.

Thus, as compared to the case of vertically setting the side surface of the rotating body, thickness of the rotating body can be small.

A ball collector which takes out the ball fitting in the recess may be provided above a lowermost section of the rotating body.

It is preferable that the recess is formed from a through hole which penetrates the rotating body, and a stationary plate is provided which shuts the through hole forming the recess. Moreover, it is preferable that the stationary plate is provided with a hole which constitutes the ball collector.

Also, the pin collection mechanism may be provided which can make a collection speed the pins high.

For this purpose, the collection mechanism may be configured as follows.

The pin collection mechanism, applied to a bowling game machine in which a player rolls a ball toward a plurality of pins arranged in a standing manner on a lane to knock down the plurality of pins arranged in a standing manner, collects the pins and conveys the collected pins to a pin setter which arranges the collected pins at predetermined positions. The pin collection mechanism includes a first conveyor, a rotating body, a stationary plate, and a second conveyor. The first conveyor conveys the pins which have been swept out to the terminal end section of the lane. A pocket for receiving the pins conveyed by the first conveyor is provided on an outer peripheral side of the rotating body. The rotation axis of the rotating body is inclined with respect to a horizontal direction. The stationary plate shuts the pocket from a side of a region of the rotating body facing downward, and is provided with an odd-shaped slit. The odd-shaped slit is formed into an elongated hole which extends upward in a rotation direction of the rotating body. The second conveyor conveys the pins dropping through the odd-shaped slit to the pin setter. It is preferable that a dimension in a minor axis direction of a first hole on a backward side in the rotation direction of the odd-shaped slit is larger than a diameter of a small diameter portion of the pin and smaller than a diameter of a large diameter portion of the pin. It is further preferable that a dimension in a minor axis direction of a second hole on a forward side in the rotation direction of the odd-shaped slit is larger than the diameter of the large diameter portion of the pin.

Thereby, when the pin reaches the odd-shaped slit in a state in which the small diameter portion of the pin is positioned on the forward side in the rotation direction of the rotating body, the small diameter portion drops through the first hole in a state in which the large diameter portion is caught by the first hole as soon as the small diameter portion reaches the first hole. Accordingly, the pin rotates such that the small diameter portion goes below the large diameter portion.

More specifically, in a state in which the pin is received in the pocket, the pin is conveyed toward the odd-shaped slit in a state in which a center axis of the pin is inclined with respect to a virtual contact surface which passes a contact portion between the large diameter portion and an inner wall of the pocket and a contact portion between the small diameter portion and the inner wall of the pocket. When a tip end portion of the pin reaches the odd-shaped slit, a wall supporting the small diameter portion disappears. The small diameter portion drops through the first hole almost as soon as the small diameter portion reaches the first hole. Thus, the pin rotates such that the small diameter portion goes below the large diameter portion.

In this case, the first hole, that is, the odd-shaped slit, is provided in the stationary plate and immovable. Therefore, in a contact portion between the large diameter portion and the first hole (hereinafter, the contact portion is referred to as a "brake point"), a force (a braking force) is generated which inhibits the pin from moving with the rotating body.

On the other hand, the bottom side of the pin is pushed by the rotating body. Therefore, the bottom of the pin rotates to the forward side in the rotation direction around the brake point, and the large diameter portion is positioned on the more forward side in the rotation direction than the brake point. In other words, the larger diameter portion is in a state positioned on the more forward side in the rotation direction than the small diameter portion.

In this case, the pin receives a forward force in the rotation direction from the rotating body at a position closer to the bottom side than the brake point, and moves to the second hole in a state receiving a backward force in the rotation direction at the brake point (hereinafter, the state is referred to as a predrop state). Thus, the large diameter portion reaches the second hole ahead of the small diameter portion.

Accordingly, when the large diameter portion reaches the second hole, the pin rotates and drops such that the large diameter portion goes below the small diameter portion.

When the pin reaches the odd-shaped slit in a state in which the large diameter portion of the pin is positioned on the forward side in the rotation direction of the rotating body, only the small diameter portion drops from the first hole. Thus, the pin moves to the second hole in the predrop state. Accordingly, when the large diameter portion reaches the second hole, the pin drops, as noted above, such that the large diameter portion goes below the small diameter portion.

Since the pins are rotated to be aligned in the same direction without reversing a moving direction of the pins, a problem does not occur in principle in which the pins pass over the odd-shaped slit due to an inertial force acting on the pins.

Accordingly, a high speed in collecting the pins can be achieved without deteriorating a collection rate of the pins.

In case that the pin is sent such that the small diameter portion is positioned on the forward side in the rotation direction, the pin is moved to the second hole while being rotated in the first hole to be in the predrop state. Thus, timing when the pin drops through the second hole is substantially the same in a case that the pin is sent such that the small diameter portion is positioned on the forward side in the rotation direction and a case that the pin is sent such that the large diameter portion is positioned on the forward side in the rotation direction.

Accordingly, in the first aspect of the invention, fluctuation in timing can be moderated upon conveying the pins collected by the pin collection mechanism to the pin setter. The pin setter can be kept from malfunctioning.

It is preferable that a gap is provided between a region of the stationary plate in which the odd-shaped slit is provided and the rotating body.

Thereby, a distance can be increased between a region of a contact portion between the pin and rotating body which receives a force for moving the pin, and the break point. Thus, a moment can be increased for rotating the pin from a state in which the small diameter portion of the pin is positioned on the forward side in the rotation direction of the rotating body to the predrop state.

Since the pin can be reliably moved to the second hole in the predrop state, a high speed in collecting the pins can be achieved without deteriorating the collection rate of the pins.

It is preferable that an inhibitor that inhibits the tip end portion of the pin which has dropped through the first hole from moving together with rotation of the rotating body.

Thereby, the tip end portion can be reliably inhibited from moving together with the rotating body. Thus, the pin can be reliably rotated such that the pin is in the predrop state.

In a state in which the tip end portion of the pin has dropped through the first hole, it is preferable that an upper external periphery of the first hole is brought into contact with the pin, and a lower external periphery of the first hole is not brought into contact with the pin.

Thereby, the pin comes into contact with the upper external periphery of the first hole above a center axial line of the pin and comes into contact with the rotating body below the center axial line. Also, a contact portion with the rotating body is positioned closer to the bottom side of the pin than the brake point (a contact portion between the external periphery of the first hole and the pin).

Thereby, the pin in the predrop state can be inhibited from dropping on an opposite side to a direction to drop naturally, that is, an opposite side of the stationary plate over the rotating body. The pin can be reliably moved to the second hole in the predrop state. Accordingly, a high speed in collecting the pins can be achieved without deteriorating the collection rate of the pins.

The present invention and various characteristics relating thereto have been described. In case that problems associated with these characteristics occur in a complex manner, the plurality of characteristics may be combined to solve the problems.

EXPLANATION OF REFERENTIAL NUMERALS

1 . . . bowling game machine, 3 . . . lane, 3A . . . hole, 4 . . . frame, 20 . . . pin conveyance mechanism, 100 . . . collection mechanism, 101 . . . belt conveyor, 103 . . . pin shooter, 105 . . . ball shooter, 110 . . . collection portion, 111 . . . rotating drum, 111A . . . rotation axis, 112 . . . projection, 112A . . . pocket, 121A . . . first hole, 121B . . . second hole, 122 . . . gap, 123 . . . guide member, 123A . . . receiving surface, 123B . . . inclined guide surface, 123C . . . outlet, 123D . . . resistor, 124 . . . cover, 124A . . . link mechanism, 124B . . . motor, 125 . . . collection hole, 130 . . . shroud, 131 . . . guide blade, 132 . . . shroud ring, 140 . . . motor, 200 . . . pin conveyance mechanism, 201 . . . shooter fixture, 202 . . . mount nozzle, 203 . . . rail, 204 . . . driving belt, 205 . . . motor, 210 . . . distribution mechanism, 230 . . . conveyance unit, 231 . . . conveyance belt, 232 . . . locking projection, 233 . . . guide blade, 234 . . . guide, 235 . . . driven roller, 236 . . . driving roller, 237 . . . motor, 238 . . . tension lever, 250 . . . distribution shooter, 251 . . . pin feeding gate, 300 . . . pin setter, 301 . . . pin lifter, 302 . . . cylinder portion, 303 . . . first cylinder, 304 . . . second cylinder, 305 . . . first projection, 306 . . . first coil spring, 307 . . . second projection, 308 . . . stopper, 309 . . . loading gate, 320 . . . piston, 321 . . . seat, 322 . . . push rod, 323 . . . second coil spring, 324 . . . holding member, 324A . . . through hole, 325 . . . bolt, 340 . . . ascending mechanism, 341 . . . ascending plate, 342 . . . chain, 343 . . . pull-up machine, 344 . . . arm, 345 . . . movable sprocket, 346 . . . idle sprocket, 350 . . . pin guide elevation mechanism, 351 . . . pin guide, 351A . . . projection, 352 . . . clamping rod, 353 . . . lift plate, 354 . . . movable plate, 355 . . . actuator, 356 . . . fixture, 356A . . . bolt, 357 . . . coil spring, 358 . . . pin sensor, 360 . . . evacuation mechanism, 361 . . . elevation guide, 362 . . . guide shoe, 363 . . . beam, 364 . . . chain, 400 . . . sweep mechanism, 500 . . . control circuit.

BEST MODE TO CARRY OUT THE INVENTION

The present embodiment describes a bowling game machine for BilliBow®, to which the present invention is applied.

BilliBow® is a bowling game machine which uses a ball of billiards. Particularly, BilliBow® is a game to hit a ball with a stick for billiards and roll the ball to knock down ten pins arranged in a standing manner in a terminal end section of a lane.

A bowling game machine for BilliBow® currently used (as of July, 2007) has a structure of an ordinary bowling game machine merely scaled down. Therefore, there are more than a few parts which can be hardly said to be suitable for BilliBow®.

Hereinafter, taking, as an example, a bowling game machine suitable for BilliBow®, embodiments of the present invention will be described by way of drawings.

First Embodiment

1. Description of the Drawings

Figure 1:
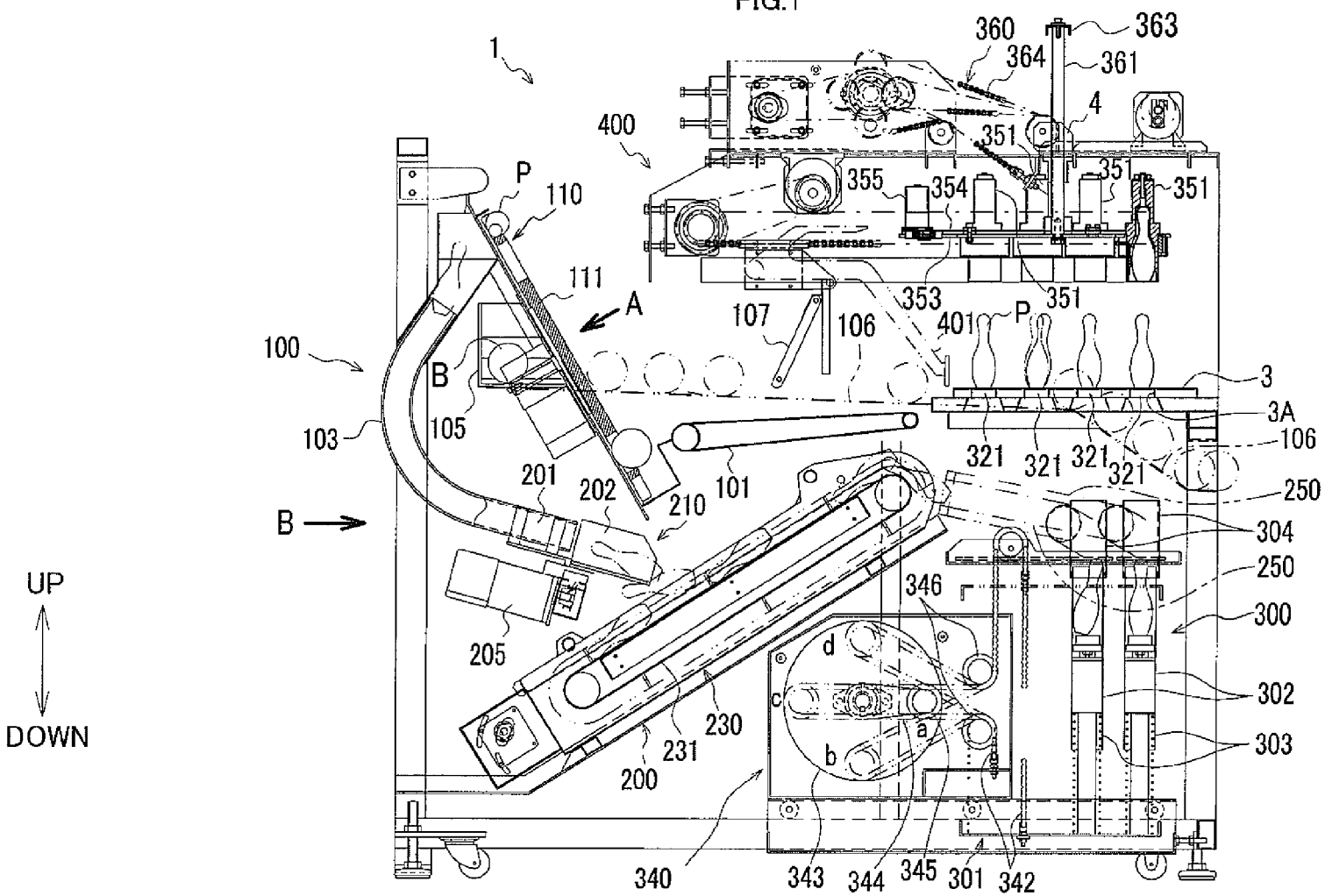
FIG. 1 is a view showing an arrangement of a collection mechanism 100, a pin setter 300 and a sweep mechanism 400 for pins P, of a bowling game machine 1.
Figure 2:
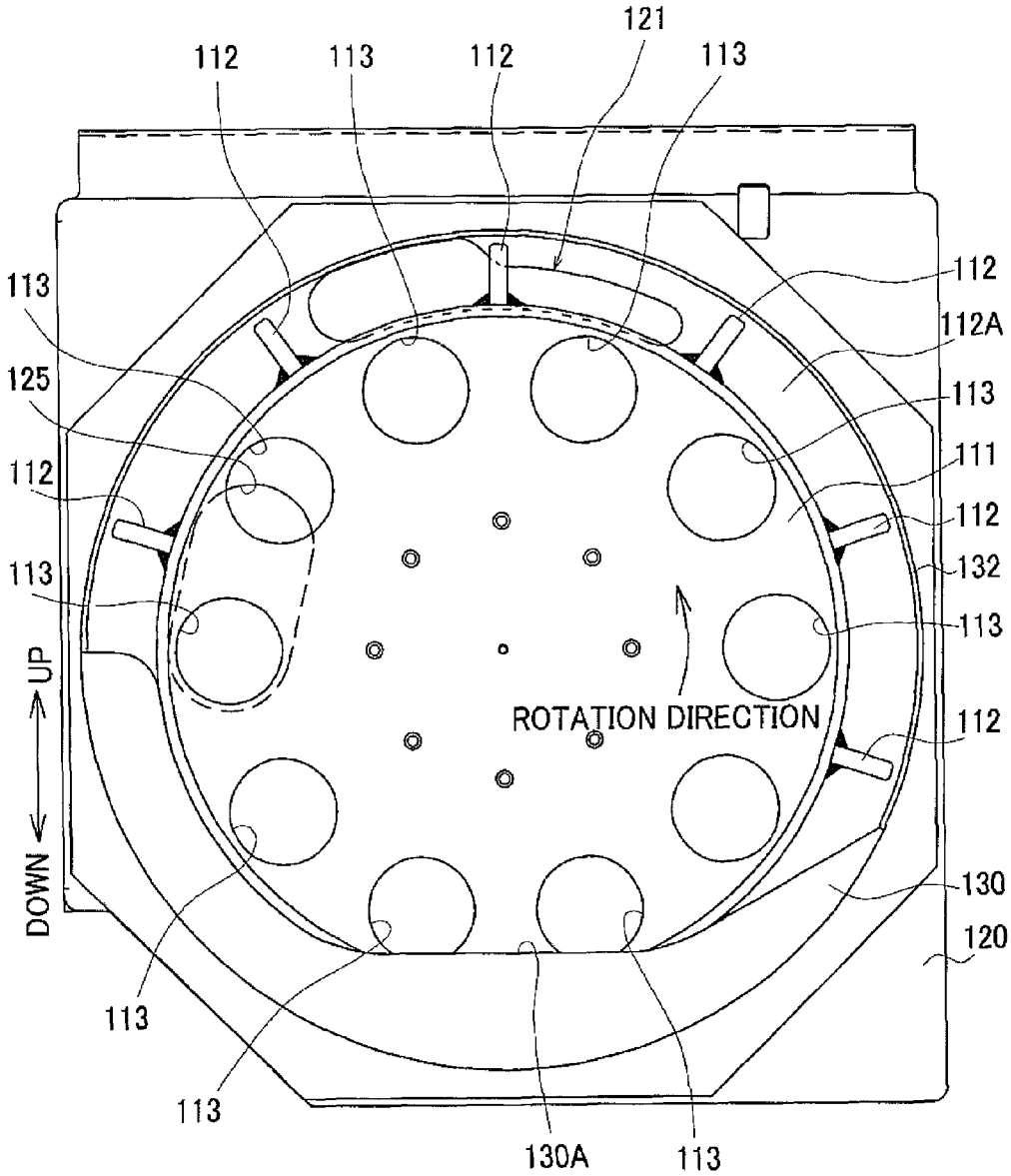
FIG. 2 is a front view of the collection mechanism 100 (a view taken in a direction of an arrow A in FIG. 1)
Figure 3:
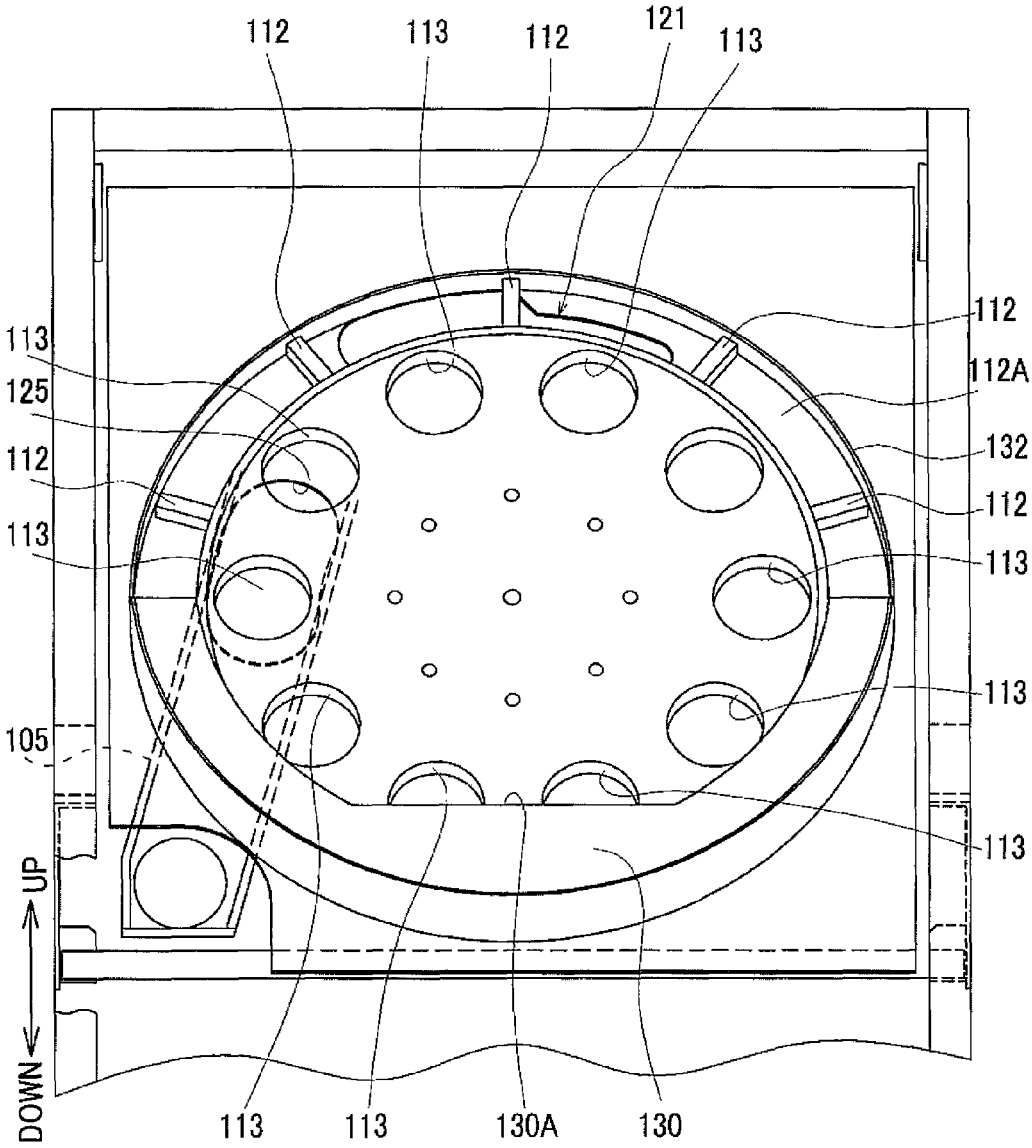
FIG. 3 is a view of a front side of the collection mechanism 100 viewed in a horizontal direction.

FIG. 1 is a view showing an arrangement of a collection mechanism 100, a pin setter 300, and a sweep mechanism 400 for pins P, in a bowling game machine 1. FIG. 2 is a front view (a view taken in a direction of an arrow A in FIG. 1) of the collection mechanism 100. FIG. 3 is a front side view of the collection mechanism 100 viewed from a horizontal direction.

Figure 4B:
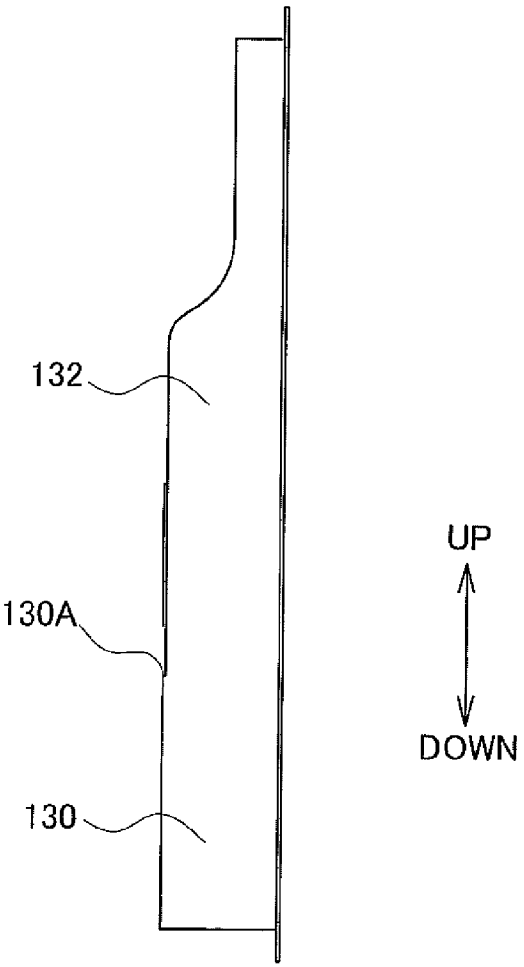
FIG. 4(*a*) is a front view of a shroud 130, and FIG. 4(*b*) is a right side view in FIG. 4(*a*)
Figure 4A:
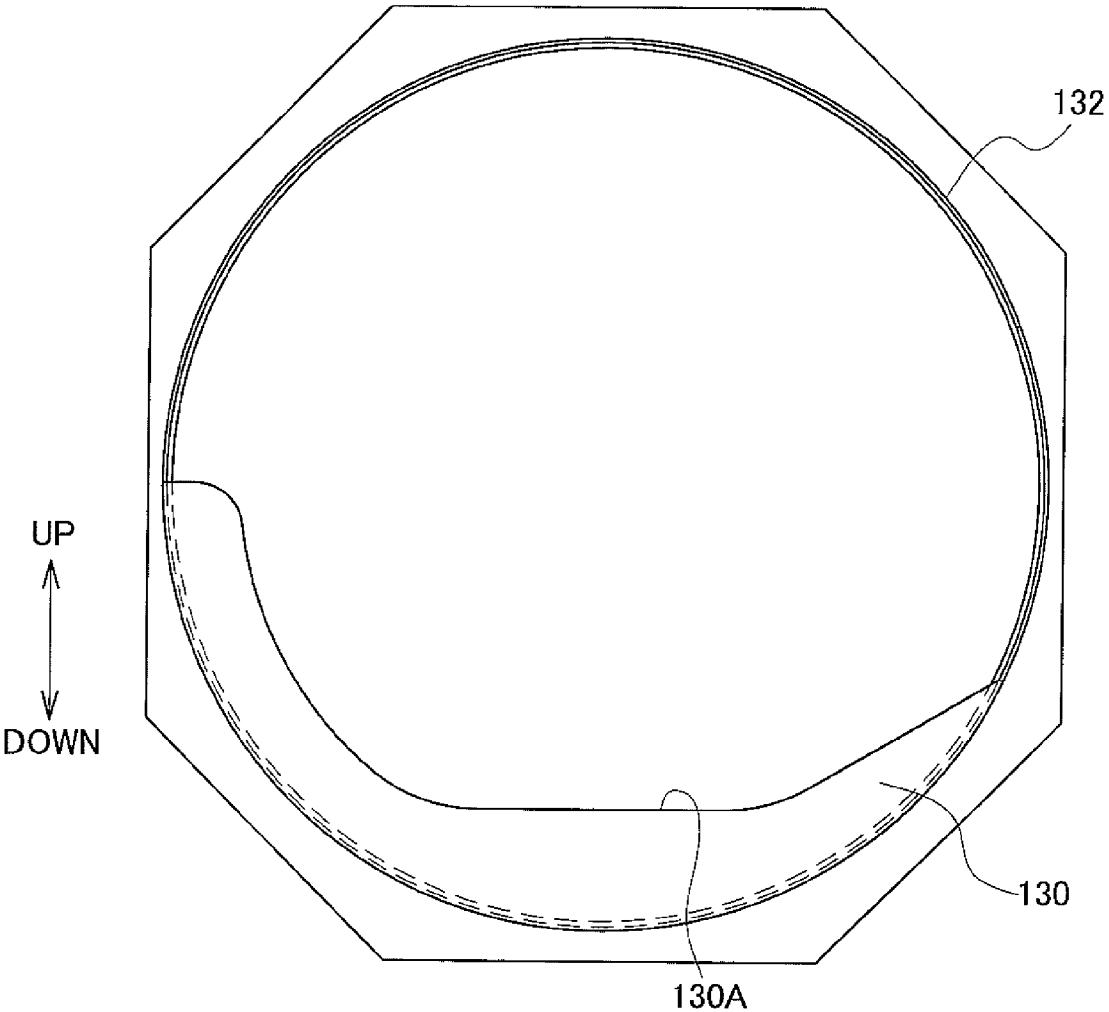
Figure 5:
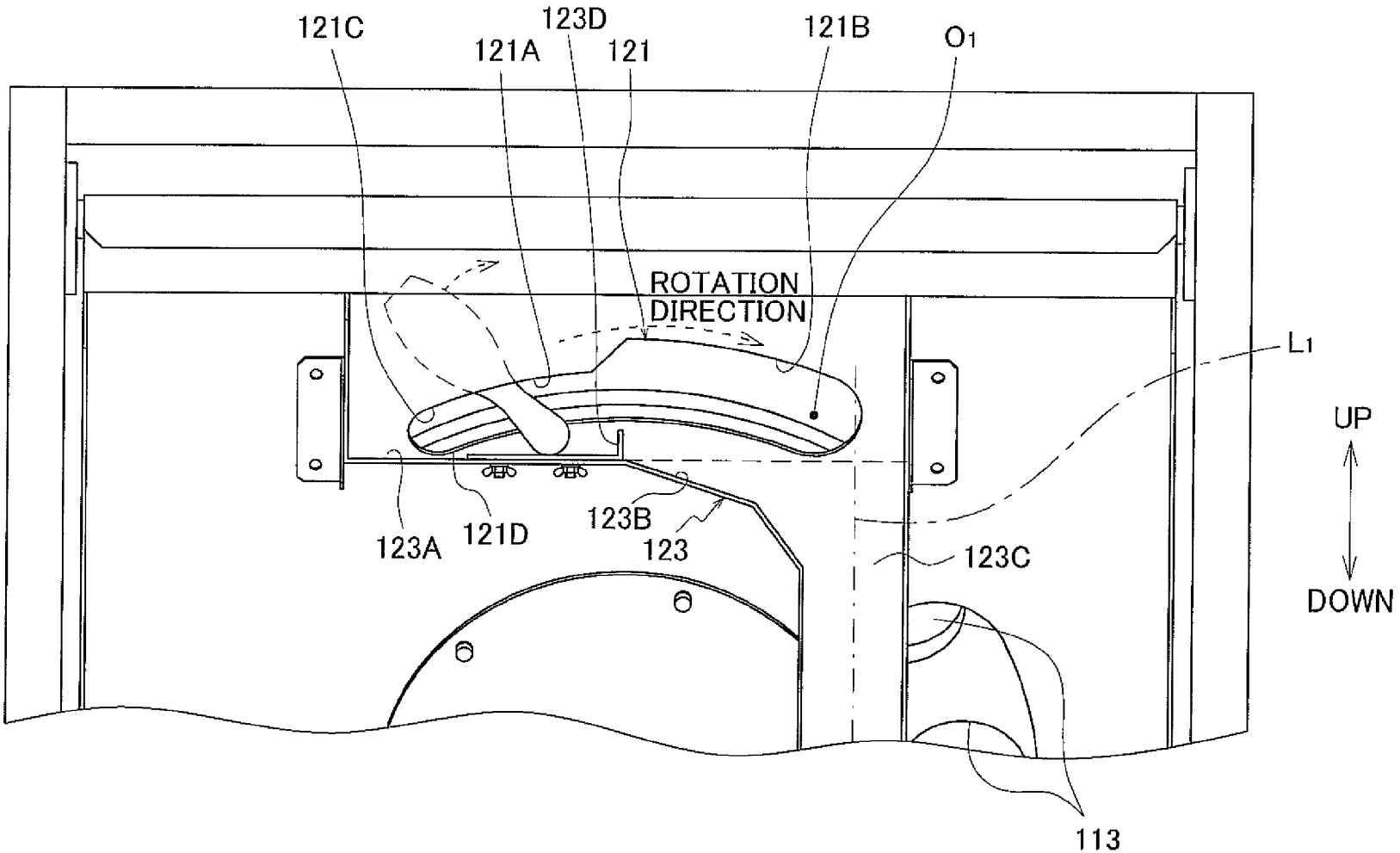
FIG. 5 is a view of a state of the pin P dropping though an odd-shaped slit 121 viewed from its back side.
Figure 6:
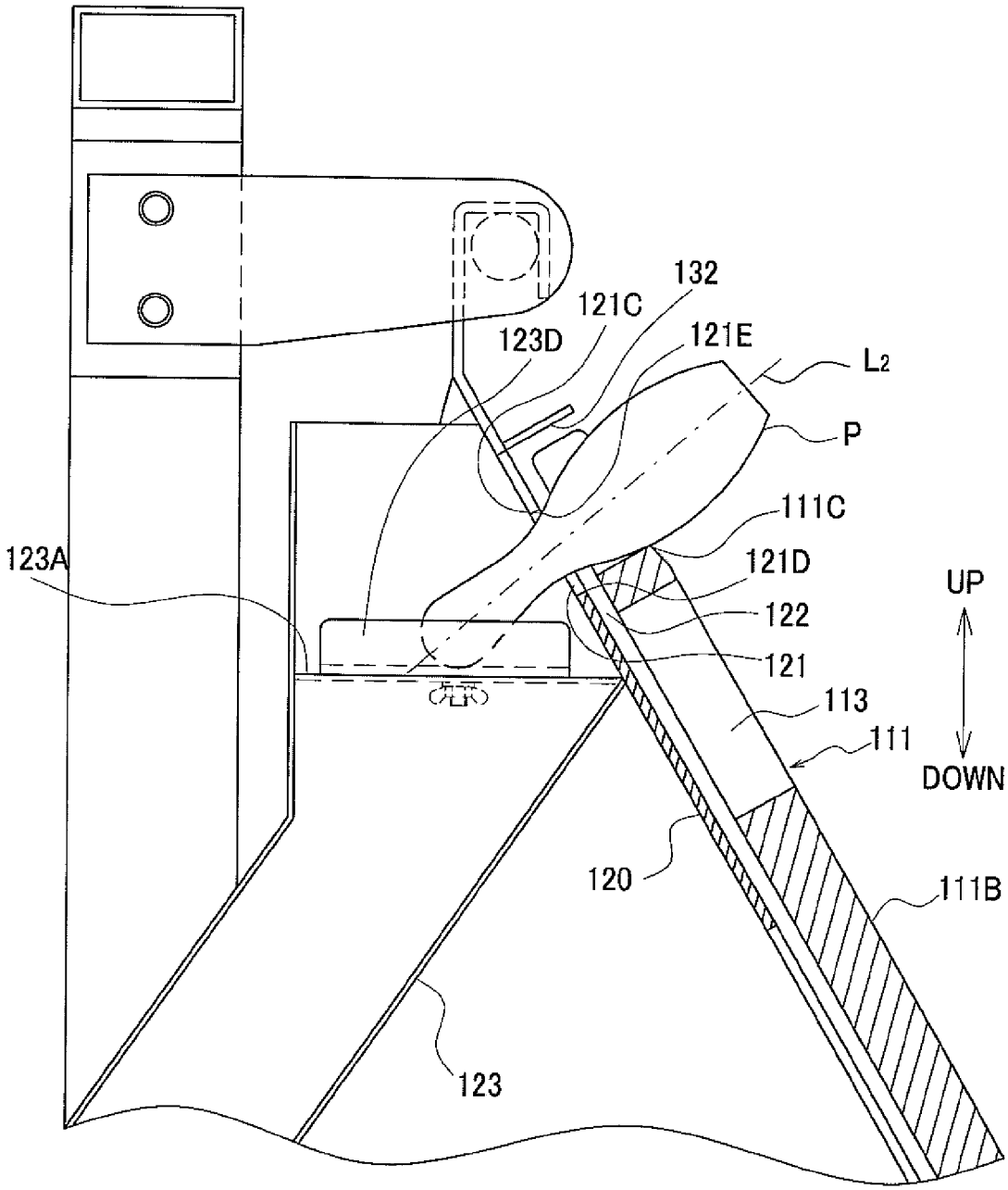
FIG. 6 is a view of the state shown in FIG. 5 viewed from a right side in FIG. 5.

FIG. 4(*a*) is a front view of a shroud 130, and FIG. 4(*b*) is a right side view in FIG. 4(*a*). FIG. 5 is a view of a state of the pin P dropping though an odd-shaped slit 121 viewed from its back side. FIG. 6 is a view of the state shown in FIG. 5 viewed from its right side in FIG. 5.

Figure 7:
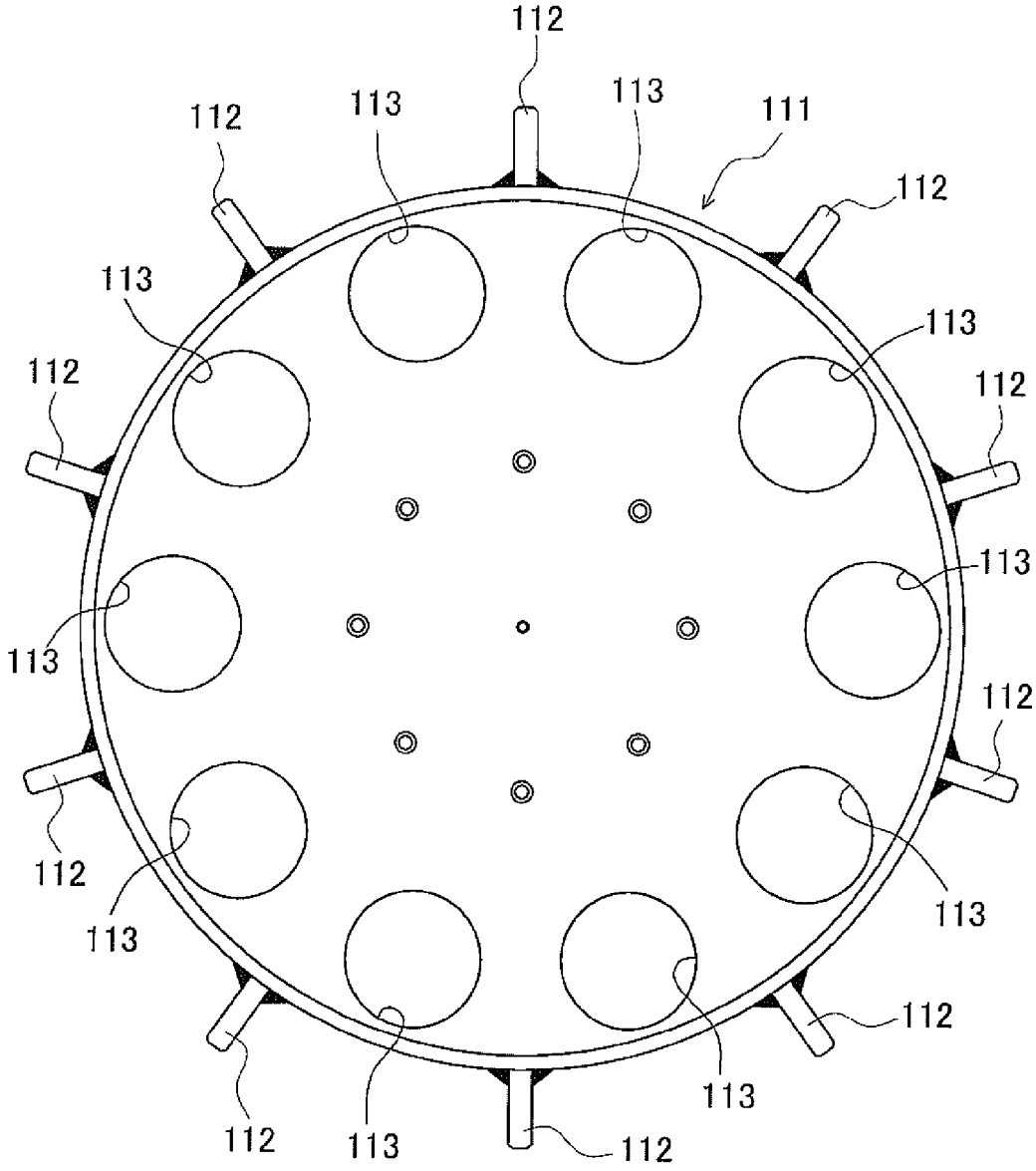
FIG. 7 is a front view of a rotating drum 111.
Figure 8A:
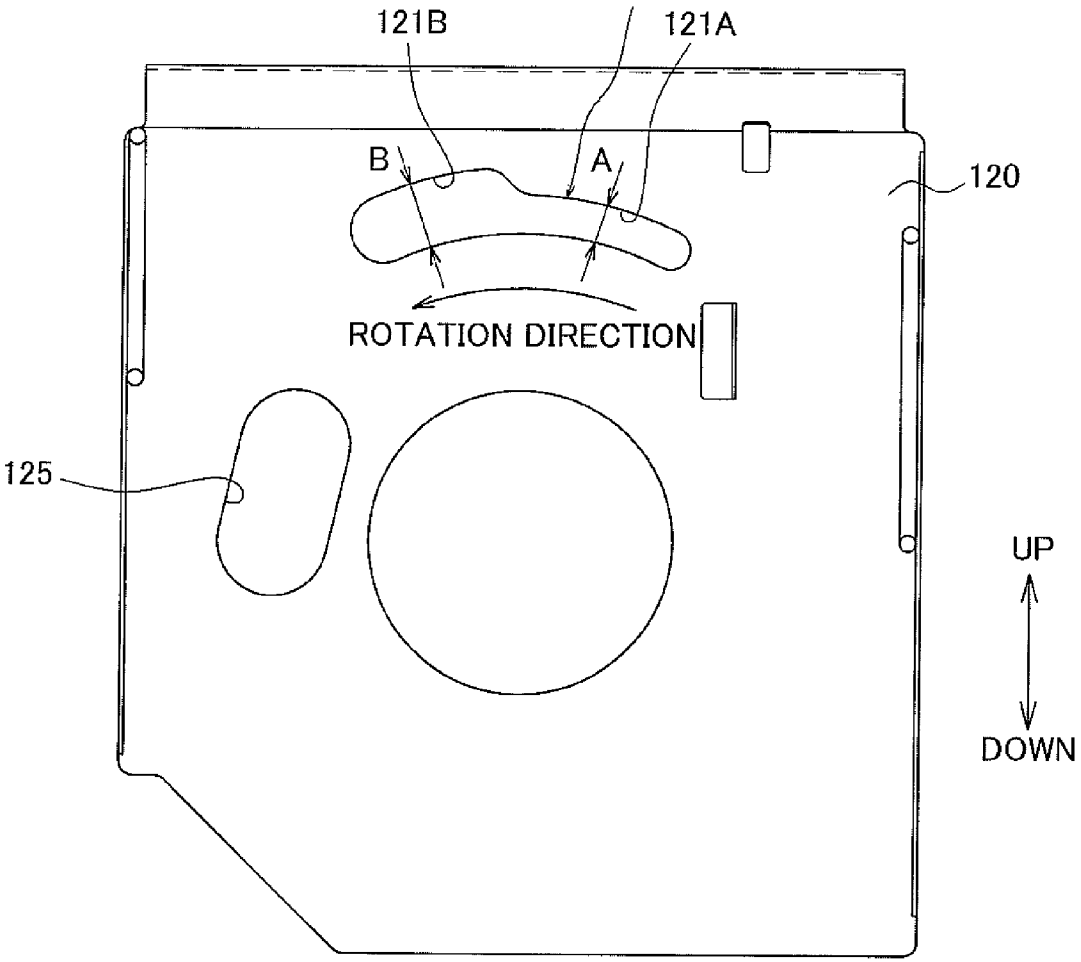
FIG. 8(*a*) is a front view of a stationary plate 120, and FIG. 8(*b*) is a front view of the pin P.
Figure 8B:
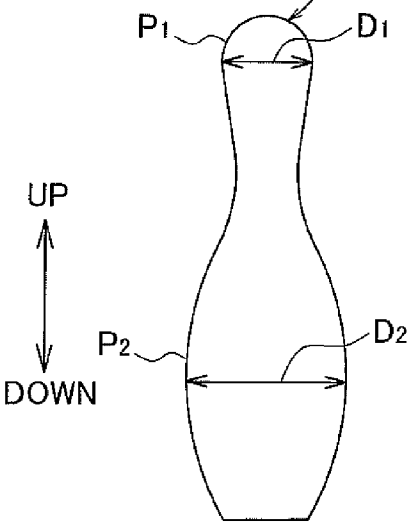
Figure 9A:
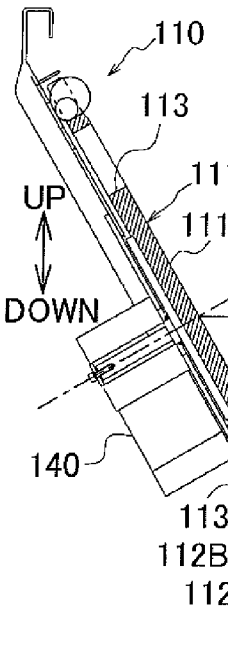
FIGS. 9(*a*) to (*c*) are views showing movements of a ball B and the pin P collected by the collection mechanism 100.
Figure 9B:
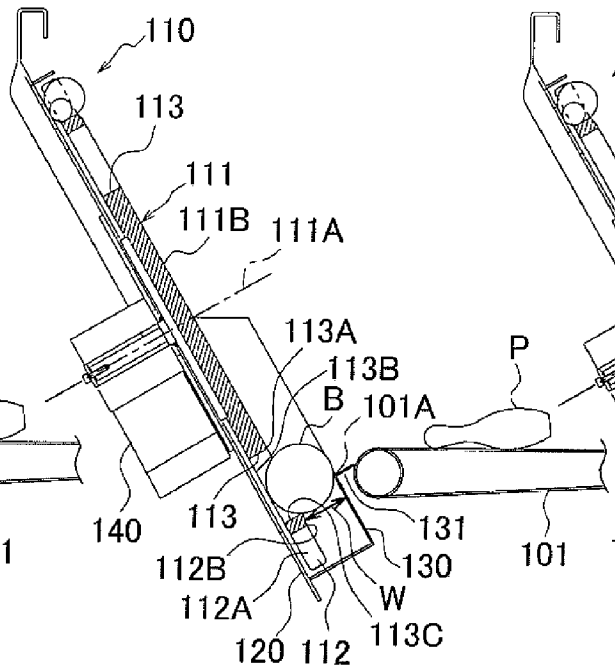
Figure 9C:
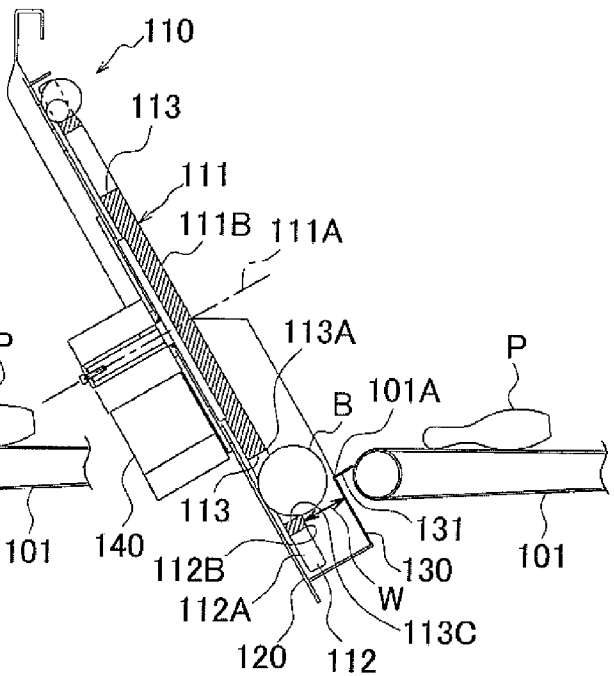
Figure 11:
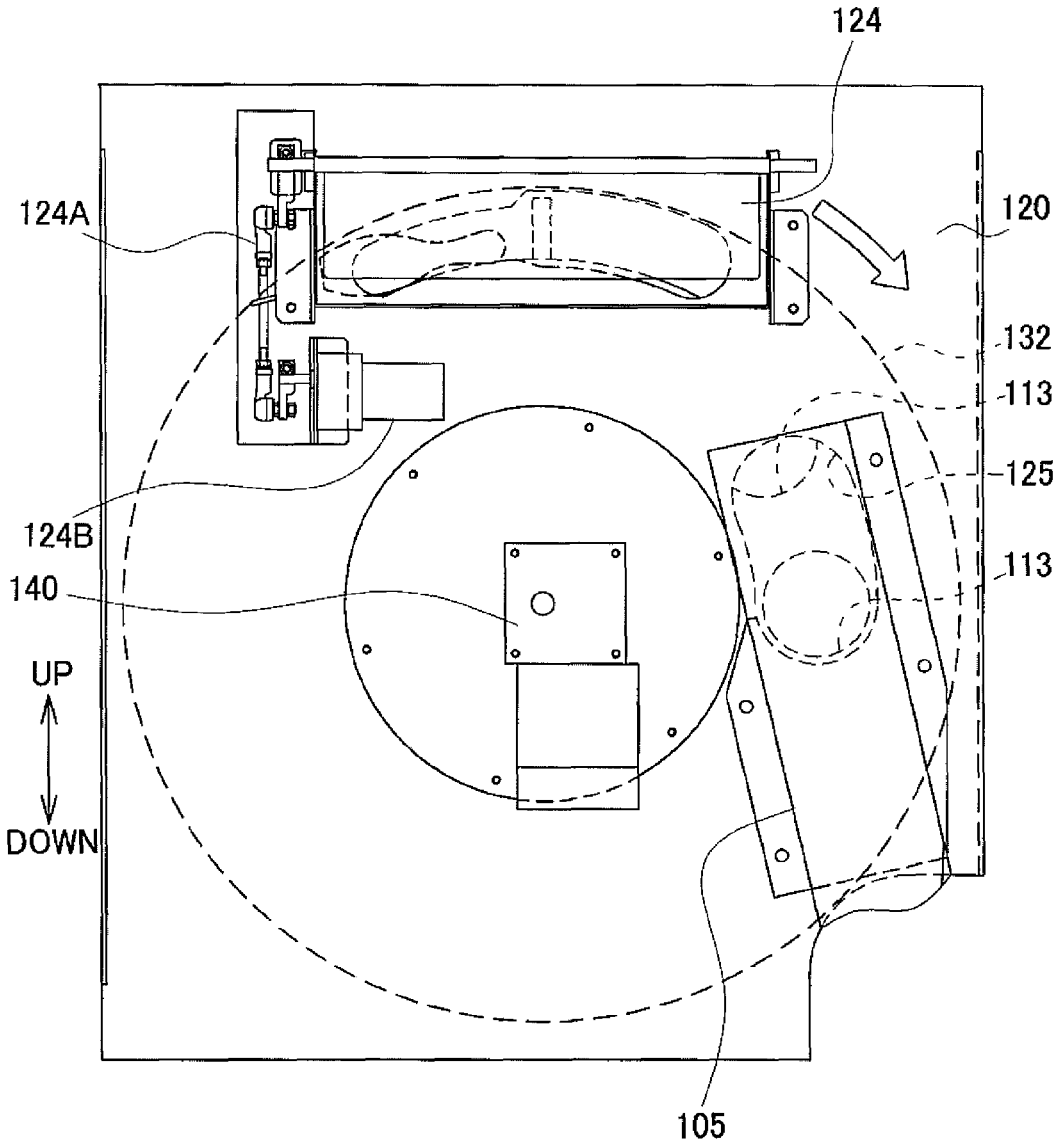
FIG. 11 is a view of the collection mechanism 100 viewed from its back side.

FIG. 7 is a front view of a rotating drum 111. FIG. 8(*a*) is a front view of a stationary plate 120, and FIG. 8(*b*) is a front view of the pin P. FIGS. 9(*a*) to 9(*c*) and 10(*a*) to 10(*c*) are views showing movements of a ball B and the pin P collected by the collection mechanism 100. FIG. 11 is a view of the collection mechanism 100 viewed from its back side.

Figure 12:
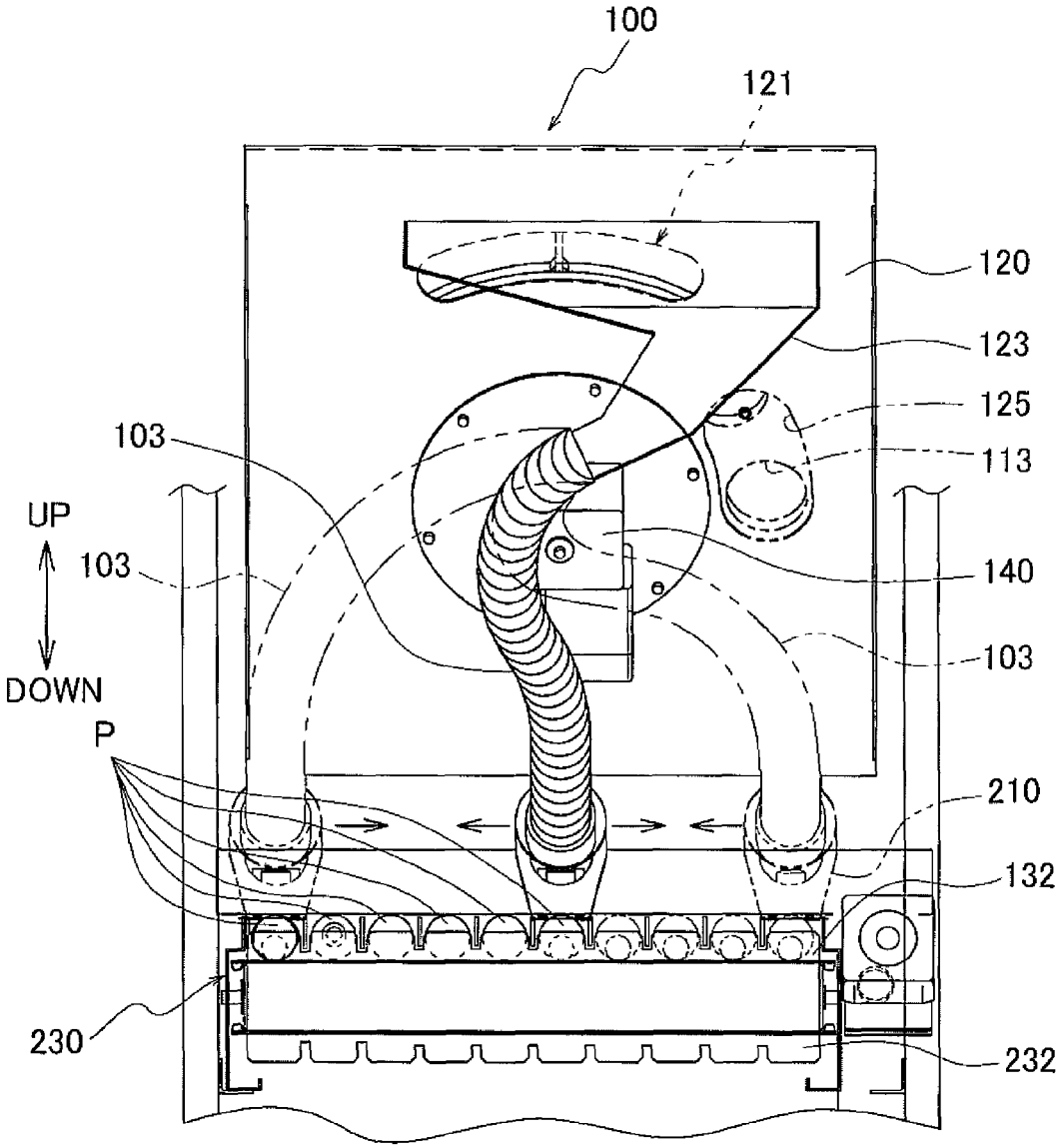
FIG. 12 is a view taken in a direction of an arrow B in FIG. 1.
Figure 13:
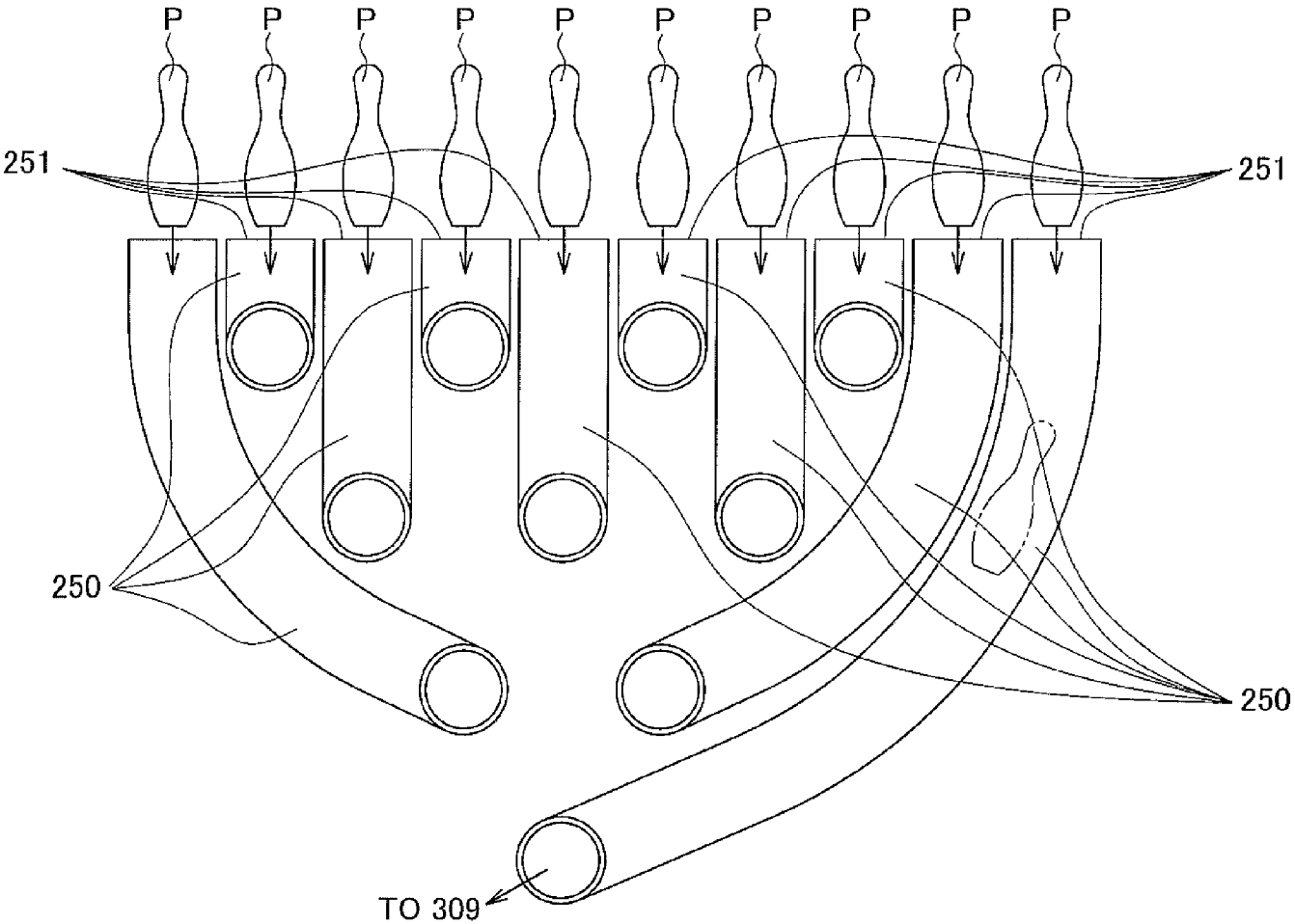
FIG. 13 is a view showing an installed state of distribution shooters 250 viewed from above.
Figures 14A, 14B:
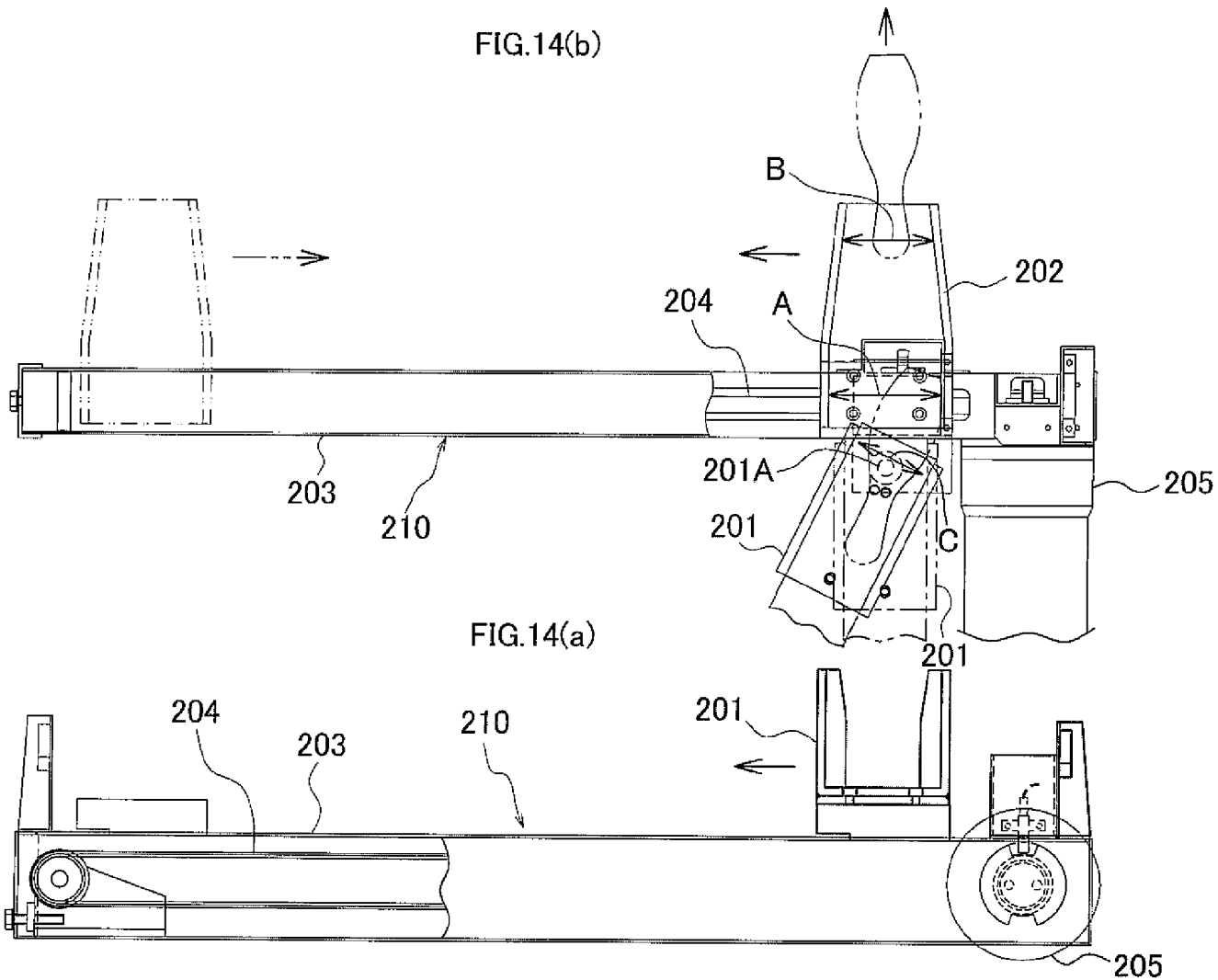
FIG. 14(*a*) is a view of a distribution mechanism 210 taken in the direction of the arrow B in FIG. 1, and FIG. 14(*b*) is a top view in FIG. 14(*a*)
Figure 15:
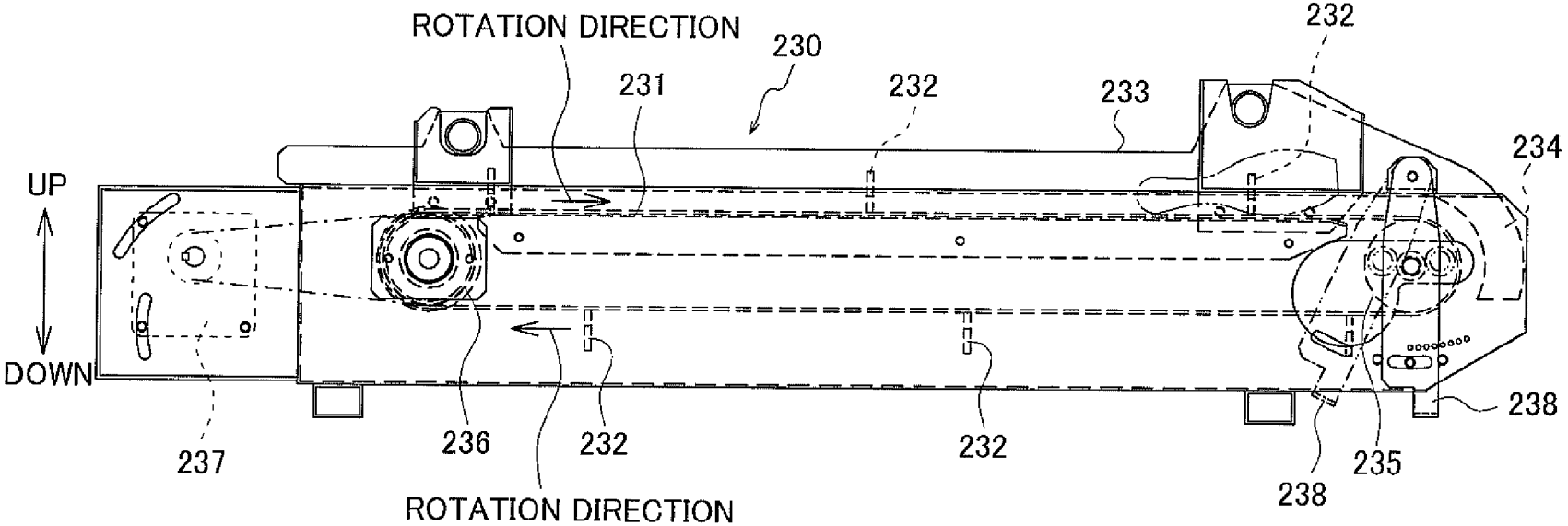
FIG. 15 is a view showing a schematic structure of a pin conveyance mechanism 200.
Figure 16:
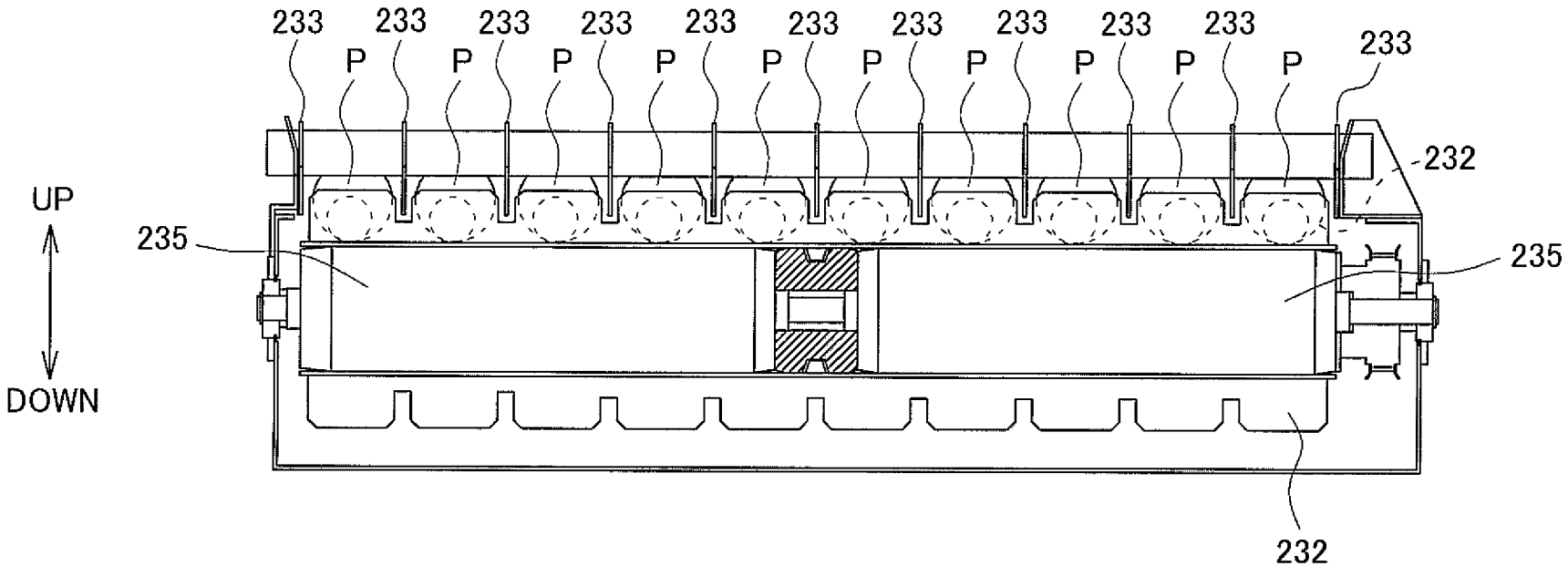
FIG. 16 is a left side view in FIG. 15.
Figure 17A:
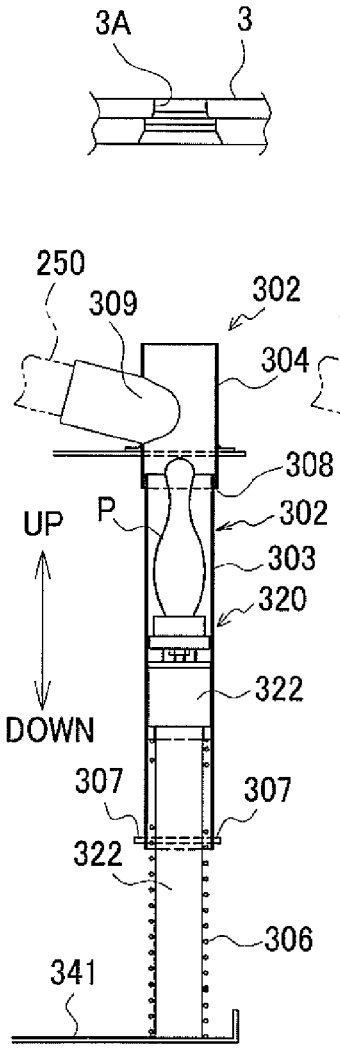
FIGS. 17(*a*) to 17(*d*) are views showing lifting operation of the pin P.
Figure 17B:
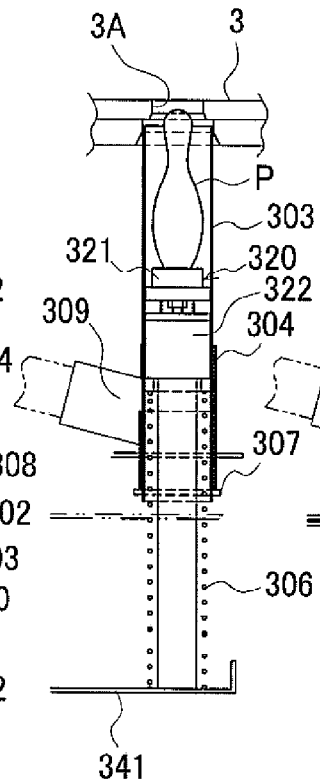
Figure 17C:
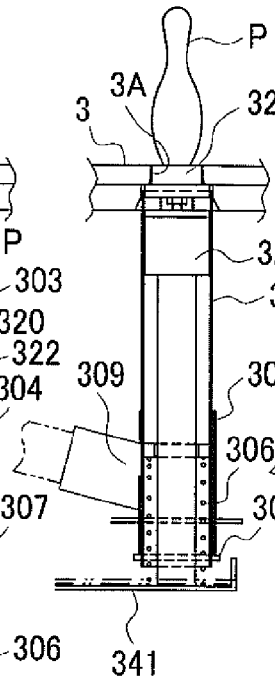
Figure 17D:
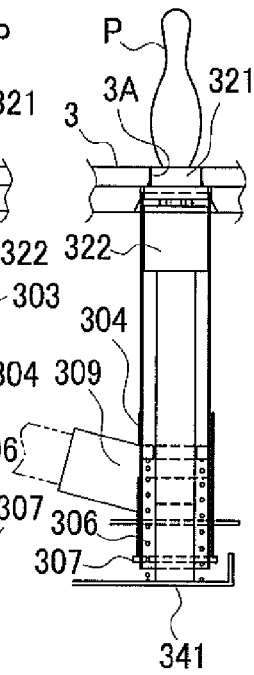

FIG. 12 is a view taken in a direction of an arrow B in FIG. 1. FIG. 13 is a view showing an installed state of distribution shooters 250 viewed from its top. FIG. 14(*a*) is a view of a distribution mechanism 210 taken in the direction of the arrow B in FIG. 1, and FIG. 14(*b*) is a top view in FIG. 14(*a*). FIG. 15 is a view showing a schematic structure of a pin conveyance mechanism 200. FIG. 16 is a left side view in FIG. 15.

Figure 18:
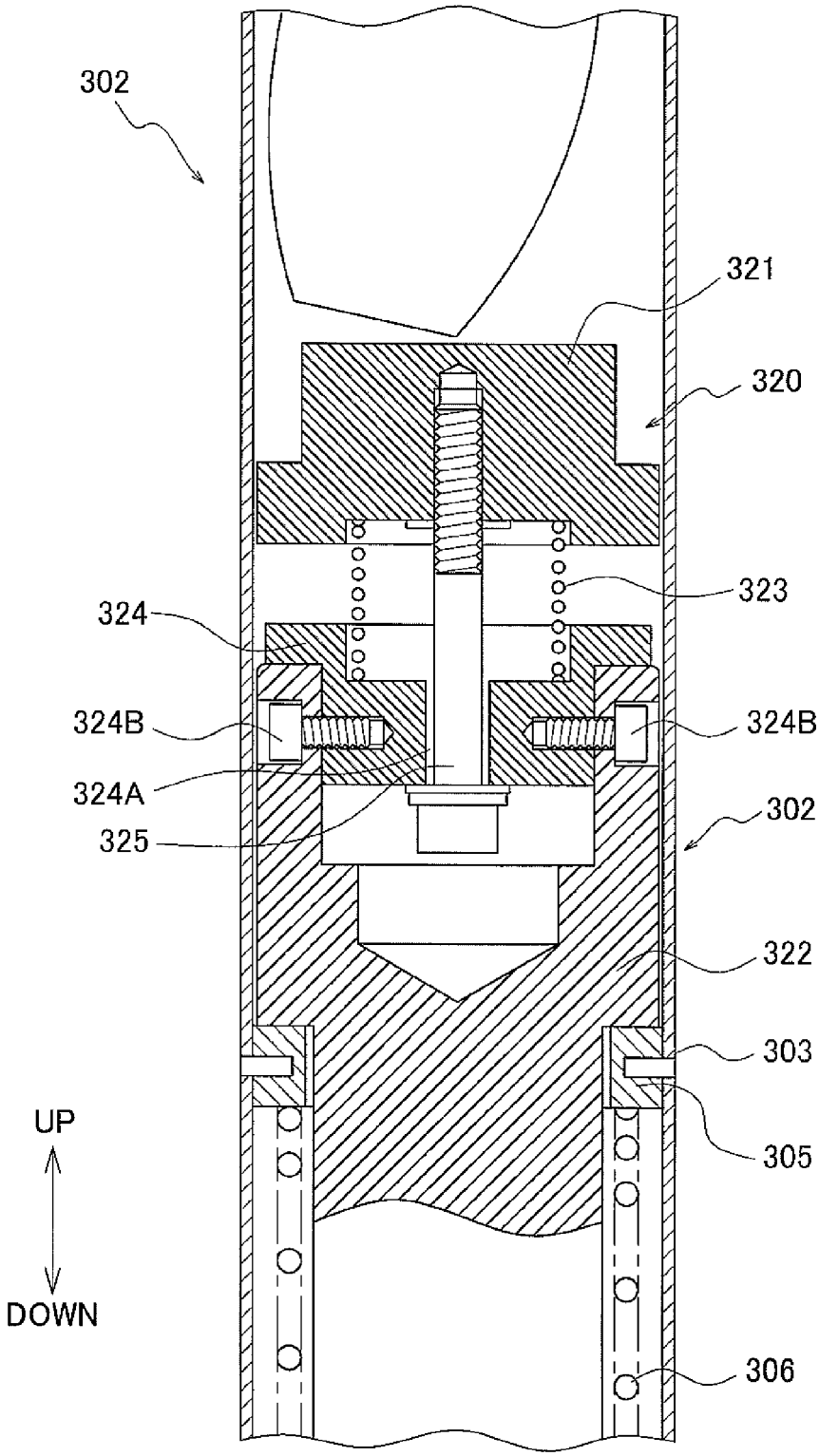
FIG. 18 is an enlarged view of a piston 320.
Figure 19B:
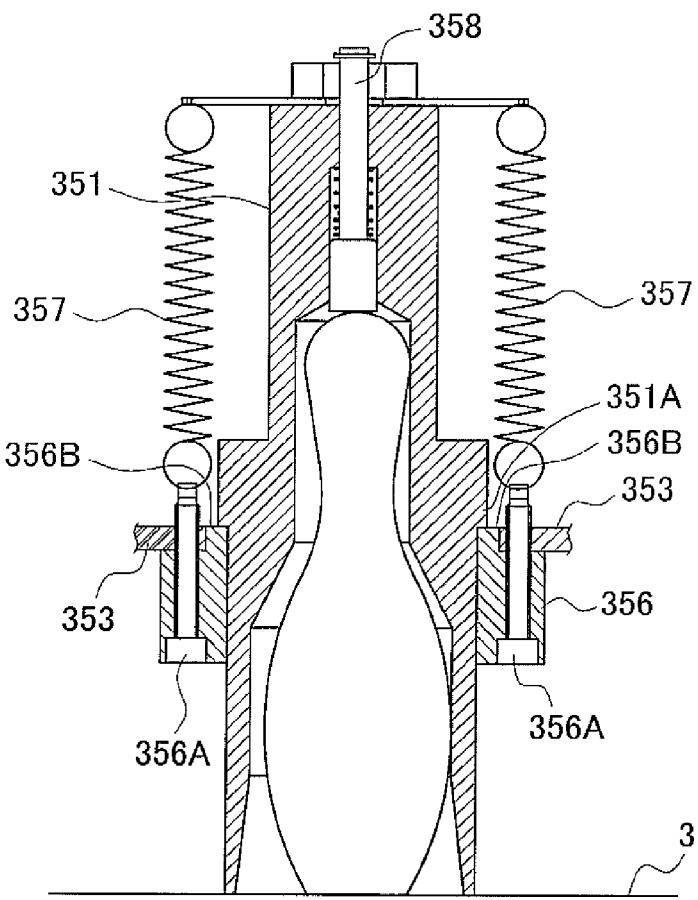
FIG. 19(*a*) is a cross sectional view of a pin guide 351, and FIG. 19(*b*) is a cross sectional view taken by a line 19B-19B in FIG. 19(*a*)
Figure 19A:
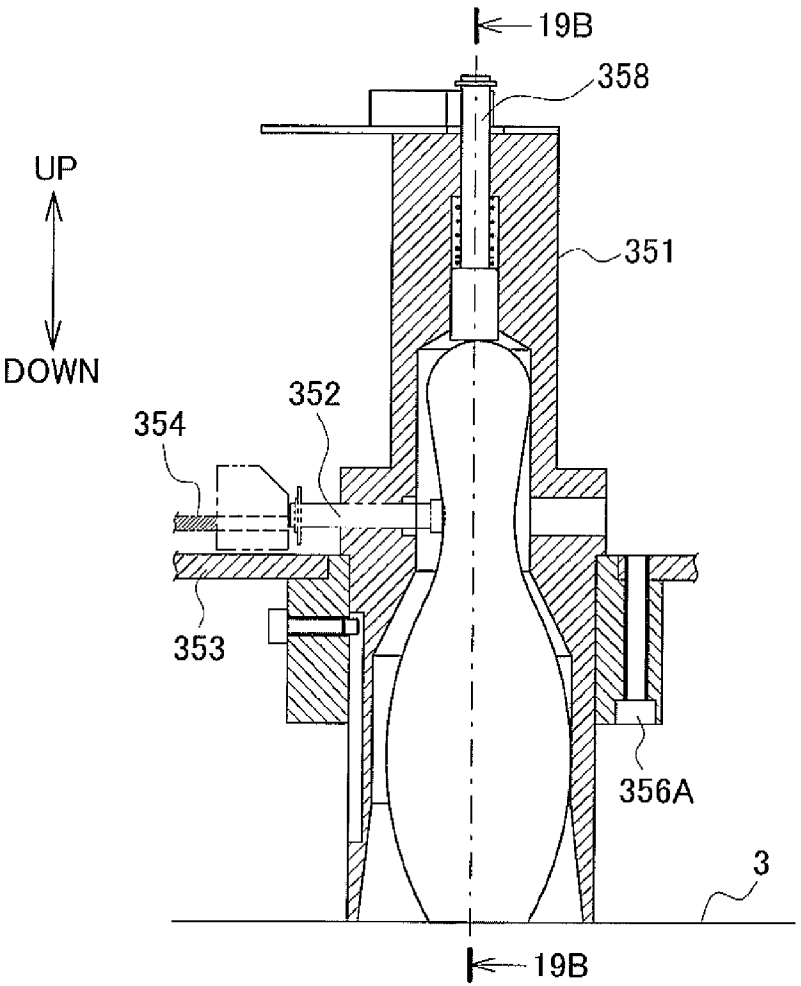
Figure 20:
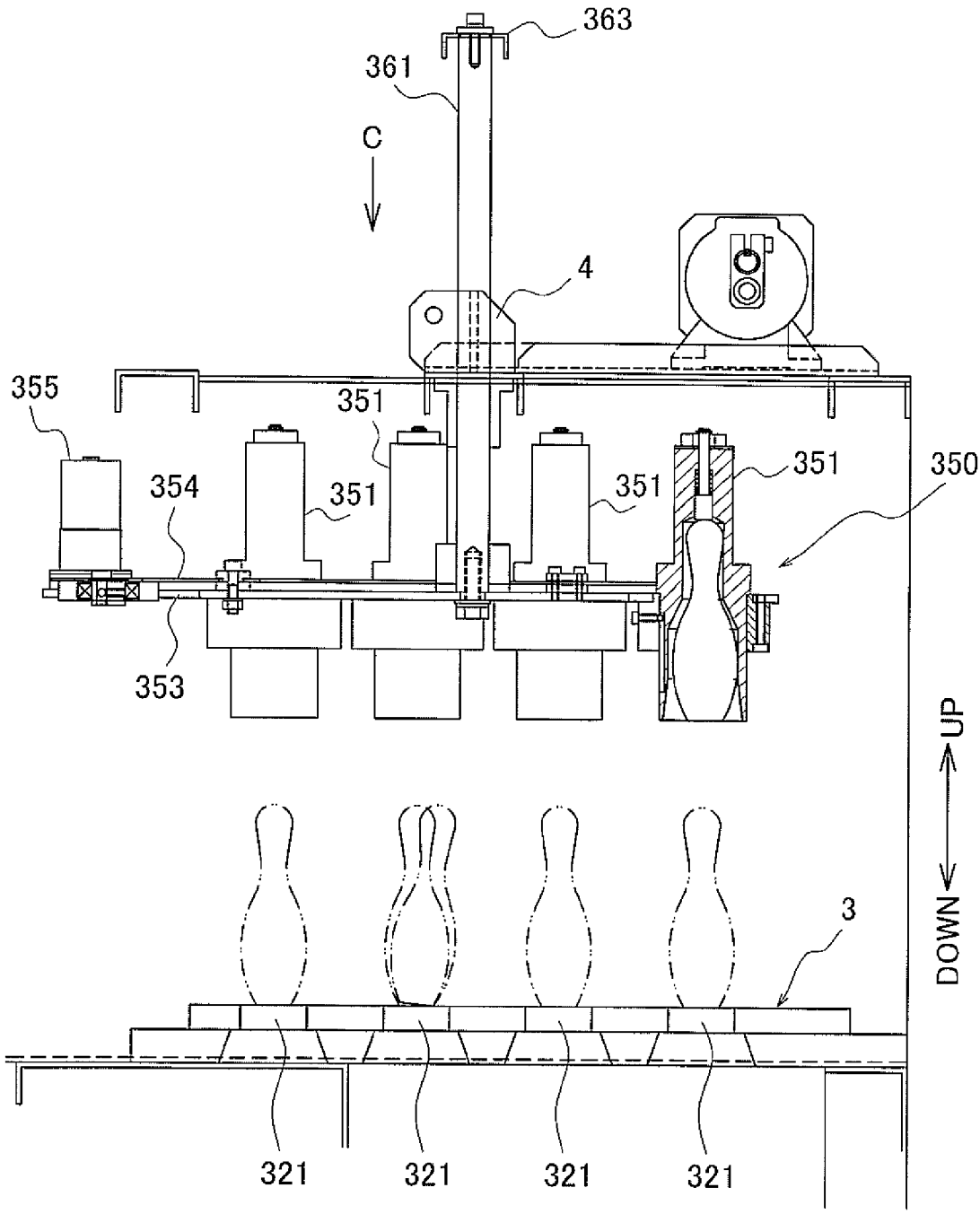
FIG. 20 is a view showing operation of an evacuation mechanism 360.
Figure 21:
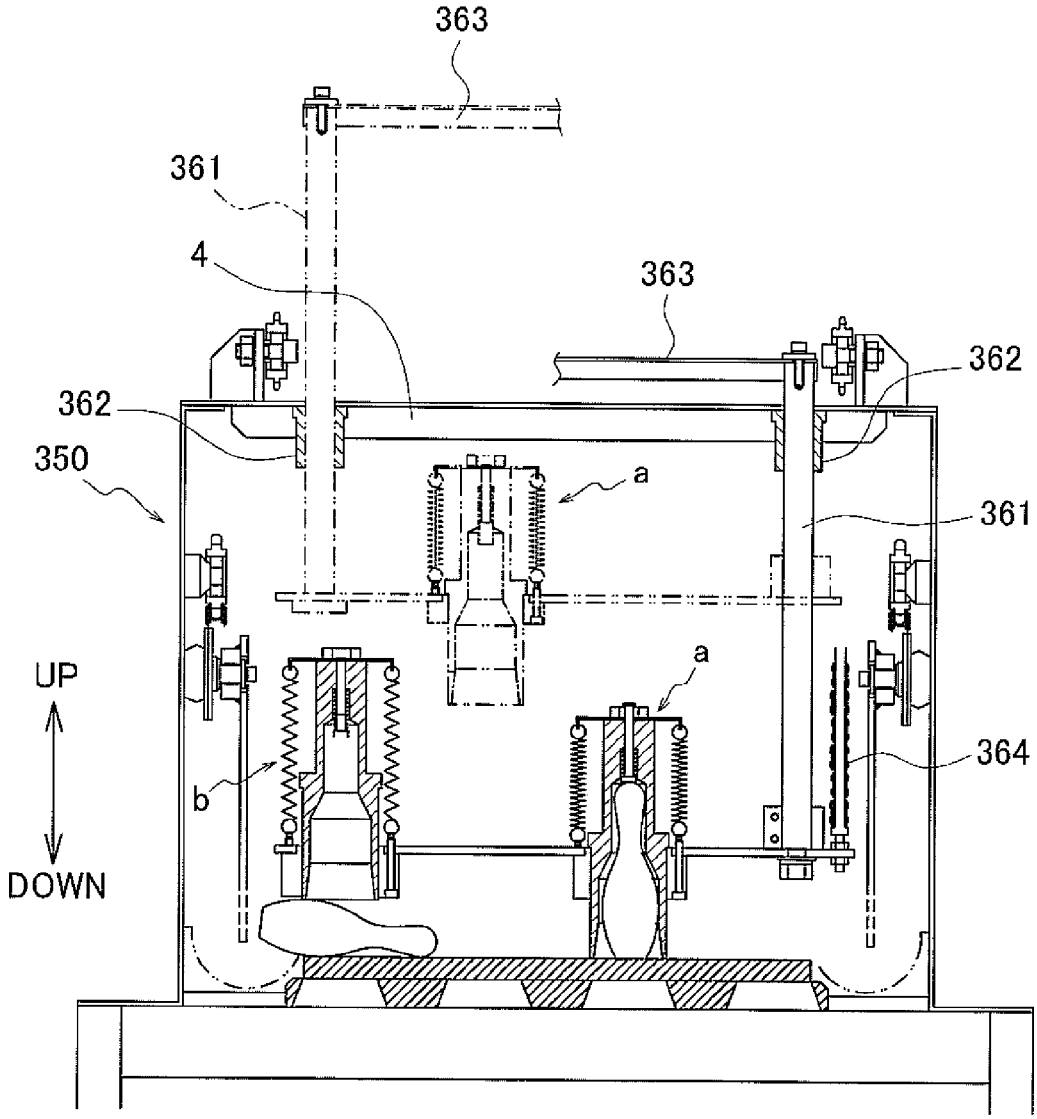
FIG. 21 is a view showing operation of the evacuation mechanism 360.

FIGS. 17(*a*) to 17(*d*) are views showing lifting operation of the pin P. FIG. 18 is an enlarged view of a piston 320. FIG. 19(*a*) is a cross sectional view of a pin guide 351, and FIG. 19(*b*) is a cross sectional view taken by a line 19B-19B in FIG. 19(*a*). FIGS. 20 and 21 are views showing operation of an evacuation mechanism 360.

Figure 22:
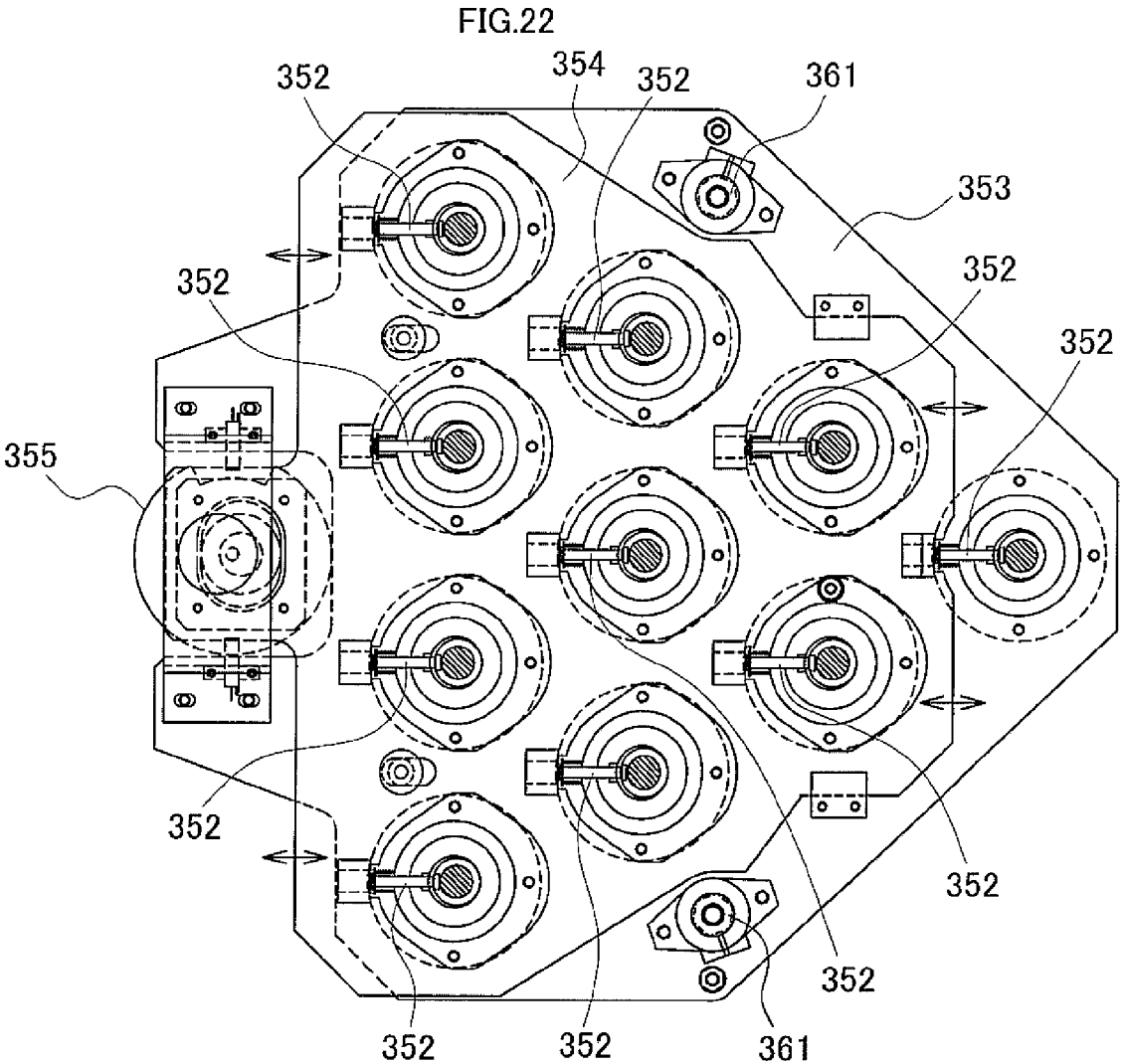
FIG. 22 is a view taken in a direction of an arrow C in FIG. 20.
Figure 23A:
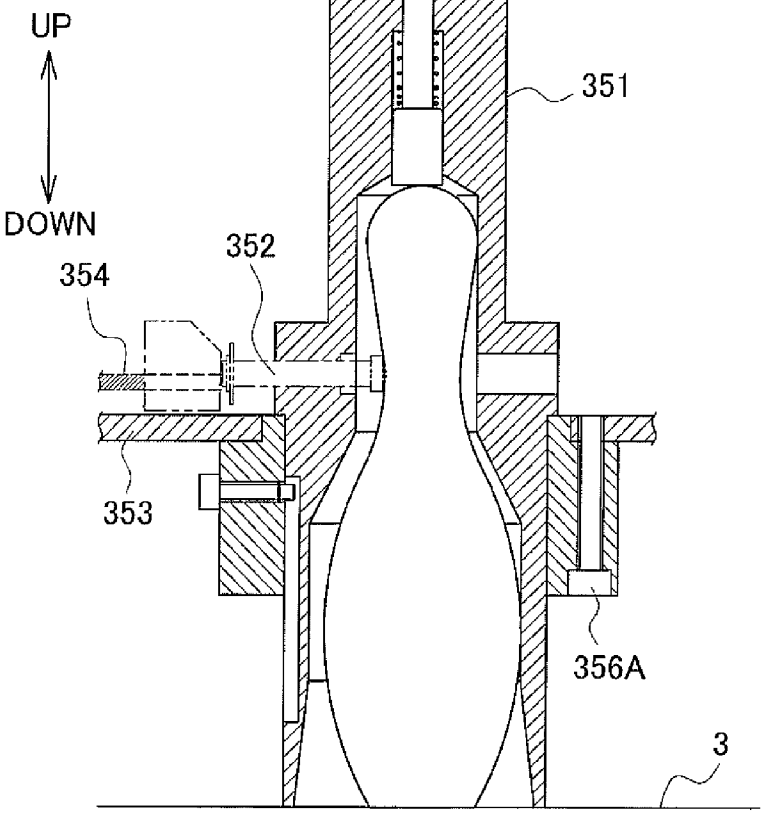
FIG. 23(*a*) is a view showing a state of the pin P being clamped by the pin guide 351, and FIG. 23(*b*) is a view showing a state in which the clamping of the pin P is released.
Figure 23B:
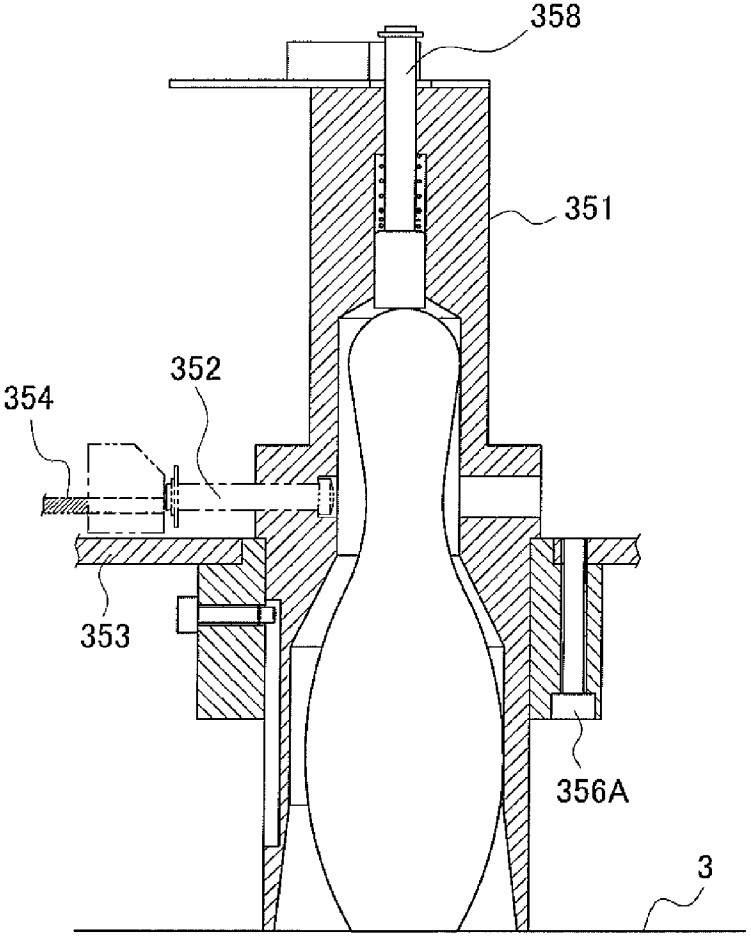
Figure 24:
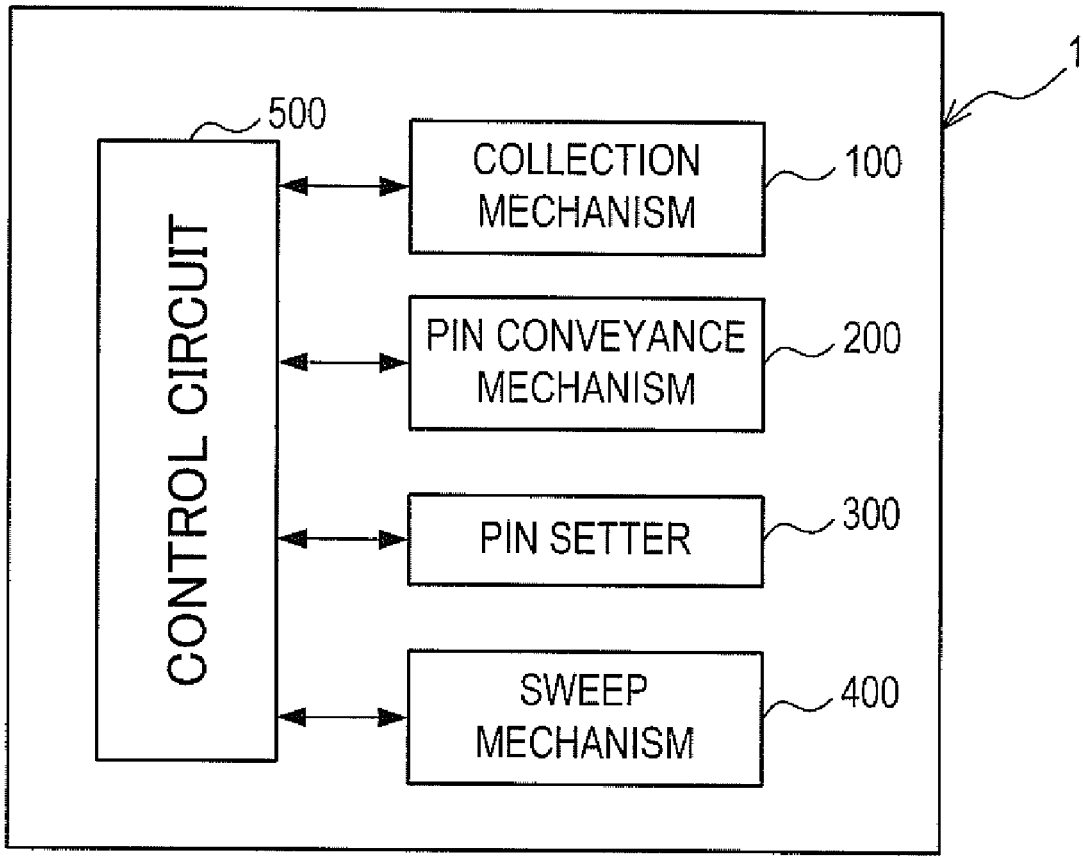
FIG. 24 is a block diagram showing an electric system of the bowling game machine 1.
Figure 25:
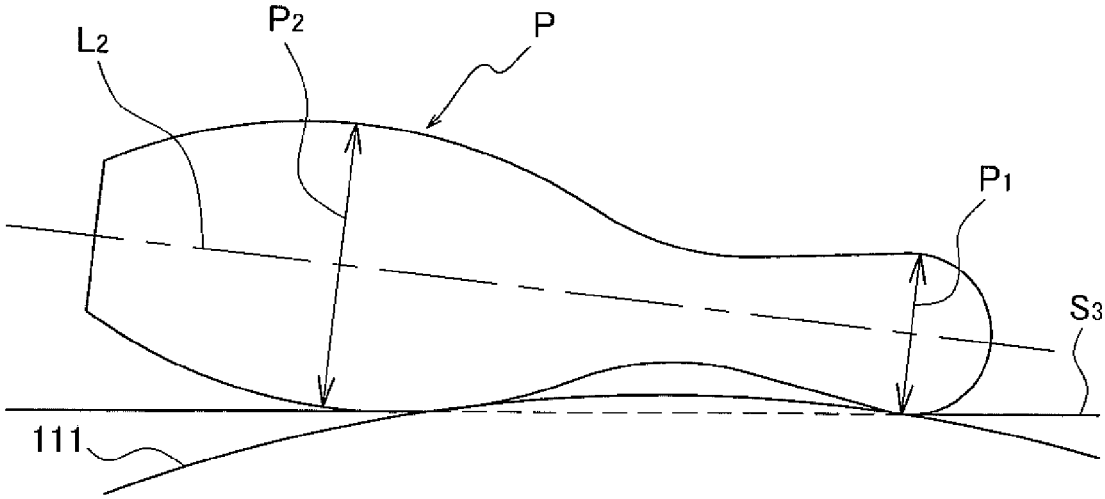
FIG. 25 is a view showing a state of the pin P received in a pocket 112A.

FIG. 22 is a view taken in a direction of an arrow C in FIG. 20. FIG. 23(*a*) is a view showing a state of the pin P being clamped by the pin guide 351, and FIG. 23(*b*) is a view showing a state in which the clamping of the pin P is released. FIG. 24 is a block diagram showing an electric system of the bowling game machine 1. FIG. 25 is a view showing a state of the pin P received in a pocket 112A.

2. Outline of the Bowling Game Machine

The bowling game machine 1 is, as noted above, a machine for use in a game to knock down the pins P arranged in a standing manner in the terminal end section of the lane 3 by rolling a ball from one end in a longitudinal direction of a lane 3 toward the other end (terminal end section).

In the terminal end section of the lane 3 and in a vicinity thereof, the collection mechanism 100, the pin conveyance mechanism 200, the pin setter 300, the sweep mechanism 400 for the pins P, and others are provided as shown in FIG. 1. The collection mechanism 100 collects the pins P and the ball B. The pin conveyance mechanism 200 conveys the pins P collected in the collection mechanism 100 to the pin setter 300. The pin setter 300 arranges the pins P in a standing manner at predetermined positions on the lane 3.

In the description hereinafter, the pin conveyance mechanism 200 and the pin setter 300 are separated into different mechanisms. This is to facilitate understanding of the bowling game machine 1 according to the present embodiment.

More specifically, how to separate mechanisms constituting the bowling game machine 1 is not limited to the way described below. For example, the pin conveyance mechanism 200 and the pin setter 300 may be constituted as a single mechanism (a pin setter).

Operation of the collection mechanism 100, the pin conveyance mechanism 200, the pin setter 300 and the sweep mechanism 400 is controlled by the control circuit 500, as shown in FIG. 24. The control circuit 500 is configured from a known microcomputer including a CPU, ROM, RAM and others. The control circuit 500 controls the collection mechanism 100 and others according to programs stored in a non-volatile storage device such as the ROM and the like.

3. Collection Mechanism 100

The collection mechanism 100 is, as shown in FIG. 1, a pin collection mechanism that collects the knocked down pins P and the ball B which has reached the terminal end section of the lane 3. The pins P collected by the collection mechanism 100 are conveyed to the pin setter 300 via the pin conveyance mechanism 200. The ball B is conveyed to one end side of the lane 3 via a return shooter 106 provided below the lane 3.

The collection mechanism 100 mainly includes a collector 110, a belt conveyor 101, a pin shooter 103, and a ball shooter 105 (see FIG. 3). The collector 110 is mainly constituted from a rotating drum 111. The belt conveyor 101 is arranged between the collector 110 and the lane 3. The pin shooter 103 guides the collected pins P to the pin conveyance mechanism 200. The ball shooter 105 guides the collected ball B to the return shooter 106.

The belt conveyor 101 has an endless belt rotationally driven by an electric motor to convey to the collection mechanism 100 the ball B which has reached the terminal end section of the lane 3 and the pins P swept out to the terminal end section of the lane 3.

The pin shooter 103, the ball shooter 105 and the return shooter 106 are guide devices which guide the pins P or the ball B to a predetermined region by dropping down the pins P or the ball B in a sliding manner, utilizing a difference in height.

The pin shooter 103 is configured from a tube or a gutter having flexibility, like a flexible tube. The ball shooter 105 and the return shooter 106 may be a flexible tube or a rigid tube, or a flexible gutter or a rigid gutter.

A bump plate 107 is a bump member against which the rolling ball B bumps thereby to drop the ball B on the belt conveyor 101. A sweeping blade 401 sweeps out the pins P and the ball B toward the belt conveyor 101. The sweeping blade 401 is moved from the right side to the left side in FIG. 1 by the sweep mechanism 400.

3.1. Collector

The collector 110 mainly includes, as shown in FIG. 2, the rotating drum 111 that rotates, a stationary plate 120, the shroud 130, and a motor 140 (see FIG. 9(*a*)). The stationary plate 120 is fixed to a frame (not shown) of the bowling game machine 1. The shroud 130 covers a lower end portion of the rotating drum 111. The motor 140 rotates the rotating drum 111.

As shown in FIG. 9(*a*), the rotating drum 111 is formed substantially into a plate. A side surface 111B orthogonal to a rotation axis 111A of the rotating drum 111 is inclined so as to intersect with a horizontal plane. On an outer peripheral side of the rotating drum 111, a plurality of projections 112 projecting radially outward are provided equiangularly, as shown in FIG. 2.

Recesses 112A formed between the projections 112 constitute a pin transfer unit which receives the pins P conveyed by the belt conveyor 101 (hereinafter, the recesses 112A are referred to as pockets 112A). With the rotating drum 111 rotating in a state in which the pins P are received in the pockets 112A, the pins P are transferred to the later described odd-shaped slit 121.

On a peripheral side inner than the pockets 112A of the rotating drum 111, through holes 113 are provided which penetrate the rotating drum 111, as shown in FIG. 9(*a*), in such a manner as to be depressed in a direction parallel to the rotation axis 111A from the side surface 111B of the rotating drum 111. Downward openings of the through holes 113 are shut by the stationary plate 120.

On the other hand, upward openings of the through holes 113 are positioned in a terminal end section of the belt conveyor 101 and are open. Thus, the through holes 113 are shut on downward sides to form recesses. Accordingly, the ball B conveyed by the belt conveyor 101 is received in the recess 113 (see FIG. 9(*b*)) as if dropping through the through hole 113 (hereinafter, the through hole 113 is referred to as the recess 113).

Consequently, when the rotating drum 111 rotates, the ball B received in the recess 113 is transferred together with the pins P received in the pockets 112A. In other words, the recess 113 serves as a ball transfer unit which transfers the ball.

As shown in FIG. 9(*a*), a guide blade 131 projecting toward the belt conveyor 101 side from the shroud 130 is provided between the belt conveyor 101 and the rotating drum 111. A gap between the guide blade 131 and the bet conveyor 101 is set to be sufficiently small so that the guide blade 131 and the belt conveyor 101 do not interfere with each other while the belt conveyor 101 is running.

Accordingly, the pins P and the ball B conveyed by the belt conveyor 101 slide on the guide blade 131 to reach the pockets 112A or the recess 113. More particularly, in the present embodiment, the belt conveyor 101 and the guide blade 131 constitute a conveyance device that conveys to the collection mechanism 100 the ball B which has reached the terminal end section of the lane 3 and the pins P swept out to the terminal end section of the lane 3.

A distance W between an end part 101A on the collector 110 side of the guide blade 131 and the rotating drum 111 is set to be smaller than a diameter of the ball B and larger than a maximum diameter of the pin P. Moreover, the end part 101A of the guide blade 131 is set to be higher than an upper end 112B of the pocket 112A and lower than an upper end 113A of the recess 113 in a vertical (up and down) direction.

The shroud 130, as shown in FIG. 2, covers at least only the pocket 112A positioned on a lowermost end side from the belt conveyor 101 side so that the pocket 112A positioned on the lowermost end side is formed into a pouch which opens upward.

The shroud 130 keeps the pins P dropped from the belt conveyor 101 into the pockets 112A from falling off from the pockets 112A and also keeps the plurality of pins P from entering to the single pocket 112A.

The shroud 130 covers only the pockets 112A completely. The recesses 113 are not completely covered by the shroud 130. Thus, the ball B conveyed by the belt conveyor 101 does not enter the pockets 112A but slides on the guide blade 131 to be received in the recess 113.

In the present embodiment, as shown in FIGS. 2, 4(*a*) and 4(*b*), an annular shroud ring 132 which covers the outer peripheral side of the rotating drum 111 is integrally formed with the shroud 130. The shroud ring 132 keeps the pins P received in the pockets 112A from radially falling out due to an inertial force (centrifugal force) accompanied with rotation of the rotating drum 111.

In the present embodiment, the guide blade 131 is attached to an upper end part 130A (see FIGS. 4(*a*) and 4(*b*)) of the shroud 130 as a separate component. However, the present embodiment is not limited to such structure. The guide blade 131 may be integrally formed with the shroud 130.

The stationary plate 120 is arranged on an undersurface side of the rotating drum 111 and shuts the pockets 112A. In an upper portion of the stationary plate 120, as shown in FIG. 2, an elongated hole-like odd-shaped slit 121 is provided which extends in a rotation direction of the rotating drum 111.

As shown in FIG. 8(*a*), the odd-shaped slit 121 is in a shape formed by connecting two types of long holes in their major axis directions, which are different in dimension in their minor axis directions. Particularly, a dimension A in a minor axis direction of a first hole 121A on a backward side (right side in FIG. 8(*a*)) in a rotation direction of the odd-shaped slit 121 is set to be larger than a diameter D1 (see FIG. 8(*b*)) of a small diameter portion P1 of the pin P and smaller than a diameter D2 (see FIG. 8(*b*)) of a large diameter portion P2 of the pin P.

A dimension B in a minor axis direction of a second hole 121B on a forward side (left side in FIG. 8(*a*)) in the rotation direction of the odd-shaped slit 121 is set to be larger than the diameter D2 of the large diameter portion P2 of the pin P. Accordingly, in the first hole 121A, only the small diameter portion P1 of the pin P can pass through the odd-shaped slit 121 and the large diameter portion P2 is caught by the first hole 121A. In the second hole 121B, the overall pin P can pass through the odd-shaped slit 121.

Between at least a region in which the odd-shaped slit 121 is provided of the stationary plate 120 and the rotating drum 111, a gap 122 is provided as shown in FIG. 6. On a side opposite to the gap 122 of the stationary plate 120, a funnel-shaped guide member 123 is attached which guides to the pin shooter 103 the pin P dropped off from the odd-shaped slit 121.

As shown in FIG. 5, the guide member 123 is configured to include a receiving surface 123A provided in a portion corresponding to the first hole 121A, and an inclined guide surface 123B provided in a portion corresponding to the second hole 121B. The receiving surface 123A is brought into contact with a tip end portion (small diameter portion P1 side) of the pin P passing through the first hole 121A to receive the pin P. The inclined guide surface 123B is inclined in such a manner as to go downward toward the forward side in the rotation direction (right side in FIG. 5) of the rotating drum 111.

An outlet 123C communicated with the pin shooter 103 is provided in a lowermost position in the inclined guide surface 123B. In the present embodiment, a center line L1 of the outlet 123C is shifted to the more forward side in the rotation direction (right side in FIG. 5) than a center of curvature O1 of an end portion on the forward side in the rotation direction of the second hole 121B, when viewed in a horizontal direction.

The receiving surface 123A is formed into a plane expanding in a horizontal direction. On a side of a border with the inclined guide surface 123B of the receiving surface 123A, a resistor 123D is provided which has a wall surface substantially orthogonal to the rotation direction of the rotating drum 111.

Thus, the tip end portion of the pin P dropped from the first hole 121A is caught by the resistor 123D, as shown in FIG. 6. In other words, the resistor 123D functions as an inhibitor that inhibits the tip end portion of the pin P dropped through the first hole 121A from moving in a unified manner with the rotation of the rotating drum 111.

The first hole 121A, the pocket 112A and the receiving surface 123A are, as shown in FIG. 6, arranged such that, in a state in which the tip end portion of the pin P is dropped through the first hole 121A, an upper outer periphery 121C of the first hole 121A comes into contact with the pin P, and a lower outer periphery 121D of the first hole 121A does not come into contact with the pin P.

Accordingly, in a state in which the tip end portion of the pin P is dropped through the first hole 121A, the pin P comes into contact with the outer periphery 121C of the first hole 121A above a center axis line L2 of the pin P, and comes into contact with the rotating drum 111 below the center axis line L2. At the same time, a contact portion 111C with the rotating drum 111 is positioned closer to a bottom side of the pin P than a contact portion 121E between the outer periphery of the first hole 121A and the pin P.

On the guide member 123 side of the odd-shaped slit 121, as shown in FIG. 11, a cover 124 is provided which opens/closes the odd-shaped slit 121. This cover 124 is driven to be opened/closed by a motor 124B via a link mechanism 124A.

Above a lowermost portion of the rotating drum 111 and below the odd-shaped slit 121 of the stationary plate 121, an elongate collection hole 125 is provided which takes out the ball B received in the recess 113 and transferred from the undersurface side of the rotating drum 111, as shown in FIG. 8(*a*). The collection hole 125 constitutes a ball collector. The ball shooter 105 (see FIG. 1) is attached to a region corresponding to the collection hole 125 of the stationary plate 120.

4. Pin Conveyance Mechanism

The pin conveyance mechanism 200 mainly includes a distribution mechanism 210, a conveyance unit 230, and the distribution shooters 250, as shown in FIG. 1. The distribution mechanism 210 distributes and arranges the ten pins P, which makes a set, one by one in a horizontal direction. The conveyance unit 230 conveys to distribution shooters 250 the pins P arranged in a straight line by the distribution mechanism 210. The distribution shooters 250 guide and transfer the pins P to predetermined positions on the later-described pin setter 300.

4.1. Distribution Mechanism

The distribution mechanism 210 is a mechanism which arranges the pins P one by one in a straight line on the conveyance belt 231 of the conveyance unit 230 by reciprocating an outlet side of the pin shooter 103 in a horizontal direction.

Particularly, as shown in FIGS. 14(*a*) and 14(*b*), the distribution mechanism 210 mainly includes a shooter fixture 201, a mount nozzle 202, a rail 203, a driving belt 204, and a motor 205. The outlet side of the pin shooter 103 is fixed to the shooter fixture 201. The mount nozzle 202 mounts the pins P discharged from the pin shooter 103 on the conveyance belt 231. The rail 203 supports the shooter fixture 201 and the mount nozzle 202 such that the shooter fixture 201 and the mount nozzle 202 can move in parallel with the rail 203. The shooter fixture 201 and the mount nozzle 202 are connected to the driving belt 204. The motor 205 rotates the driving belt 204.

The mount nozzle 202 is provided with a sensor (not shown) which detects whether or not the pin P has passed the mount nozzle 202. When the sensor detects passing of the pin P, the motor 205 rotates the driving belt 204 to move the shooter fixture 201 and the mount nozzle 202 in parallel with the rail 203.

In the present embodiment, while an inlet side (the guide member 123 side) of the pin shooter 103 is fixed to the guide member 123 and is immovable, the outlet side of the pin shooter 103 reciprocates in a longitudinal direction of the rail 203.

The ten pins P to be mounted on the conveyance belt 231 need to be mounted in parallel to a conveyance direction of the conveyance belt 231 such that the tip end portions of the pins P are positioned on a lower side. Therefore, it is preferable that an outlet of the mount nozzle 202 always faces a direction parallel to the conveyance direction of the conveyance belt 231.

In the present embodiment, the mount nozzle 202 is configured to move on the rail 203 in a state in which the outlet always faces the direction parallel to the conveyance direction of the conveyance belt 231. Also, the shooter fixture 201 is configured to move on the rail 203 while swinging on a swinging support 201A. Moreover, a dimension A on an inlet side of the mount nozzle 202 is set larger than a dimension C on the outlet side of the pin shooter 103.

The dimension A on the inlet side of the mount nozzle 202 is calculated by adding (taking into account) the dimension C on the outlet side of the pin shooter 103 and a swinging dimension of the shooter fixture 201, which is larger than a dimension B on an outlet side of the mount nozzle 202.

Also in the present embodiment, an inner diameter from the inlet side to the outlet side of the mount nozzle 202 is smoothly (continuously) reduced thereby to smoothly turn a discharge direction of the pins P discharged from the pin shooter 103 to the direction parallel to the conveyance direction of the conveyance belt 231.

4.2. Conveyance Unit

The conveyance unit 230 is a feeding unit which rotates the conveyance belt 231 to convey the pins P upward and then feeds to the distribution shooters 250 the ten pins P arranged in a straight line in a horizontal direction orthogonal to a conveyance direction (rotation direction of the conveyance belt 231).

On an outer peripheral side of the conveyance belt 231, as shown in FIG. 15, locking projections 232 projecting outward are provided at a plurality of positions. By means of the locking projections 232, the pins P mounted on the conveyance belt 231 by the distribution mechanism 210 are conveyed upward in a locked state (see FIG. 1).

On a top surface side of the conveyance unit 230, as shown in FIG. 16, a plurality of guide blades 233 are provided which inhibit the pins P being conveyed from largely leaning to the conveyance direction. The guide blades 233, as shown in FIG. 15, extend from one end side to the other end side in a longitudinal direction of the conveyance unit 230.

On the other end side in a longitudinal direction of the guide blade 233 (right end side in FIG. 15), a guide portion 234 is provided which is curved in such a manner as to follow an outer peripheral surface of a driven roller 235 to guide the conveyed pins P to pin feeding gates 251 of the distribution shooters 250.

A driving roller 236 rotationally drives the conveyance belt 231. The driving roller 236 rotates by receiving a driving force from a motor 237 via a power transmitter like a belt, a chain, and so on.

The driven roller 235 rotates in conjunction with rotation of the conveyance belt 231. The driven roller 235 is rotatably attached to a tension lever 238 swingably attached to a frame. A tension of the conveyance belt 231 is adjusted by the tension lever 238.

5. Pin Setter

The pin setter 300 is a mechanism which arranges the plurality of pins P conveyed by the pin conveyance mechanism 200 at predetermined positions on the lane 3. Particularly, as shown in FIG. 1, the pin setter 300 mainly includes the distribution shooters 250, a pin lifter 301, and a pin guide elevation mechanism 350.

5.1. Pin Lifter

The pin lifter 301 lifts the pins P in a standing state up onto the lane 3, as shown in FIG. 1. Particularly, the pin lifter 301 mainly includes a plurality of cylindrically formed cylinder portions 302 and an ascending mechanism 340. The pins P are loaded into the cylinder portions 302 in a standing state. The ascending mechanism 340 lifts the cylinder portions 302.

5.1.1. Ascending Mechanism

The ascending mechanism 340 mainly includes an ascending plate 341, a chain 342, and a pull-up machine 343. The ten cylinder portions 302 arranged to form a triangle (pyramid) are fixed on the ascending plate 341. The chain 342 moves up and down the ascending plate 341. The pull-up machine 343 pulls up the chain 342.

One end of the chain 342 is fixed to the ascending plate 341. The other end of the chain 342 is fixed to a fixed member such as the pull-up machine 343. The pull-up machine 343 mainly includes an arm 344 and a movable sprocket 345. The arm 344 is rotationally driven by a motor (not shown). The movable sprocket 345 is rotatably attached to a front end of the arm 344 to be engaged with the chain 342.

A pair of idle sprockets 346 apply a given tension to the chain 342 in order to inhibit the chain 342 from coming off from the movable sprocket 345. The idle sprockets 346 are rotatably fixed/supported to the fixed member such as the pull-up machine 343.

When the arm 344 is rotated to move the movable sprocket 345 from symbols "a" to "b", "b" to "c", "c" to "d", and then back to "a" or the other way around in FIG. 1, the ascending plate 341 moves up and down at a double speed in conjunction with rotation of the arm 344 thereby to move up and down the cylinder portions 302.

5.1.2. Cylinder Portion

The cylinder portion 302 mainly includes, as shown in FIG. 17(*a*), a first cylinder 303, a second cylinder 304, and a piston 320. The first cylinder 303 moves up and down with the ascending plate 341. The second cylinder 304 is arranged coaxial to the first cylinder 303 at an upper end portion of the first cylinder 303 and fixed to a fixed member such as a frame. The piston 320 is displaced inside the first cylinder 303 in a longitudinal direction of the first cylinder 303.

On an inner wall of the first cylinder 303, as shown in FIG. 18, a first projection 305 is provided which projects inwardly. An upper end of a first coil spring 306 is caught by the first projection 305. A lower end of the first coil spring 306 is fixed to the ascending plate 341. Accordingly, the first cylinder 303 is in a state connected to the ascending plate 341 while supported by the ascending plate 341 via the first coil spring 306.

The piston 320 mainly includes a seat 321, a push rod 322, and an elastically deformable second coil spring 323. The seat 321 comes into contact with the bottom of the pin P and supports the pin P from below. The push rod 322 is attached and fixed to the ascending plate 341. The second coil spring 323 is arranged between the push rod 322 and the seat 321.

A holding member 324 is detachably attached and fixed to an upper end of the push rod 322 via a fastening unit such as a screw 324B. The seat 321 is connected to the push rod 322 via a bolt 325 which movably penetrates a through hole 324A provided in the holding member 324.

Accordingly, as the push rod 322 goes up, upward displacement (upward force) of the push rod 322 (ascending plate 341) is transmitted to the seat 321 via the second coil spring 323. To the contrary, as the push rod 322 goes down, downward displacement (downward force) of the push rod 322 (ascending plate 341) is transmitted to the seat 321 via the bolt 325.

Also, on an outer wall on a lower end of the first cylinder 303, a second projection 307 is provided which projects outward, as shown in FIG. 17(*a*). At a lower end of the second cylinder 304, a stopper 308 is provided which mechanically stops ascent of the first cylinder 303 by being hit by the second projection 307 as the first cylinder 303 goes up.

On a side surface of the second cylinder 304, a loading gate 309 is provided for loading the pin P guided to the cylinder portion 302 via the distribution shooter 250 into the first cylinder 303 (cylinder portion 302). The pin P loaded through the loading gate 309 into the cylinder portion 302 is stored inside the first cylinder 303 in a manner standing on the seat 321.

In a region corresponding to the cylinder portion 302 of the terminal end section of the lane 3, a hole 3A is provided through which the pin P is pushed up, as shown in FIG. 17(*b*). When the pin P is pushed up on the lane 3, the hole 3A is shut by the seat 321, as shown in FIG. 17(*c*).

More particularly, when the ascending plate 341 goes up from a state in which the first cylinder 303 is down (a state shown in FIG. 17(*a*)), the first coil spring 306 and the push rod 322 move up simultaneously. Thus, as shown in FIG. 17(*b*), the first cylinder 303 and the piston 320 move up in a unified manner until the second projection 307 hits the stopper 308.

When the second projection 307 hits the stopper 308, the first coil spring 306 is compressed and deformed to stop the ascent of the first cylinder 303. On the other hand, the push rod 322 moves up in a unified manner with the ascending plate 341. Consequently, as shown in FIG. 17(*c*), the piston 320 moves up in conjunction with the ascending plate 341 and the seat 321 fits into the hole 3A.

In this case, dimensions of the respective components are set such that ascent of the ascending plate 341 stops in a state in which the seat 321 fits into the hole 3A. Due to variation in dimension within dimensional tolerance, however, the ascending plate 341 may continue to move up even after the seat 321 fits into the hole 3A.

In the present embodiment, in case that the ascending plate 341 continues to move up, the ascent is absorbed by the second coil spring 323 (see FIG. 17(*d*)). Thus, the ascending force is inhibited from excessively acting on the lane 3 via the piston 320.

5.2. Distribution Shooter

The distribution shooters 250 are distribution devices that slide down the ten pins P conveyed by the conveyance unit 230 to be distributed to the respective loading gates 309 of the cylinder portions 302.

More particularly, the distribution shooters 250, as shown in FIG. 13, connect the ten pin feeding gates 251 arranged in a straight line to the ten loading gates 309 arranged to form a triangle at lower positions than the pin feeding gates 251. In the present embodiment, the distribution shooters 250 are constituted from flexible tubes or gutter-shaped rigid members.

Since the ten pins P are conveyed to the pin feeding gates 251 by the conveyance unit 230 in a state in which the pins P are arranged in a straight line, the ten pins P are fed to the pin feeding gates 251 (distribution shooters 250) almost simultaneously.

5.3. Pin Guide Elevation Mechanism

The pin guide elevation mechanism 350, as shown in FIGS. 19(*a*) and 19(*b*), mainly includes the pin guide 351, and the evacuation mechanism 360 (see FIG. 1). The pin guide 351 keeps the pin P lifted onto the lane 3 from falling down on the lane 3. The evacuation mechanism 360 evacuates the pin guide 351 from the lane 3.

5.3.1. Pin Guide

The pin guide 351 is, as shown in FIG. 19(*a*), formed into a cap which covers the pin P from the tip end portion of the pin P. The pin guide 351 mainly includes a clamping rod 352 and a pin sensor 358, inside thereof. The clamping rod 352 clamps the pin P by pressing the pin P onto an inner wall of the pin guide 351. The pin sensor 358 serves as a detector which is brought into contact with the tip end portion of the pin P and displaced thereby to detect presence/absence of the pin P.

The ten pin guides 351, as shown in FIG. 22, are attached to the lift plate 353 substantially formed into a pentagon, in a state arranged to form a triangle.

More particularly, as shown in FIG. 19(*b*), an annular fixture 356 is fixed to the lift plate 353 by a bolt 356A. The pin guide 351 is slidably inserted to the fixture 356 from above and caught on an upper end surface 356B of the fixture 356 by a stepped projection 351A provided in an outer periphery of the fixture 356.

An upper end side of the pin guide 351 is normally attracted to the lift plate 353 side by a pair of coil springs 357.

Accordingly, the lift plate 353 and the pin guide 351 normally move up and down in a unified manner, as shown by a symbol "a" in FIG. 21. However, when the pin P falls down and does not fit into the pin guide 351 thereby interfering with the pin guide 351, the pin guide 351 and the lift plate 353 separately move down so that the pin guide 351 is spaced from the lift plate 353, as shown by a symbol "b" in FIG. 21.

Also, a movable plate 354 which can be moved in parallel with the lift plate 353 is mounted on the lift plate 353. An actuator 355 which displaces the movable plate 354 with respect to the lift plate 353 is mounted on the lift plate 353. Moreover, the respective clamping rods 352 are connected to the movable plate 354.

When the movable plate 354 is displaced to the left side in FIG. 22 with respect to the lift plate 353, the clamping rod 352 is spaced from the pin P to release clamping of the pin P, as shown in FIG. 23(*b*). When the movable plate 354 is displaced to the right side in FIG. 22 with respect to the lift plate 353, the clamping rod 352 pushes the pin P so that the pin P is clamped by the pin guide 351, as shown in FIG. 23(*a*).

5.3.2. Evacuation Mechanism

The evacuation mechanism 360 is a mechanism for moving up and down the ten pin guides 351. As shown in FIG. 20, lower ends of a pair of elevation guides 361 are fixed to the lift plate 353. Above the lift plate 353, as shown in FIG. 21, guide shoes 362, which slidably come into contact with outer peripheries of the elevation guides 361 and guide up and down of the elevation guides 361, are fixed to a frame 4.

Upper ends of the pair of elevation guides 361 are connected via a beam 363. The beam 363 keeps a dimension between the pair of elevation guides 361 to be constant while the elevation guides 361 move up and down, thereby enabling the elevation guides 361 to smoothly move up and down.

One end of a chain 364 is connected to the lift plate 353 (see FIG. 21). The other end of the chain 364 is fixed to the frame 4 (see FIG. 1). The lift plate 353 is moved up and down in the same manner as the above-described ascending mechanism 340.

6. Schematic Operation of the Bowling Game Machine (BilliBow®)

The pins P knocked down by the ball B rolled by a player and the ball B, or the pins P swept out by the sweep mechanism 400 and the ball B, are conveyed to the collection mechanism 100 by the belt conveyor 101, as shown in FIGS. 9(*a*) to 9(*c*) and 10(*a*) to 10(*c*), and separated into the ball B and the pins P to be collected by the collection mechanism 100.

The collected pins P are oriented to the same direction when dropping through the odd-shaped slit 121, and guided to the conveyance unit 230 via the pin shooters 103. The collected ball B is moved up to a position higher than the lowermost portion of the rotating drum 111, and guided to the return shooter 106 via the ball shooter 105.

The pins P fed to the distribution shooters 250 by the conveyance unit 230 are loaded into the first cylinders 303, and moved up onto the lane 3. In this case, since the pin guides 351 are down onto the lane 3, the moved up pins P are set on the lane 3 in such a manner as to be loaded into the pin guides 351 from below.

When the holes 3A in the lane 3 are shut by the seats 31, the pin guides 351 are evacuated upward from the lane 3. Then, a playable state is again established.

7. Characteristics of the Bowling Game Machine According to the Present Embodiment In the present embodiment, the rotating drum 111 is provided with the pockets 112A which constitute the pin transfer unit which transfers the pins P and the recesses 113 which constitute a ball transfer unit which transfers the ball B. Thus, the number of components of the collection mechanism 100 which collects the pins P and the ball B can be reduced to achieve a simple structure.

Also in the present embodiment, the distance between the end part 101A of the guide blade 131, which constitutes a conveyance device that conveys to the collection mechanism 100 the ball B which has reached the terminal end section of the lane 3 and the pins P swept out to the terminal end section of the lane 3, and the rotating drum 111 is set to be smaller than the diameter of the ball B and larger than the maximum diameter of the pins P, as shown in FIG. 9(*a*).

Figure 10A:
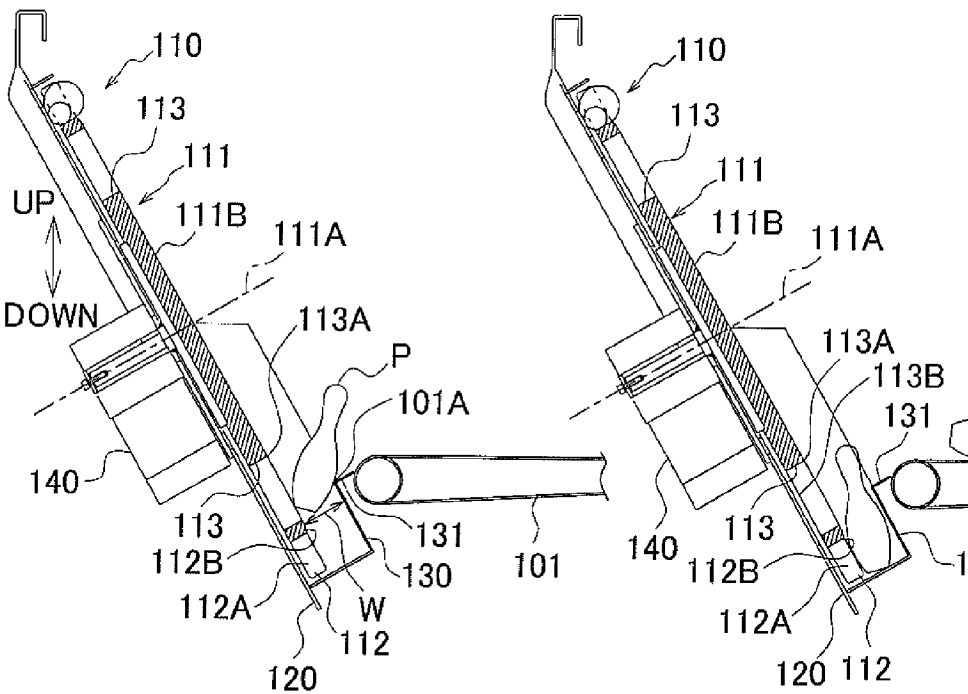
FIGS. 10(*a*) to (*c*) are views showing movements of the ball B and the pin P collected by the collection mechanism 100.
Figure 10B:
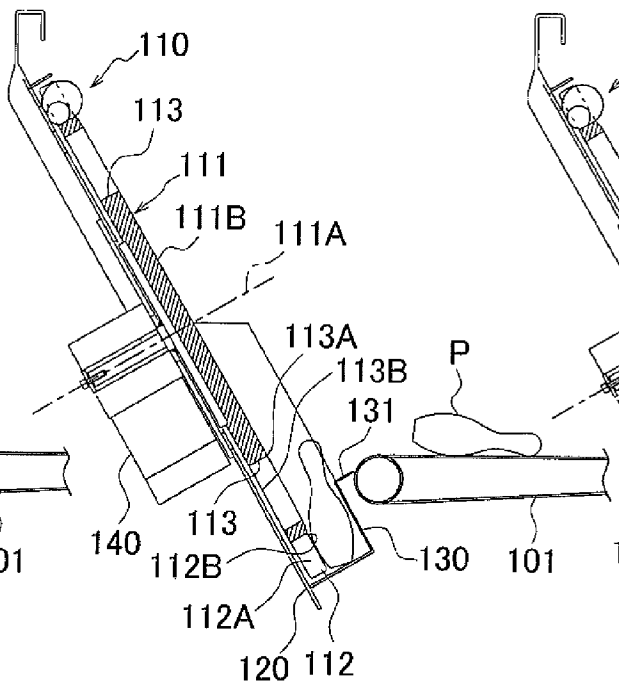
Figure 10C:
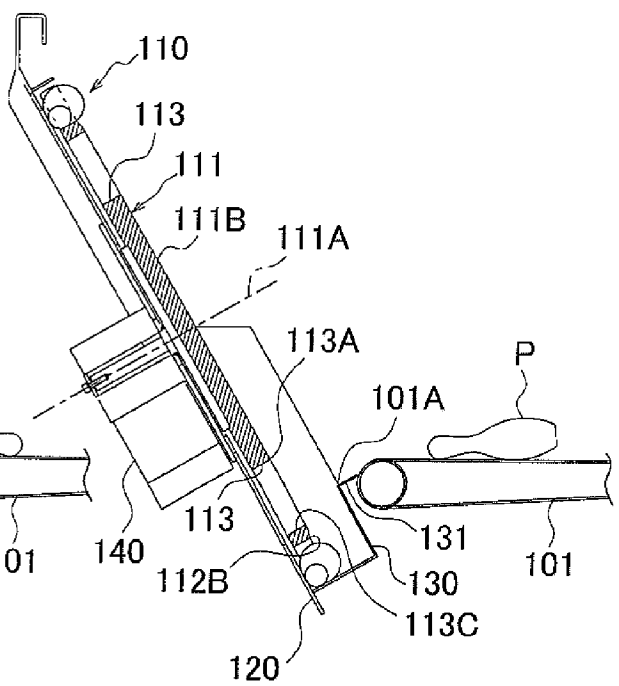

Moreover, the end part 101A of the guide blade 131 is set to be at a position higher than the upper ends 112B of the pockets 112A and lower than the upper ends 113A of the recesses 113 in a vertical direction. Thus, as shown in FIGS. 10(*a*) to 10(*c*), the pins P drop through a gap between the guide blade 131 and the collection mechanism 100 (rotating drum 111) to be received in the pocket 112A. The ball B is received in the recesses 113 without dropping through the gap, as shown in FIGS. 9(*a*) to 9(*c*).

Accordingly, even if the pins P and the ball B are conveyed together to the collection mechanism 100, the pins P and the ball B can be easily collected while being sorted.

Also in the present embodiment, the recess 113 is, as shown in FIG. 9(*b*), formed as a recess depressed in a direction parallel to the rotation axis 111A from the side surface 111B of the rotating drum 111, and the side surface 111B is inclined to a horizontal plane so that an opening of the recess 113 opens upward. Therefore, the ball B can be held with a bottom 113B and an inner peripheral side surface 113C of the recess 113.

Assuming that the side surface 111B of the rotating drum 111 is vertical, it is necessary to hold the ball B only with the inner peripheral side surface 113C of the recess 113. Thus, a depth (length) of the recess 113 has to be increased.

Accordingly, in the present embodiment, a thickness of the rotating drum 111 can be made small as compared to the case where the side surface 111B of the rotating drum 111 is vertical.

Also in the present embodiment, the dimension A in the minor axis direction of the first hole 121A on the backward side in the rotation direction of the odd-shaped slit 121 is set larger than the diameter of the small diameter portion P1 of the pin P and smaller than the diameter of the large diameter portion P2 of the pin P. Moreover, the dimension B in the minor axis direction of the second hole 121B in the forward side in the rotation direction of the odd-shaped slit 121 is set larger than the diameter of the large diameter portion P2.

Thereby, in the present embodiment, when the pin P reaches the odd-shaped slit 121 in a state in which the small diameter portion P1 side of the pin P is positioned on the forward side in the rotation direction of the rotating drum 111, the small diameter portion P1 drops through the first hole 121A in a state in which the large diameter portion P2 is caught by the first hole 121A once the small diameter portion P1 reaches the first hole 121A, as shown in FIG. 5. As a result, the pin P rotates such that the small diameter portion P1 goes below the large diameter portion P2.

More particularly, in a state in which the pin P is received in the pocket 112A, the pin P is conveyed to the odd-shaped slit 121 side in a state in which a center axis L2 of the pin P is inclined with respect to a virtual contact surface S3 which passes a contact portion S1 between the large diameter portion P2 and an inner wall of the pocket 112A and a contact portion S2 between the small diameter portion P1 and the inner wall of the pocket 112A, as shown in FIG. 25.

As the tip end portion of the pin P reaches the odd-shaped slit 121 in the above-described state, a wall supporting the small diameter portion P1 disappears. As shown in FIGS. 5 and 6, once the small diameter portion P1 reaches the first hole 121A, the small diameter portion P1 drops through the first hole 121A. As a result, the pin P rotates such that the small diameter portion P1 goes below the large diameter portion P2.

In this case, the first hole 121A, that is the odd-shaped slit 121, is provided in the stationary plate 120 and immovable. Thus, a force (braking force) which inhibits the pin P from moving together with the rotating drum 111 is generated in a contact portion (brake point) between the large diameter portion P2 and the first hole.

On the other hand, since the bottom side of the pin P is pushed by the rotating drum 111, the bottom of the pin P rotates to the forward side in the rotation direction around the aforementioned brake point. The large diameter portion P2 is positioned on the more forward side in the rotation direction than the brake point. In other words, the large diameter portion P2 is positioned on the more forward side in the rotation direction than the small diameter portion P1.

In this case, the pin P receives a force directed forward in the rotation direction from the rotating drum 111 at a position closer to the bottom side than the brake point, and moves to the second hole 121B in a state receiving a force directed backward in the rotation direction at the brake point (a predrop state). Thus, the large diameter portion P2 reaches the second hole ahead of the small diameter portion P1.

Accordingly, as the large diameter portion P2 reaches the second hole 121B, the pin P rotates and drops such that the large diameter portion P2 goes below the small diameter portion P1.

When the pin P reaches the odd-shaped slit 121 in a state in which the large diameter portion P2 side of the pin P is positioned on the forward side in the rotation direction of the rotating drum 111, only the small diameter portion P1 drops through the first hole 121A. Then, the pin P moves to the second hole 121B in the aforementioned predrop state. Accordingly, when the large diameter portion P2 reaches the second hole 121B, the pin P drops such that the large diameter portion P2 goes below the small diameter portion P1, as described in the above.

In this manner, in the present embodiment, the pins P are rotated to be aligned in the same direction without reversing a moving direction of the pins P. Accordingly, a problem does not occur in principle in which the pins P pass over the odd-shaped slit 121 due to an inertial force acting on the pins P.

Thus, in the present embodiment, a high speed in collecting the pins P can be achieved without deteriorating a collection rate of the pins P.

In the invention described in Unexamined Japanese Patent Publication No. 11-333044, for example, in case that the pin P is sent such that the small diameter portion P1 is positioned on the forward side in the rotation direction, the pin P drops after the conveyance direction is reversed.

In case that the pin P is sent such that the large diameter portion P2 is positioned on the forward side in the rotation direction, the pin P drops without reversing the conveyance direction. Thus, in the invention described in Unexamined Japanese Patent Publication No. 11-333044, even if a rotation speed of the rotating drum 111 is constant, a period (timing) in which the pin P drops through a drop hole fluctuates depending on a state of the pin P sent to the drop hole.

More particularly, in the invention described in Unexamined Japanese Patent Publication No. 11-333044, in case that the pin P is sent such that the small diameter portion P1 is positioned on the forward side in the rotation direction, the timing in which the pin P drops through the drop hole fluctuates to be delayed as compared to the case where the pin P is sent such that the large diameter P2 is positioned on the forward side in the rotation direction.

Thus, in the invention described in Unexamined Japanese Patent Publication No. 11-333044, the timing fluctuates in which the pin P collected by the collection mechanism 100 is conveyed to the pin setter 300. The pin setter 300 may be highly likely to malfunction.

In contrast, in the present embodiment, in case that the pin P is sent such that the small diameter portion P1 is positioned on the forward side in the rotation direction, the pin P is rotated at the first hole 121A to be set to be in the predrop state and moved to the second hole 121B. Thus, the timings in which the pin P drops through the second hole 121B are almost the same in both the case where the pin P is sent such that the small diameter portion P1 is positioned on the forward side in the rotation direction and the case where the pin P is set such that the large diameter portion P2 is positioned on the forward side in the rotation direction.

Accordingly, in the present embodiment, fluctuation in timing can be reduced upon conveying the pins P collected by the collection mechanism 100 to the pin setter 300. The pin setter 300 can be kept from malfunctioning.

Also in the present embodiment, a gap 122 is provided between the region of the stationary plate 120 in which the odd-shaped slit 121 is provided and the rotating drum 111. Thus, a distance can be increased between a region which receives a force to move the pin P of the contact portions of the pin P and the rotating drum 111, and the brake point.

Accordingly, a moment can be increased for rotating the pin P from a state in which the small diameter portion P1 side of the pin P is positioned on the forward side in the rotation direction of the rotating drum 111 to the predrop state. The pin P can be reliably moved to the second hole 121B in the predrop state. Accordingly, in the present embodiment, a high speed in collecting the pins P can be achieved without deteriorating the collection rate of the pins P.

Also in the present embodiment, the resistor 123D is provided which serves as an inhibitor that inhibits the tip end portion of the pin P dropped through the first hole 121A from moving together with the rotation of the rotating drum 111. Thus, the tip end portion of the pin P can be reliably inhibited from moving together with the rotating drum 111. The pin P can be reliably rotated to be in the predrop state.

Also in the present embodiment, in a state in which the tip end portion of the pin P has dropped through the first hole 121A, the pin P comes into contact with the upper outer periphery 121C of the first hole 121A above the center axis line L2 of the pin P, and comes into contact with the rotating drum 111 below the center axis line L2, as shown in FIG. 6. Furthermore, the contact portion with the rotating drum 111 is positioned closer to the bottom side of the pin P than the brake point (contact portion between the outer periphery of the first hole 121A and the pin P).

Thus, the pin P in the predrop state is inhibited from dropping to a side opposite to a direction to drop in principle, that is, on a side opposite to the stationary plate 120 over the rotating drum 111. The pin P can be reliably moved to the second hole 121B in the predrop state. Accordingly, a high speed in collecting the pins P can be achieved without deteriorating the collection rate of the pins P.

Also in the present embodiment, the pins P slide down through the distribution shooters 250 to be guided to the predetermined positions, that is, to the loading gates 309 arranged to form a triangle. Thus, as compared to the invention described in Unexamined Patent Publication No. 11-333044 in which the pins P are fed and arranged at the predetermined positions one by one by means of an arm which stretches while swinging, the number of components of the pin setter 300 can be reduced to achieve a simple structure.

Also in the present embodiment, the conveyance unit 230 which serves as a feeder that feeds the pins P to the distribution shooters 250 can feed the pins P to the plurality of distribution shooters 250 simultaneously. Thus, the plurality of pins P can be fed and arranged in a short amount of time. A processing speed of the pin setter 300 can be enhanced.

Also in the present embodiment, the pin guides 351 are provided which keep the pins P lifted onto the lane 3 from falling down on the lane 3. Thus, the pins P arranged on the lane 3 can avoid falling down.

Also in the present embodiment, the loading gate 309 for loading the pin P is provided on the side surface of the cylinder portion 302 (second cylinder 304). Thus, the pin P can be loaded into the cylinder portion 302 (first cylinder 303) in a short amount of time.

More particularly, in the present embodiment, the pins P are arranged on the lane 3 by moving up the first cylinders 303. Assuming that the loading gate is provided on top of the cylinder portion as in the invention described in Unexamined Japanese Patent Publication No. 2002-119634, it is necessary to have the pin to be loaded into the cylinder portion next (next-to-be loaded pin) wait at a waiting position which is off the loading gate in order to avoid interference between the next-to-be loaded pin and the cylinder portion upon moving up the cylinder portion.

In the invention described in Unexamined Japanese Patent Publication No. 2002-119634, the next-to-be loaded pin has to be moved from the waiting position to the loading gate upon loading the pin into the cylinder portion. Thus, even if the cylinder portion goes down, the pin is unable to be loaded into the cylinder portion immediately.

In contrast, in the present embodiment, the loading gate 309 is provided on the side surface of the second cylinder 304. Therefore, it is not necessary to have the pin P to be loaded next wait at a position off the loading gate for operation of loading the next pin P.

Consequently, it is not necessary to move the pin P from the waiting position to the loading gate 309 upon operation of loading the next pin P. Also, since the pin P to be loaded next can be loaded into the cylinder portion 302 (first cylinder 303) almost as soon as the first cylinder 303 goes down, the pin P can be loaded into the cylinder portion 302 in a short amount of time.

Also in the present embodiment, after the first cylinder 303 and the piston 320 go up in a unified manner by a predetermined amount, only the piston 320 goes up to push up the pin P onto the lane 3 through the hole 3A provided in the lane 3. Thus, after the pin P is lifted up to the vicinity of the lane 3 while keeping the pin P from falling down in the first cylinder 303, only the pin P can be lifted onto the lane 3 by the piston 302.

Also in the present embodiment, the second coil spring 323 is provided which constitutes an elastic displacement portion between the seat 321 and the push rod 322. Thus, variations in dimension, variations in assembling dimension, etc. of the ascending mechanism 340 and the seat 321 can be absorbed by the second coil spring 323.

Also in the present embodiment, the evacuation mechanism 360 and the pin guides 351 are connected. The coil spring 357 is also provided which serves as an elastic displacement portion elastically displaceable in an up and down direction. Thus, the pin guides 351 can be reliably displaced in an up and down direction.

More particularly, when the pin guide 351 moves down in a state in which the pin P is fallen, the pin guide 351 interferes with the fallen pin P and is unable to go down completely. Descending operation of other pin guides 351 may be adversely affected.

In contrast, in the present embodiment, as shown by the symbol "b" in FIG. 21, even if the pin guide 351 interferes with the fallen pin P, the coil spring 357 can absorb the interference. Thus, the descending operation of the other pin guides can be kept from being adversely affected.

Also in the present embodiment, the pull-up machine 343 which moves up and down the ascending plate 341 and the evacuation mechanism 360 which moves up and down the lift plate 353 are constituted from a crank mechanism which utilizes rotation of an arm. Thus, a displacement speed can be reduced at the start and the end of displacement.

Accordingly, since a large inertial force can be kept from acting on the ascending plate 341 and the lift plate 353 at the start and the end of displacement, the ascending plate 341 and the lift plate 353 can be smoothly displaced.

Second Embodiment

In the first embodiment, the shroud ring 132 is integrated into the shroud 130. In the present embodiment, the shroud ring 132 is integrated into the rotating drum 111, and outer peripheral sides of the pockets 112A are closed.

Thereby, in the present embodiment, the pins P received in the pockets 112A can be kept from transferring to the odd-shaped slit 121 side while rubbing themselves against the shroud ring 132 upon rotation of the rotating drum 111. Thus, noise can be reduced which occurs when the pins P are transferred. Also, development of wear of the pins P, the shroud ring 132 and so on can be inhibited.

Third Embodiment

The present embodiment attempts to further improve pin collection efficiency in the collector 110. Hereinafter, the present embodiment is described by way of drawings.

Figure 26:
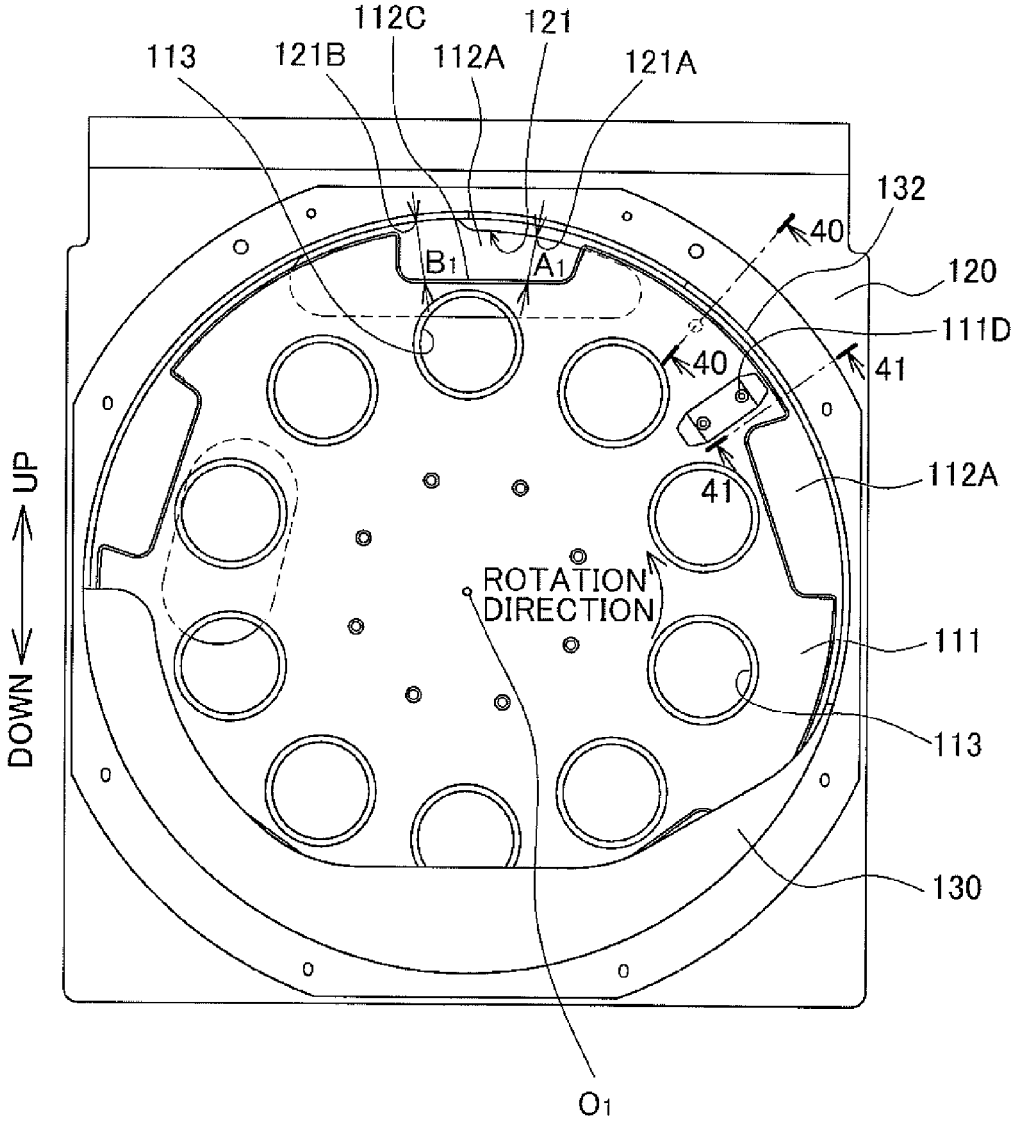
FIG. 26 is a front view of the collection mechanism 100.
Figure 27:
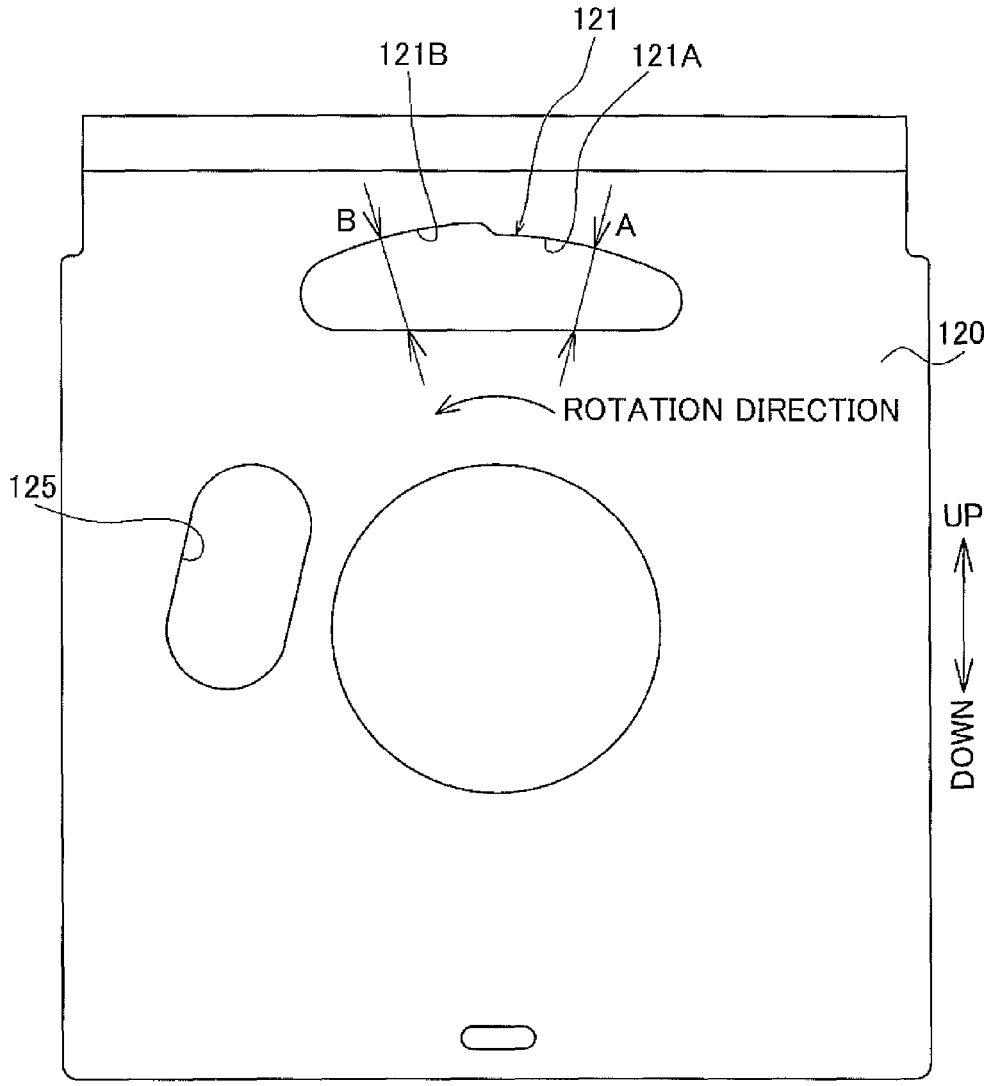
FIG. 27 is a front view of the stationary plate 120.
Figure 28:
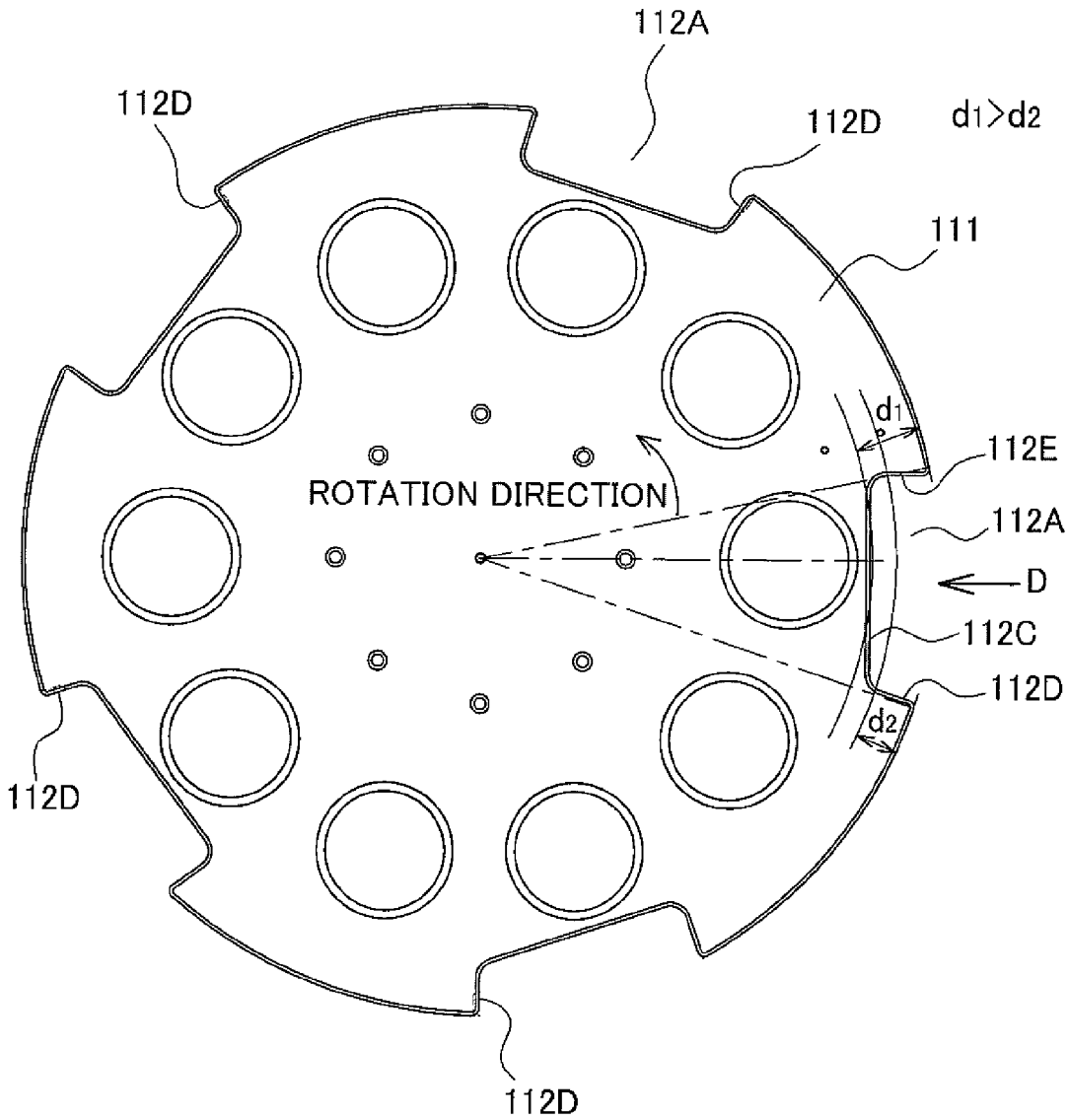
FIG. 28 is a front view of the stationary plate 120.
Figure 29A:
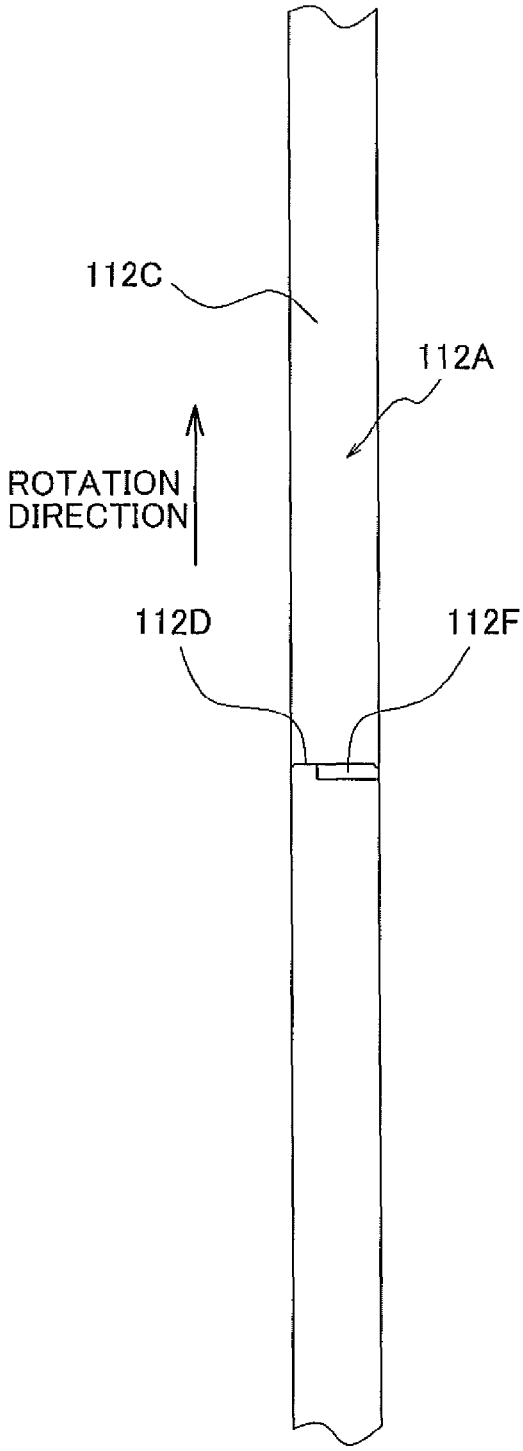
FIG. 29(*a*) is a view taken in a direction of an arrow D in FIG. 28, and FIG. 29(*b*) is a right side view in FIG. 29(*a*)
Figure 29B:
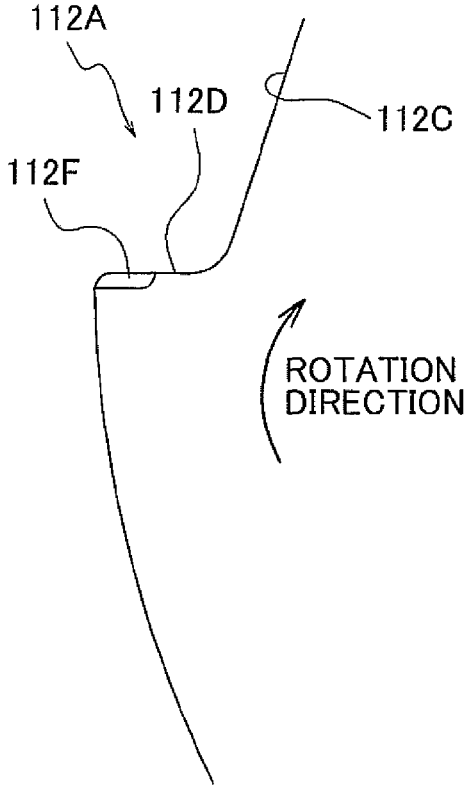

FIG. 26 is a front view of the collection mechanism 100. FIG. 27 is a front view of the stationary plate 120. FIG. 28 is a front view of the stationary plate 120. FIG. 29(*a*) is a view taken in a direction of an arrow D in FIG. 28, and FIG. 29(*b*) is a right side view in FIG. 29(*a*).

Figure 30:
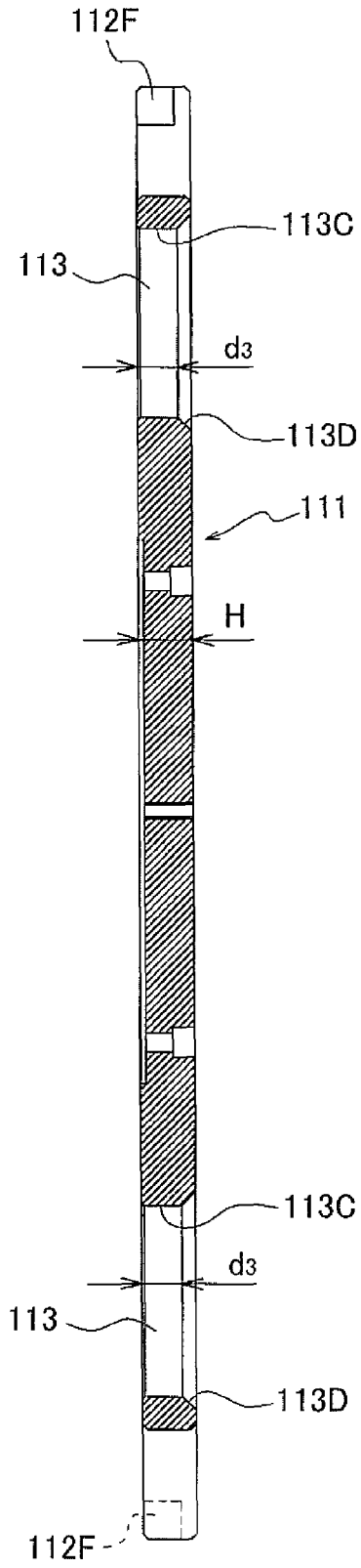
FIG. 30 is a cross sectional view of the rotating drum 111.
Figure 31B:
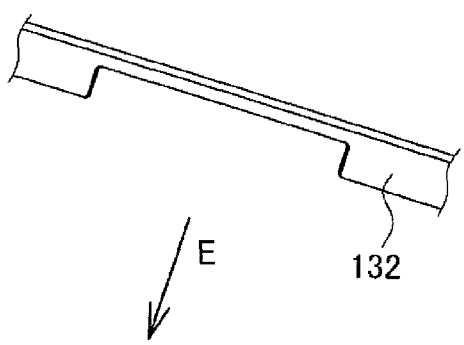
FIG. 31(*a*) is a front view of the shroud 130, and FIG. 31(*b*) is a view taken in a direction of an arrow E in FIG. 31(*a*)
Figure 31A:
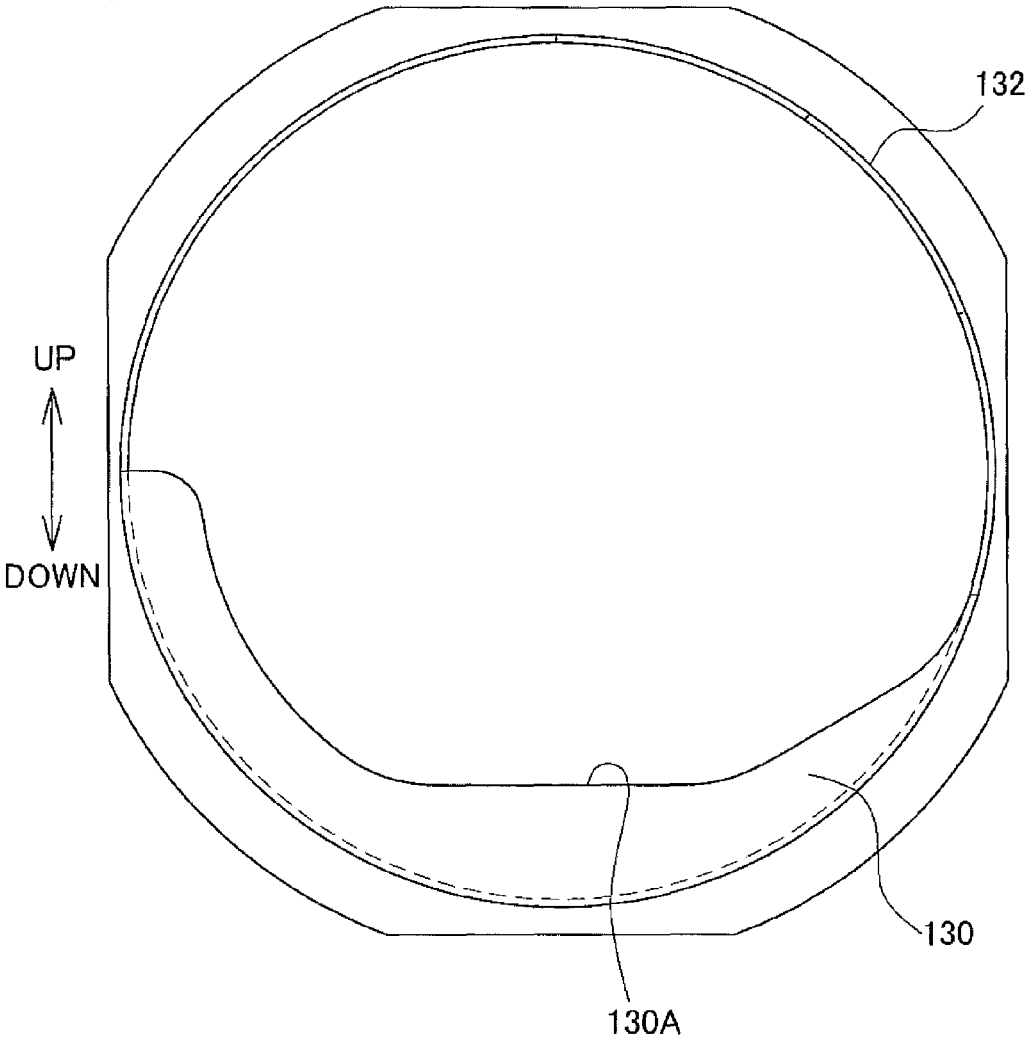
Figure 38:
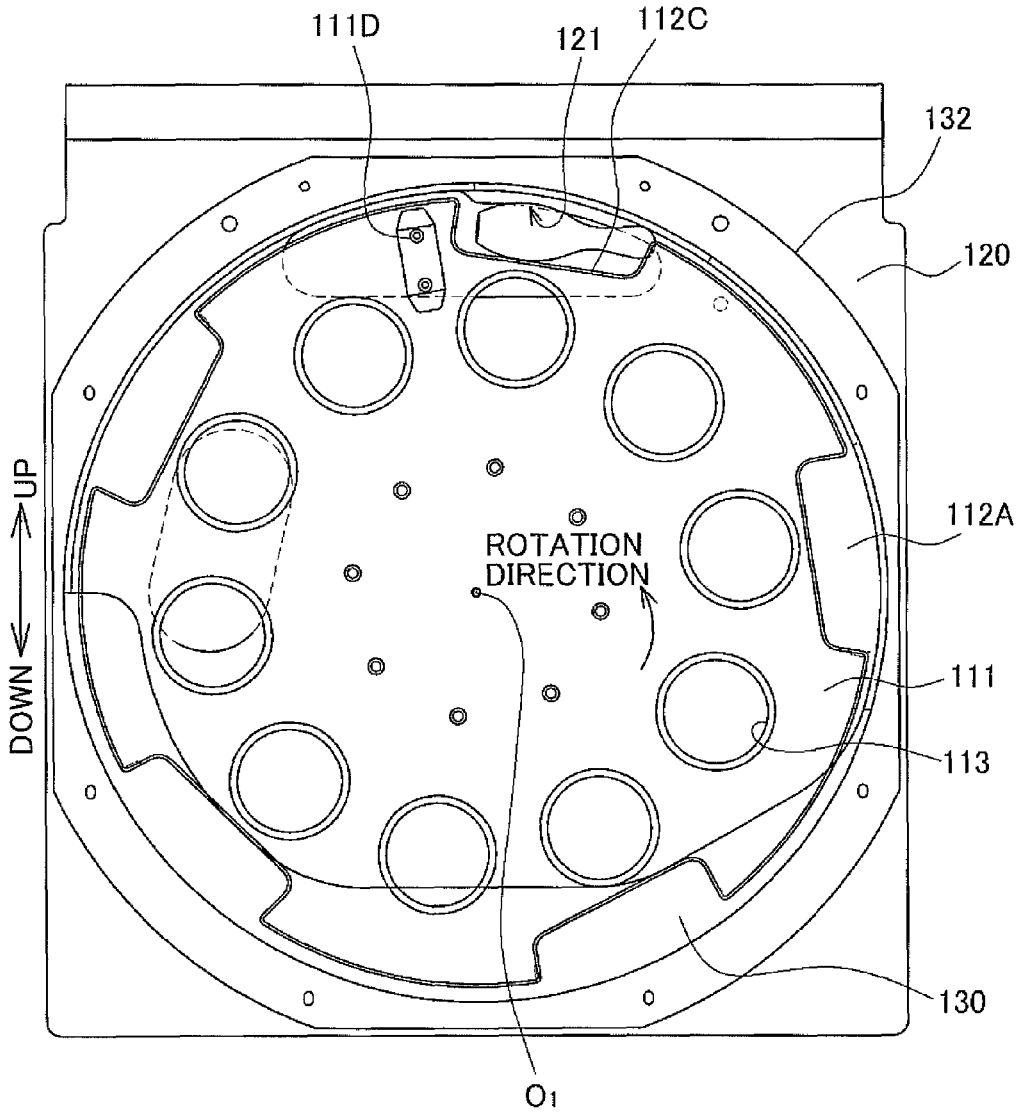
FIG. 38 is an operation explanatory view of the collection mechanism 100.
Figure 39B:
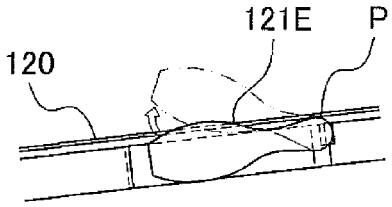
FIGS. 39(*a*) and 39(*b*) are operation explanatory views of the collection mechanism 100.
Figure 39A:
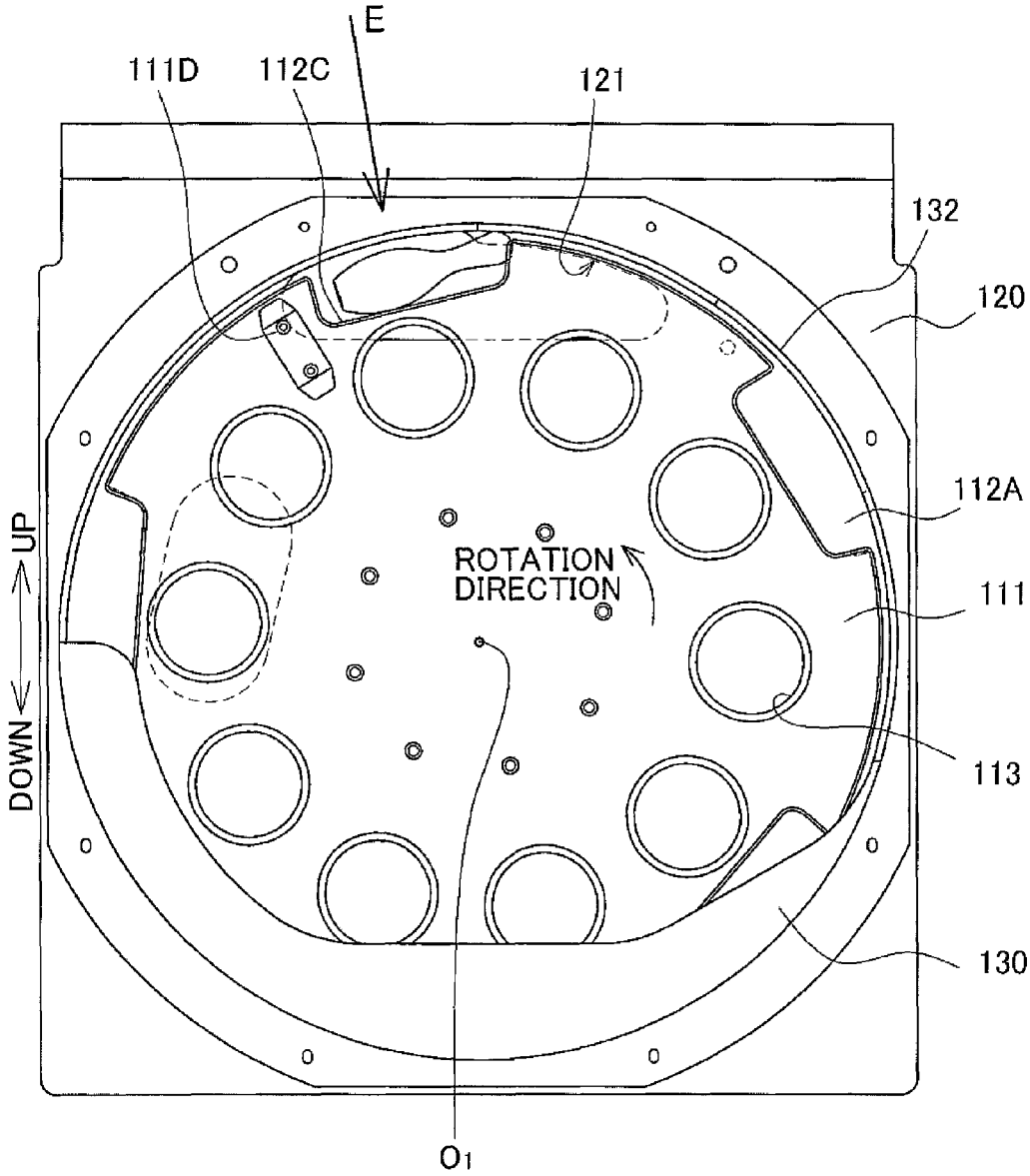
Figure 40:
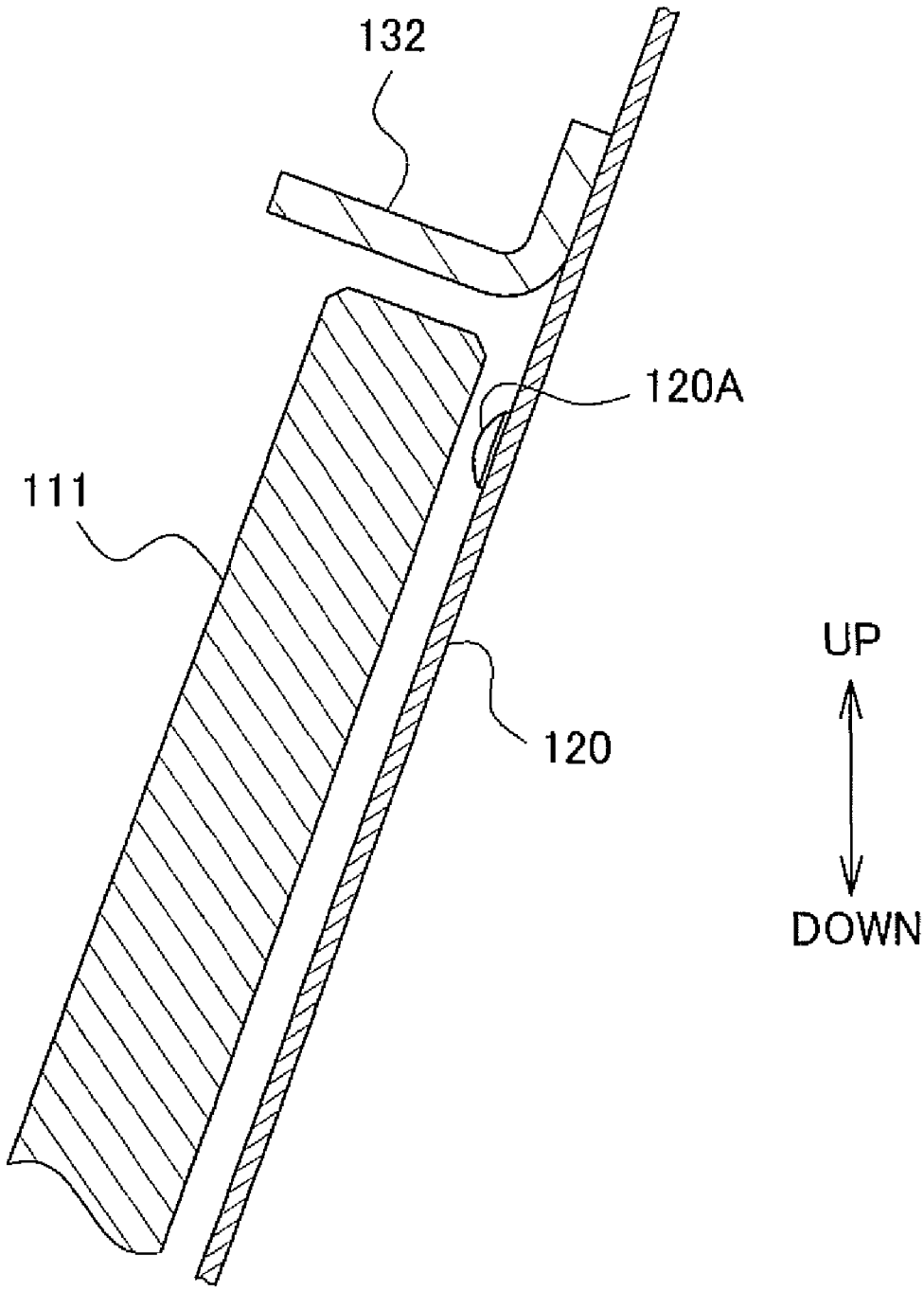
FIG. 40 is a cross sectional view taken by a line 40-40 in FIG. 26.
Figure 41:
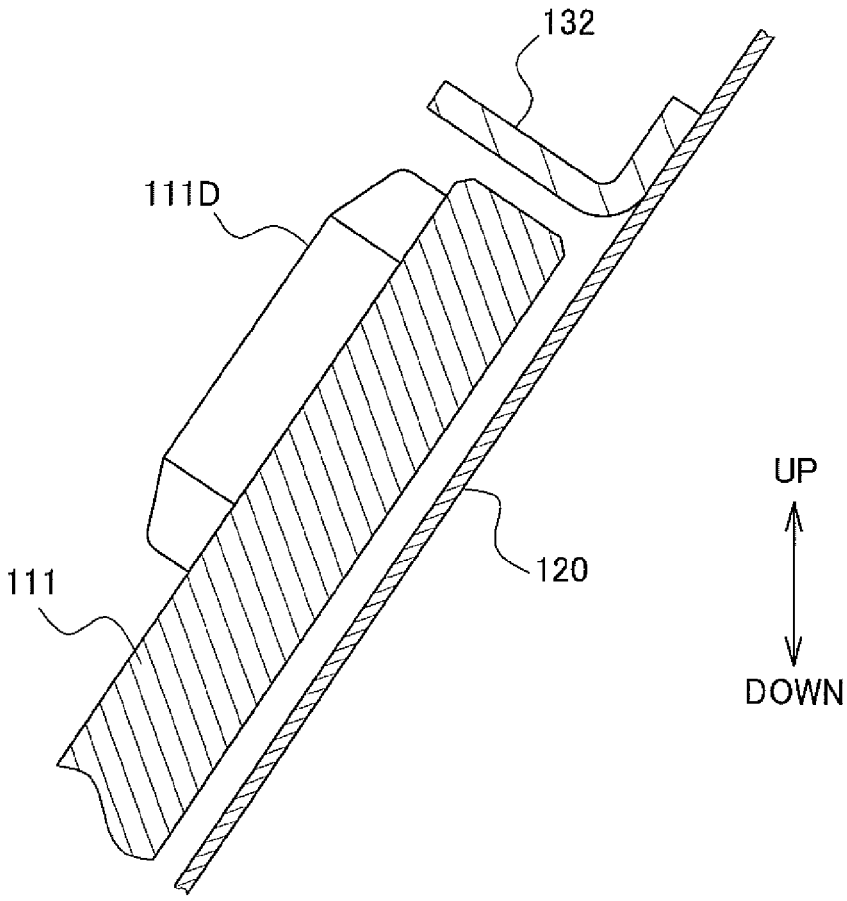
FIG. 41 is a cross sectional view taken by a line 41-41 in FIG. 26.
Figure 42:
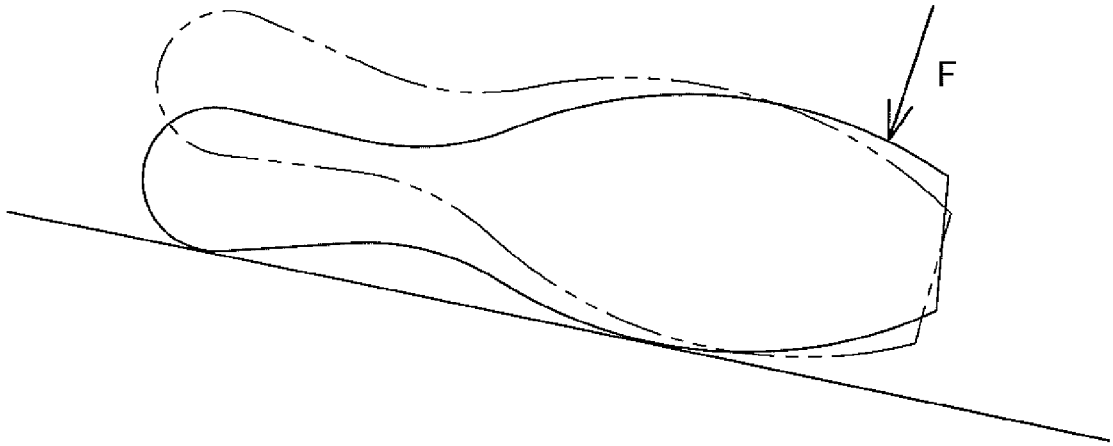
FIG. 42 is a view for explaining an effect of a recess 112F.

FIG. 30 is a cross sectional view of the rotating drum 111. FIG. 31(*a*) is a front view of the shroud 130, and FIG. 31(*b*) is a view taken in a direction of an arrow E in FIG. 31(*a*). FIGS. 32 to 39 are operation explanatory views of the collection mechanism 100. FIGS. 33(*b*), 34(*b*), 35(*b*), 36(*b*) and 39(*b*) are views taken in the direction of the arrow E (views from radially outside) in FIGS. 33(*a*), 34(*a*), 35(*a*), 36(*a*) and 39(*a*), respectively. FIG. 40 is a cross sectional view taken by a line 40-40 in FIG. 26. FIG. 41 is a cross sectional view taken by a line 41-41 in FIG. 26. FIG. 42 is a view for explaining an effect of a recess 112F.

1. Characteristic Structure of the Bowling Game Machine According to the Present Embodiment In the present embodiment, as shown in FIG. 26, a rotation center O1 side of the odd-shaped slit 121 is expanded toward the rotation center O1 over a bottom 112C of the pocket 112A so as to make the dimensions A and B (see FIG. 27) in the minor axis direction of the odd-shaped slit 121 larger than the dimensions in the above-described embodiment. Also, as shown in FIG. 31(*b*), part of the shroud ring 132 corresponding to the odd-shaped slit 121 is cut out.

In the present embodiment, a real dimension A1 (see FIG. 26) in the minor axis direction of the first hole 121A constituted by the rotating drum 111 and the odd-shaped slit 121 is about 0.9 times larger than the diameter D2 (see FIG. 8(*b*)) of the large diameter portion P2 of the pin P. A real dimension B1 (see FIG. 26) in the minor axis direction of the second hole 121B constituted by the rotating drum 111 and the odd-shaped slit 121 is about 1.1 times larger than the diameter D2 of the large diameter portion P2 of the pin P.

Also, a depth of the pocket 112A, that is, a length from an outer peripheral surface of the rotating drum 111 to the bottom 112C is, as shown in FIG. 28, set such that a depth d1 on the forward side in the rotation direction of the rotating drum 111 is larger than a depth d2 on the backward side in the rotation direction.

Thus, in the present embodiment, a side wall 112D on the backward side in the rotation direction of the side wall of the pocket 112A extends nearly in parallel to a radial direction from the rotation center O1, while a side wall 112E on the forward side in the rotation direction extends in parallel to a direction substantially orthogonal to the bottom 112C.

On the stationary plate 120 side of the side wall 112D on the backward side in the rotation direction, which is the shroud ring 132 side, the recess 112F is provided, as shown in FIGS. 29(*a*) and 29(*b*). The recess 112F is configured such that only the tip end portion of the pin P can fit in.

Figure 37A:
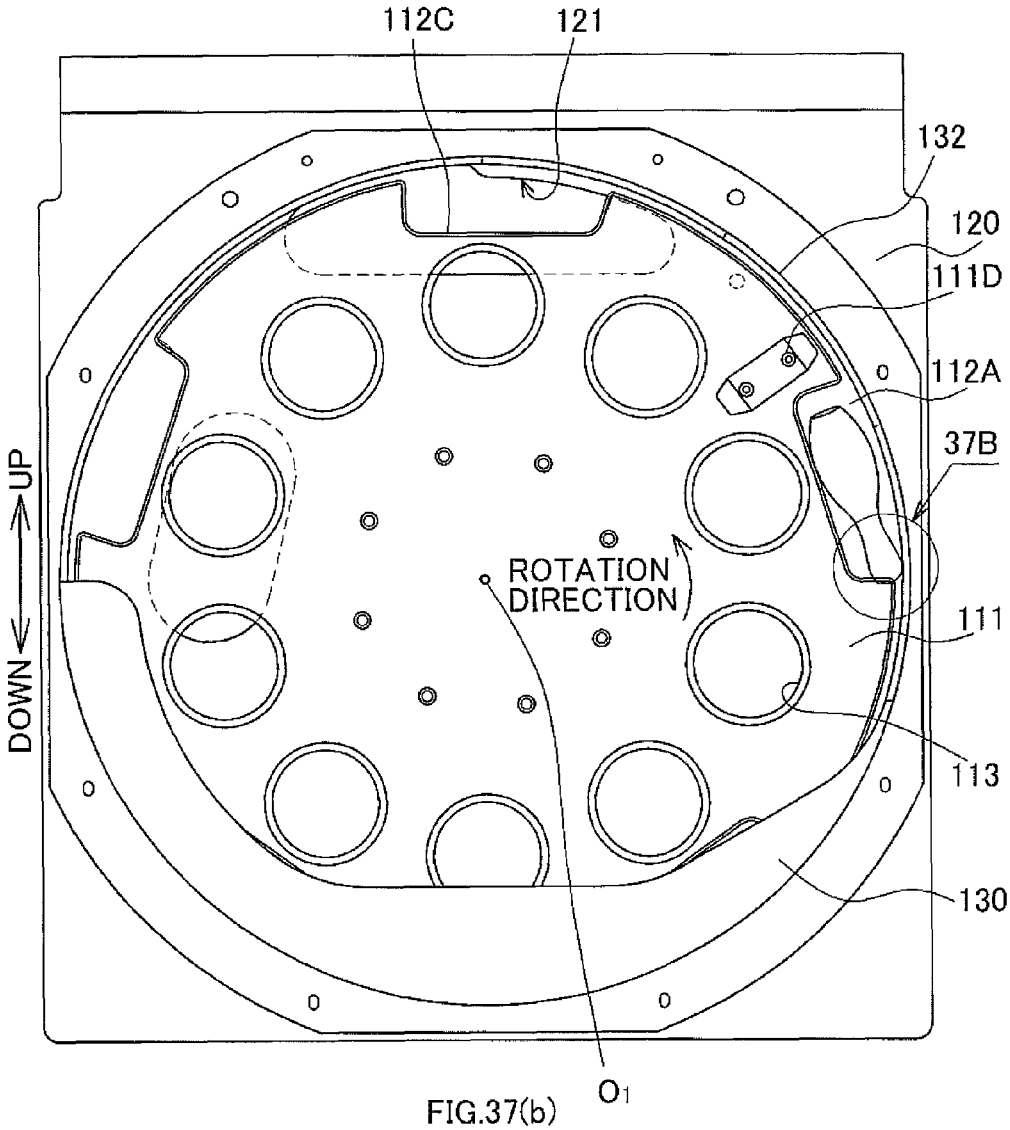
FIG. 37(*a*) is an operation explanatory view of the collection mechanism 100, and FIG. 37(*b*) is an enlarged view of a portion indicated by a symbol "37B" in FIG. 37(*a*)
Figure 37B:
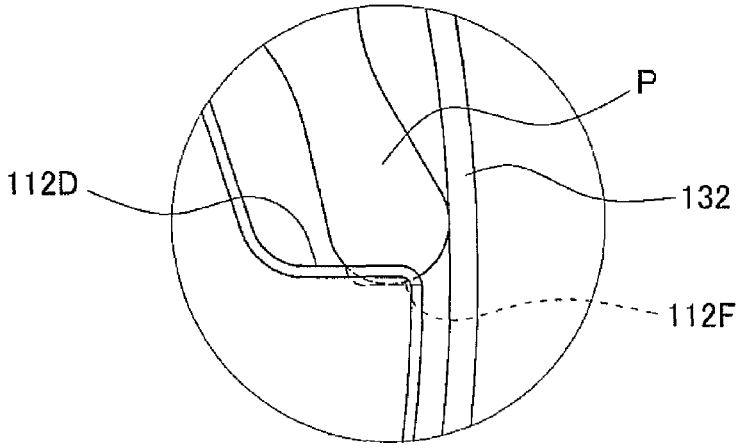

More particularly, as shown in FIG. 37(*a*), in case that the pin P is received in the pocket 112A such that the tip end portion of the pin P comes into contact with the side wall 112D on the backward side in the rotation direction, the pin P is transferred to the odd-shaped slit 121 in a state in which the tip end portion of the pin P fits in the recess 112F, as shown in FIG. 37(*b*).

Figure 32:
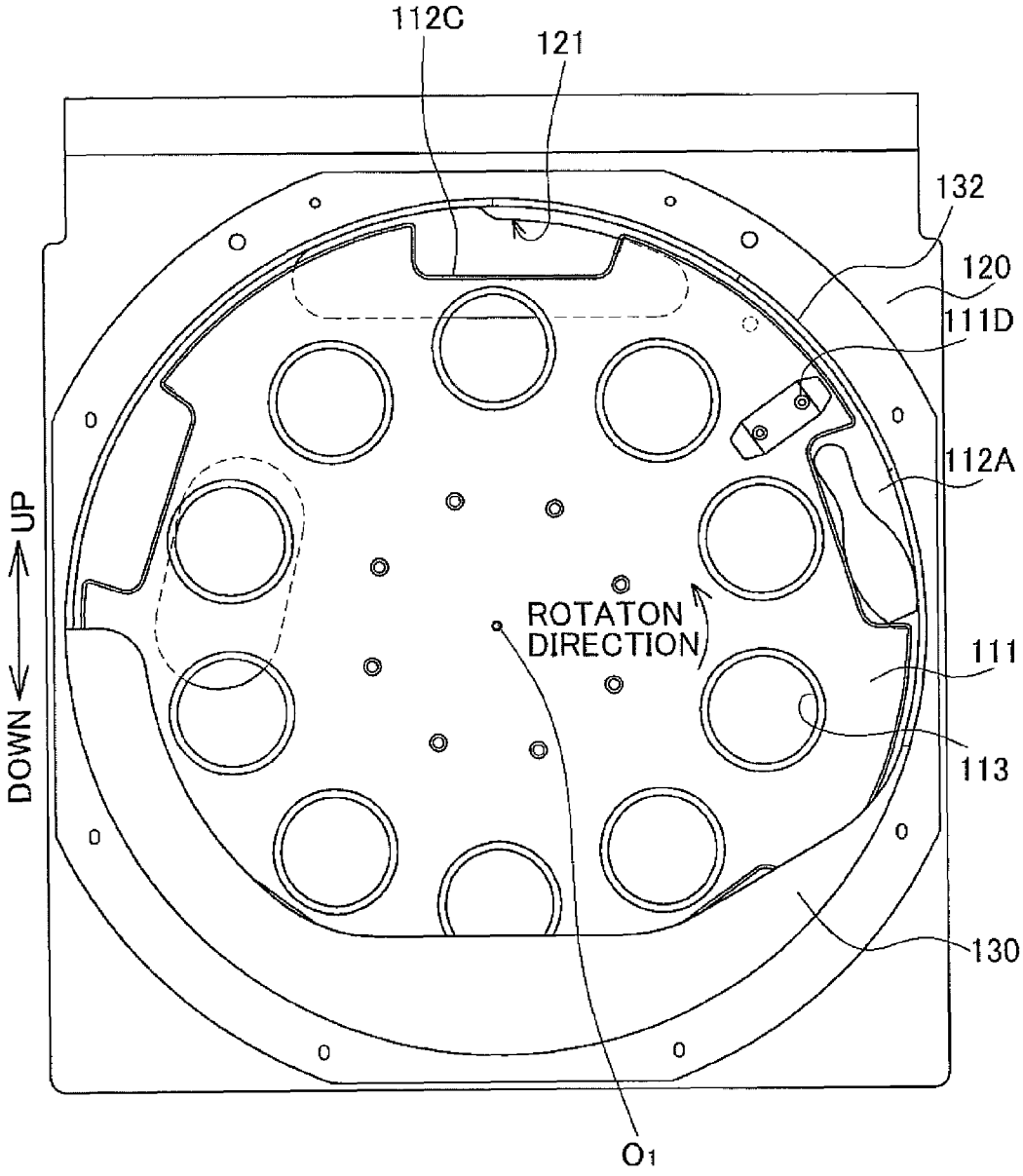
FIG. 32 is an operation explanatory view of the collection mechanism 100.
Figure 33B:
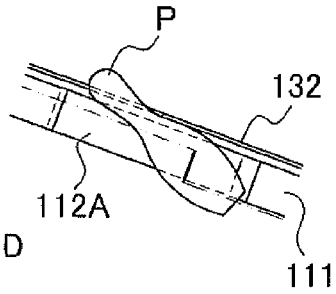
FIGS. 33(*a*) and 33(*b*) are operation explanatory views of the collection mechanism 100.
Figure 33A:
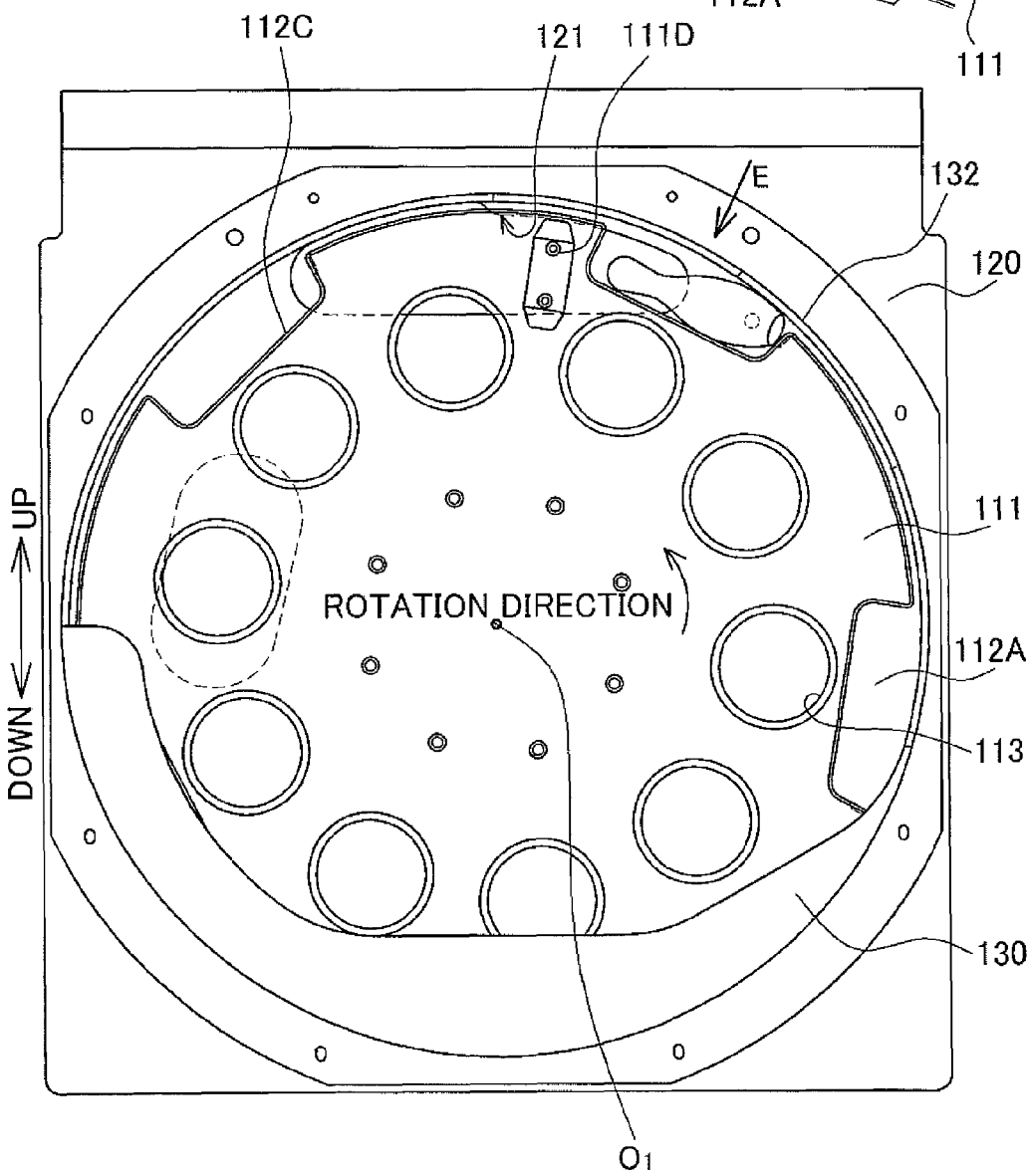

On the other hand, in case that the pin P is received in the pocket 112A such that the bottom of the pin P comes into contact with the side wall 112D on the backward side in the rotation direction, the pin P is transferred to the odd-shaped slit 121 in a state in which the bottom side of the pin P does not fit in the recess 112F, as shown in FIG. 32.

On a side opposite to the stationary plate 120 of an edge part of the recess 113 for transferring the ball B, a chamfering portion 113D is provided, as shown in FIG. 30. Due to the chamfering portion 113D, a real depth d3 of the recess 113 is smaller than a thickness H of the rotating drum 111. The real depth d3 of the recess 113 is a length of a portion of the inner peripheral side surface 113C of the recess 113 which contributes to holding of the ball B.

In a region corresponding to the pocket 112A of the stationary plate 120 on the backward side in the rotation direction of the odd-shaped slit 121, a projection 120A is provided which projects to the rotating drum 111 side, as shown in FIG. 40. The projection 120A, in the present embodiment, is formed by attaching to the stationary plate 120 a screw, such as a P screw, of which head is formed into a curved surface.

On a side opposite to the stationary plate 120 of the rotating drum 111, a stirrer 111D is provided for stirring the plurality of pins P accumulated in the lower end portion of the rotating drum 111, as shown in FIG. 41.

2. Characteristics of the Bowling Game Machine According to the Present Embodiment In the present embodiment, the real dimension A1 in the minor axis direction of the first hole 121A constituted by the rotating drum 111 and the odd-shaped slit 121 is expanded to be about 0.9 times larger than the diameter D2 of the large diameter portion P2 of the pin P. Therefore, even if the pin P is transferred to the odd-shaped slit 121 in a state in which the pin P is received in the pocket 112A such that the bottom side of the pin P is positioned on the backward side in the rotation direction, the pin P can be reliably dropped in a state in which the large diameter portion P2 of the pin P is positioned below the small diameter portion P1.

More particularly, the pin P received in the pocket 112A such that the bottom side of the pin P is positioned on the backward side in the rotation direction is transferred to a position in which the odd-shaped slit 121 is provided, as shown in FIGS. 32 to 33(*a*). After the small diameter portion P1 of the pin P reaches the first hole 121A, the tip end portion of the pin P drops through the odd-shaped slit 121 to the guide member 123 side, as shown in FIG. 33(*b*).

Figure 34B:
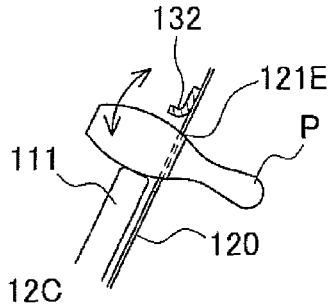
FIGS. 34(*a*) and 34(*b*) are operation explanatory views of the collection mechanism 100.
Figure 34A:
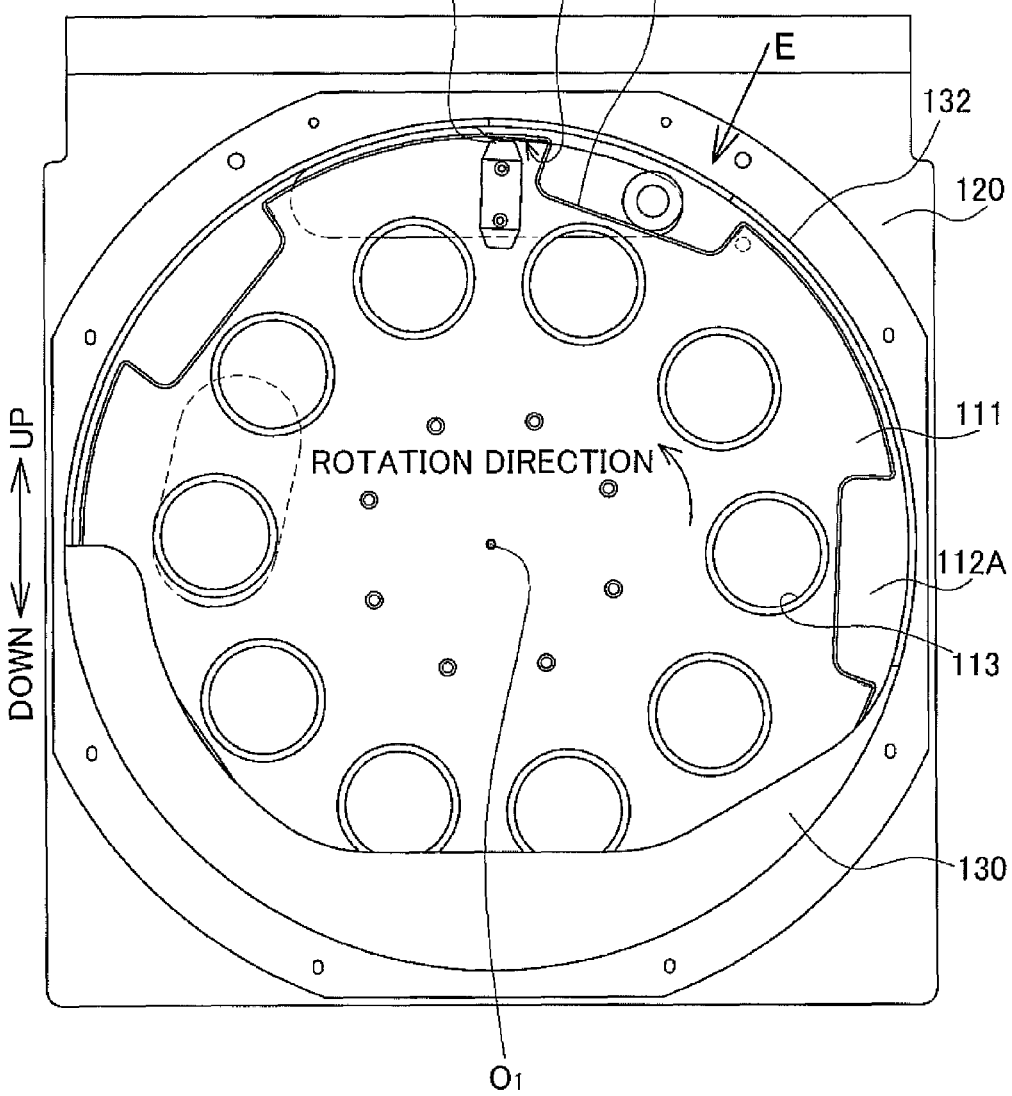

In this case, since the gap dimension A1 is expanded to be about 0.9 times larger than the diameter D2 of the large diameter portion P2 of the pin P, the pin P turns around due to the gravity acting on itself such that the large diameter portion P2 goes above the small diameter portion P1, as shown in FIGS. 34(*a*) and 34(*b*), as the tip end portion of the pin P starts to drop through the odd-shaped slit 121 to the guide member 123 side.

Figure 35B:
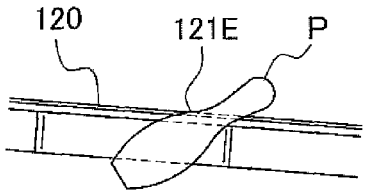
FIGS. 35(*a*) and 35(*b*) are operation explanatory views of the collection mechanism 100.
Figure 35A:
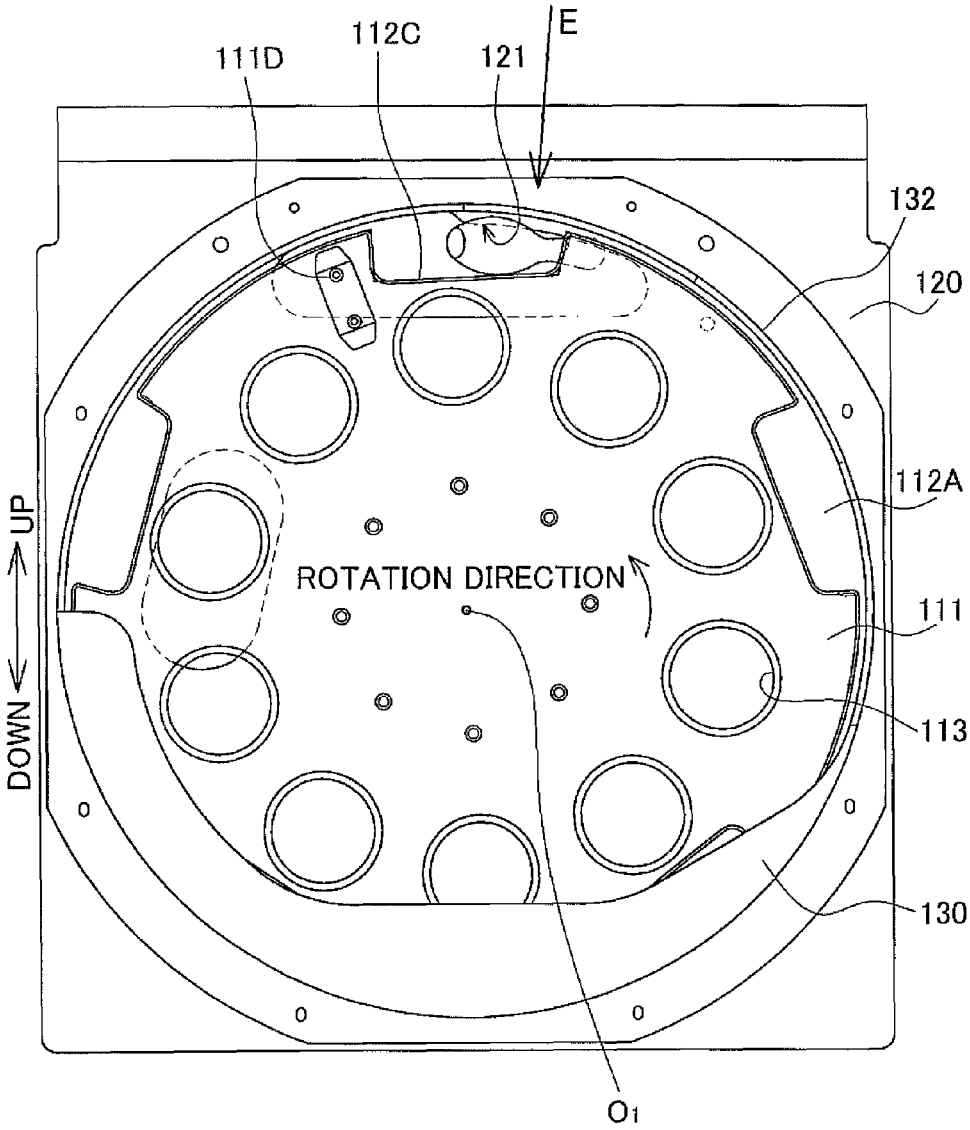

When the rotating drum 111 rotates in the above-described state, a moment which may position the large diameter portion P2 of the pin P on the more forward side in the rotation direction than the small diameter portion P1 acts on the pin P due to a frictional force which occurs in a contact portion 121E between the outer edge of the first hole 121A and the pin P (see FIG. 34(*b*)) and a rotational force of the rotating drum 111, as shown in FIGS. 35(*a*) and 35(*b*).

Figure 36B:
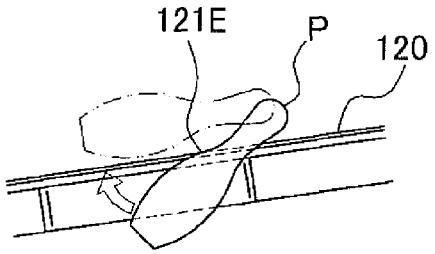
FIGS. 36(*a*) and 36(*b*) are operation explanatory views of the collection mechanism 100.
Figure 36A:
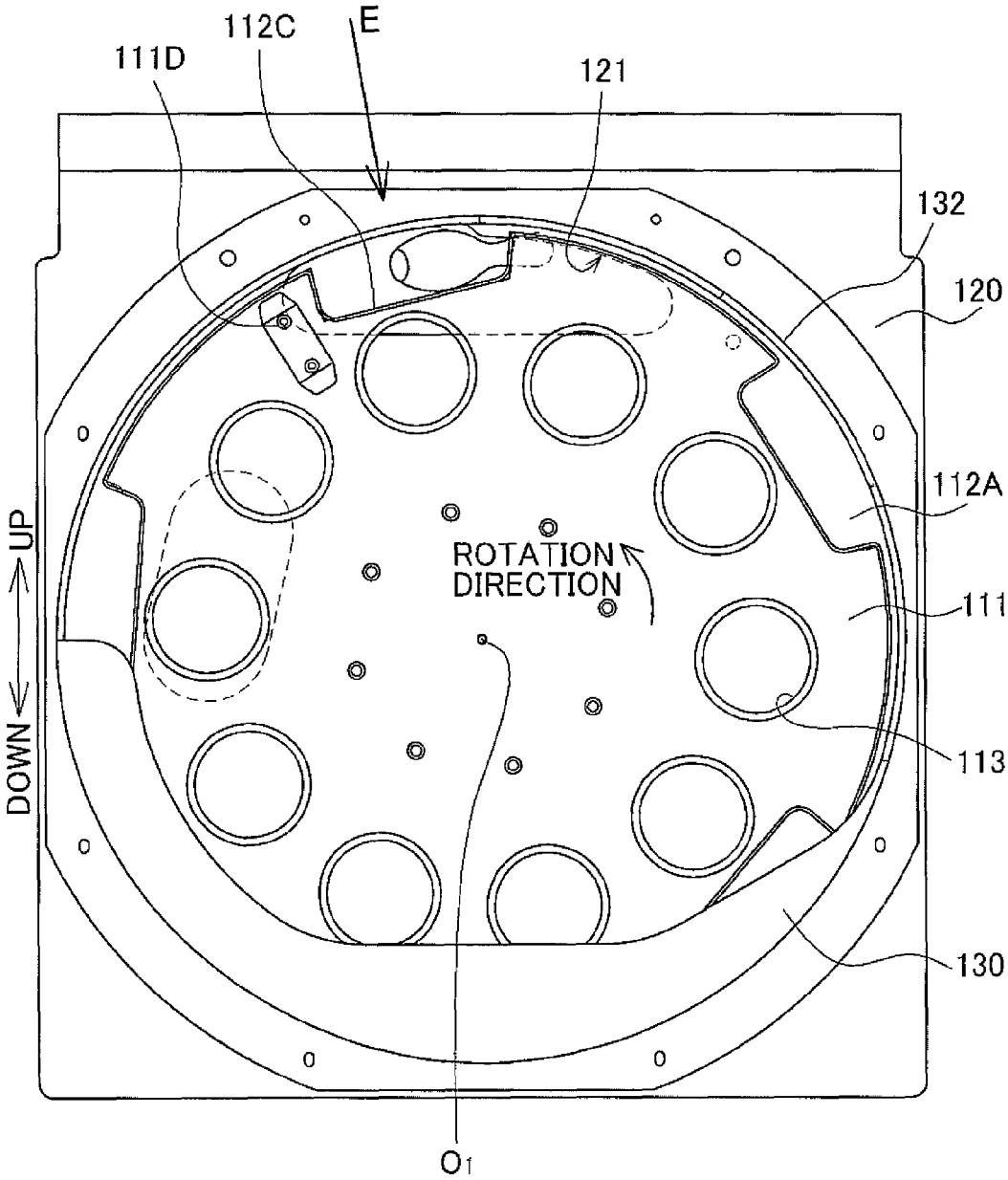

Thus, the pin P is transferred to the second hole 121B in a state in which the large diameter portion P2 of the pin P is caught by the rotating drum 111 and the outer edge of the first hole 121A. When the large diameter portion P2 reaches the second hole 121B, the whole pin P drops through the odd-shaped slit 121 to the guide member 123, and slides down inside the pin shooter 103 so that the large diameter portion P2 is positioned below the small diameter portion P1, as shown in FIGS. 36(*a*) and 36(*b*).

Accordingly, even if the pin P is transferred to the odd-shaped slit 121 in a state in which the pin P is received in the pocket 112A such that the bottom side of the pin P is positioned on the backward side in the rotation direction, the pin P can be reliably dropped in a state in which the large diameter portion P2 of the pin P is positioned below the small diameter portion P1.

In case that the pin P is received in the pocket 112A such that the tip end portion of the pin P is positioned on the backward side in the rotation direction, the pin P is transferred to the odd-shaped slit 121 in a state in which the tip end portion of the pin P fits in the recess 112F, as shown in FIGS. 37(*a*) and 37(*b*).

In this case, the tip end portion of the pin P fits in the recess 112F provided on the shroud ring 132 side of the side wall 112D on the backward side in the rotation direction. Thus, as shown in FIG. 38, the tip end portion of the pin P slides and is displaced in a region off the odd-shaped slit 121.

Therefore, the whole pin P moves with the rotation of the rotating drum 111 in a state in which the small diameter portion P1 side of the pin P does not drop through the odd-shaped slit 121 to the guide member 123 side. When the large diameter portion P2 reaches the second hole 121B, the whole pin P drops through the odd-shaped slit 121 to the guide member 123, and slides down inside the pin shooter 103 so that the large diameter portion P2 is positioned below the small diameter portion P1, as shown in FIGS. 39(*a*) and 39(*b*).

In case that the pin P is transferred to the odd-shaped slit 121 in a state in which the pin P is received in the pocket 112A such that the bottom side of the pin P is positioned on the backward side in the rotation direction, the pin P turns around so that the large diameter portion P2 goes above the small diameter portion P1, as mentioned above. Since the rotating drum 111 is constantly rotating, it is much likely that the pin P oscillates in a direction of an arrow as if to dance in a state in which the tip end portion of the pin P has dropped through the first hole 121A, as shown in FIG. 34(*b*).

When the pin P oscillates as if to dance, the shroud ring 132 and the large diameter portion P2 of the pin P hit each other. The pin P may not be able to be reliably dropped to the guide member 123.

In the present embodiment, the region corresponding to the odd-shaped slit 121 of the shroud ring 132 is cut out. Thus, the shroud ring 132 and the large diameter portion P2 of the pin P do not hit each other. The pin P can be reliably dropped to the guide member 123.

In the present embodiment, the shroud ring 132 and the large diameter portion P2 of the pin P are kept from hitting each other. Thus, instead of cutting out the region corresponding to the odd-shaped slit 121 of the shroud ring 132, a region corresponding to the odd-shaped slit 121 of the shroud ring 132 may be expanded radially outward to be spaced from the rotating drum 111.

Also in the present embodiment, on the stationary plate 120 side of the side wall 112D on the backward side in the rotating direction, the recess 112F is provided which the tip end portion of the pin P fits in. Thus, the pin P can be received in the pocket 112A in a stable manner.

More particularly, the diameter of the pin P becomes smaller from the large diameter portion P2 toward the bottom, as shown in FIG. 8(*b*). Thus, as shown in FIG. 42, if a force F acts on a portion closer to the bottom than the large diameter portion P2, the tip end portion of the pin P goes up to be in a state in a double-dashed line from a state in a solid line.

Therefore, when other pins P hit the portion closer to the bottom than the large diameter portion P2 of the pin P received in the pocket 112A, the tip end portion of the received pin P goes up and separated from the stationary plate 120.

In case that the pin P is received in the pocket 112A such that the tip end portion of the pin P is positioned on the backward side in the rotation direction (see FIGS. 37(*a*) and 37(*b*)), the pin P is supported by the tip end portion of the pin P. Thus, when the tip end portion of the pin P goes up and separated from the stationary plate 120, the received pin P is dropped from the pocket 112A. The collection rate of the pins P declines.

In the present embodiment, the recess 112F which the tip end portion of the pin P fits in is provided on the stationary plate 120 side of the side wall 112D on the backward side in the rotation direction. Thus, even if the other pins P hit the side closer to the bottom than the large diameter portion P2, the tip end portion of the pin P can be inhibited from going up and separated from the stationary plate 120. Accordingly, the received pin P can be inhibited from dropping from the pocket 112A. The collection rate of the pin P can be inhibited from declining.

In a state in which the pin P is received in the pocket 112A such that the bottom side of the pin P is positioned on the backward side in the rotation direction, the pin P is stable. Thus, even if the other pins P hit the side closer to the bottom than the large diameter portion P2, the pin P seldom drops from the pocket 112A.

Assuming that the depth of the recess 113 is sufficiently large, the pin P may be transferred in a state fitting in the recess 113. In the present embodiment, the chamfering portion 113D is provided on the side opposite to the stationary plate 120 of the edge part of the recess 113. Thereby, the real depth d3 of the recess 113 is made smaller than the thickness H of the rotating drum 111. The pin P is kept from being transferred in a state fitting in the recess 113.

If the thickness H of the rotating drum 111 is made small, the chamfering portion 113D becomes unnecessary. However, if the thickness H of the rotating drum 111 is made small, it becomes easy for the pin P to drop off from the pocket 112A. The pin P cannot be transferred to the odd-shaped slit 121. The collection rate of the pin P declines.

Such problem can be solved by using the rotating drum 111 in which the thickness H on the outer peripheral side (pocket 112A side) of the rotating drum 111 is different from the thickness H on the recess 113 side. In the above solution, however, the shape of the rotating drum 111 becomes complex. Manufacturing costs of the rotating drum 111 may increase.

In the present embodiment, a simple technique is adopted which provides the chamfering portion 113D on the side opposite to the stationary plate 120 of the edge part of the recess 113. Thus, while the manufacturing costs of the rotating drum 111 are inhibited from increasing, the pin P can be kept from being transferred in a state fitting in the recess 113 and easily dropping off from the pocket 112A.

The pin P received in the pocket 112A in an incomplete state does not drop through the odd-shaped slit 121 as described in the above even if the pin P is transferred to the odd-shaped slit 121. Thus, the pin P cannot be collected normally. The pin collection rate may decline.

In the present embodiment, the projection 120A is provided in the region corresponding to the pocket 112A of the stationary plate 120, on the more backward side in the rotation direction than the odd-shaped slit 121. Thus, before the pin P received in the pocket 112A in an incomplete state is transferred to the odd-shaped slit 121, the pin P can be forcibly dropped from the pocket 112A. The collection rate of the pin P can be improved.

More particularly, the pin P received in the pocket 112A in a complete state is in a state in which the pin P comes into contact with the stationary plate 120 at two positions, that is at the small diameter portion P1 and the large diameter portion P2. The pin P received in the pocket 112A in an incomplete state is in a state in which the pin P comes into contact with the stationary plate 120 only at one of the small diameter portion P1 and the large diameter portion P2.

Accordingly, the pin P received in the pocket 112A in an incomplete state is most likely to be in a state in which, for example, the tip end portion of the pin P projects from the rotating drum 111 to the side opposite to the stationary plate 120 (hereinafter, referred to as a front side). Thus, even if the pin P is transferred to the odd-shaped slit 121, it is highly probable that the pin P may not drop through the odd-shaped slit 121 as described in the above.

In the present embodiment, since the projection 120 is provided, the pin P is pushed to the front side by the projection 120A before reaching the odd-shaped slit 121. Thus, the pin P received in the pocket 112A can be prevented from being transferred to the odd-shaped slit 121 in an incomplete state. The collection rate of the pins P can be improved.

The pin P received in the pocket 112A in a complete state as well is pushed to the front side by the projection 120A. However, the pin P received in the pocket 112A in a complete state does not drop off from the pocket 112A since the pin P comes into contact with the stationary plate 121 at the two positions, that is at the small diameter portion P1 and the large diameter portion P2.

If the plurality of pins P accumulated in the lower end portion of the rotating drum 111 stand in neat rows, it is difficult for the accumulated pins P to enter the pockets 112A. The collection rate of the pins P may decline.

In the present embodiment, since the stirrer 111D is provided on the front side of the rotating drum 111, the plurality of pins P accumulated in the lower end portion of the rotating drum 111 are stirred by the stirrer 111D. Accordingly, the plurality of pins P accumulated in the lower end portion of the rotating drum 111 can be kept from standing in neat rows. The collection rate of the pins P can be kept from declining.

Fourth Embodiment

The present embodiment is concerned with a mounting structure of a bracket for mounting various components on the bowling game machine 1. Hereinafter, the present embodiment is described by way of example of a case in which a bracket 600 is mounted on a side surface of the lane 3 of the bowling game machine 1.

Figure 43:
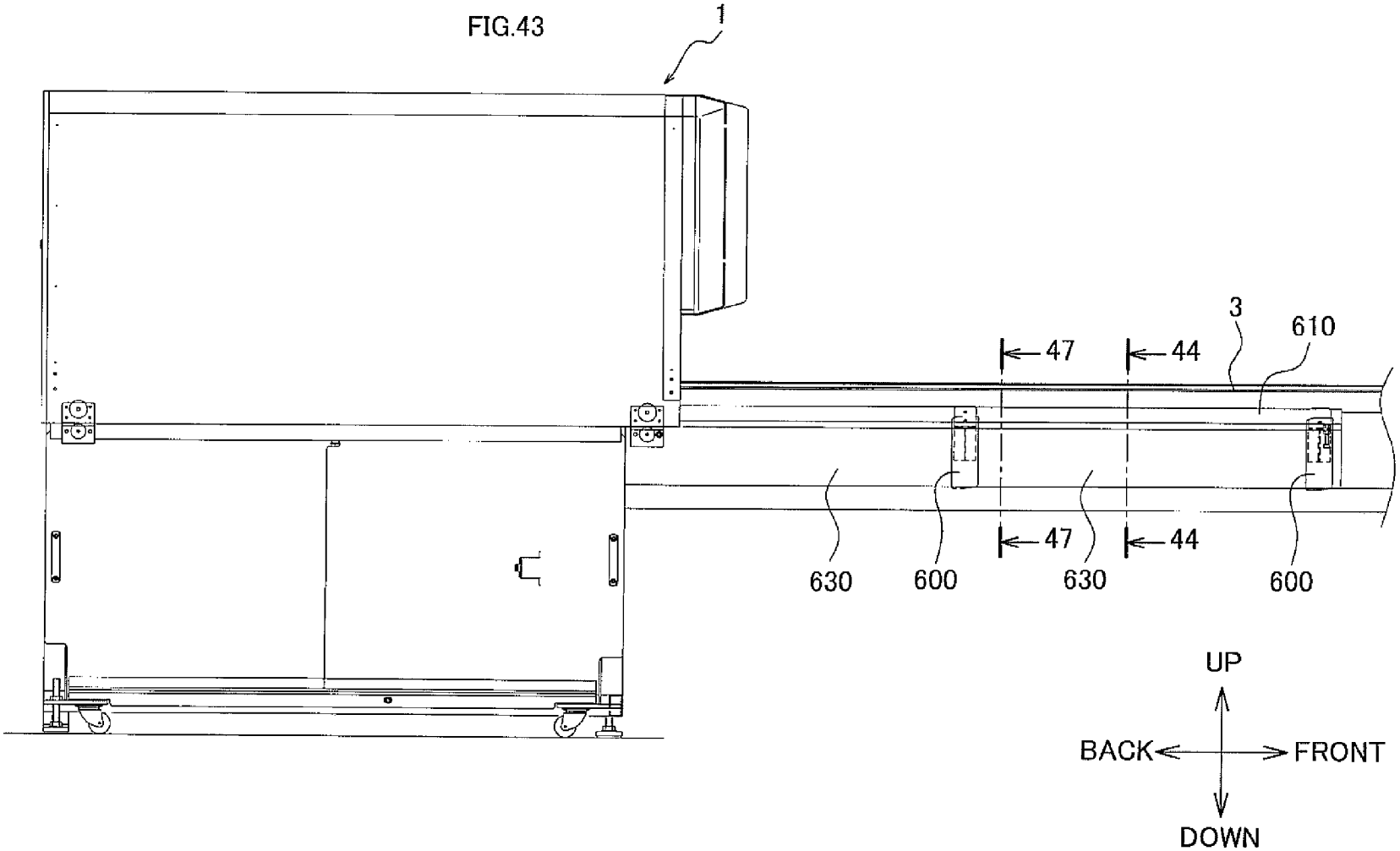
FIG. 43 is an external side view of the bowling game machine 1.
Figure 44:
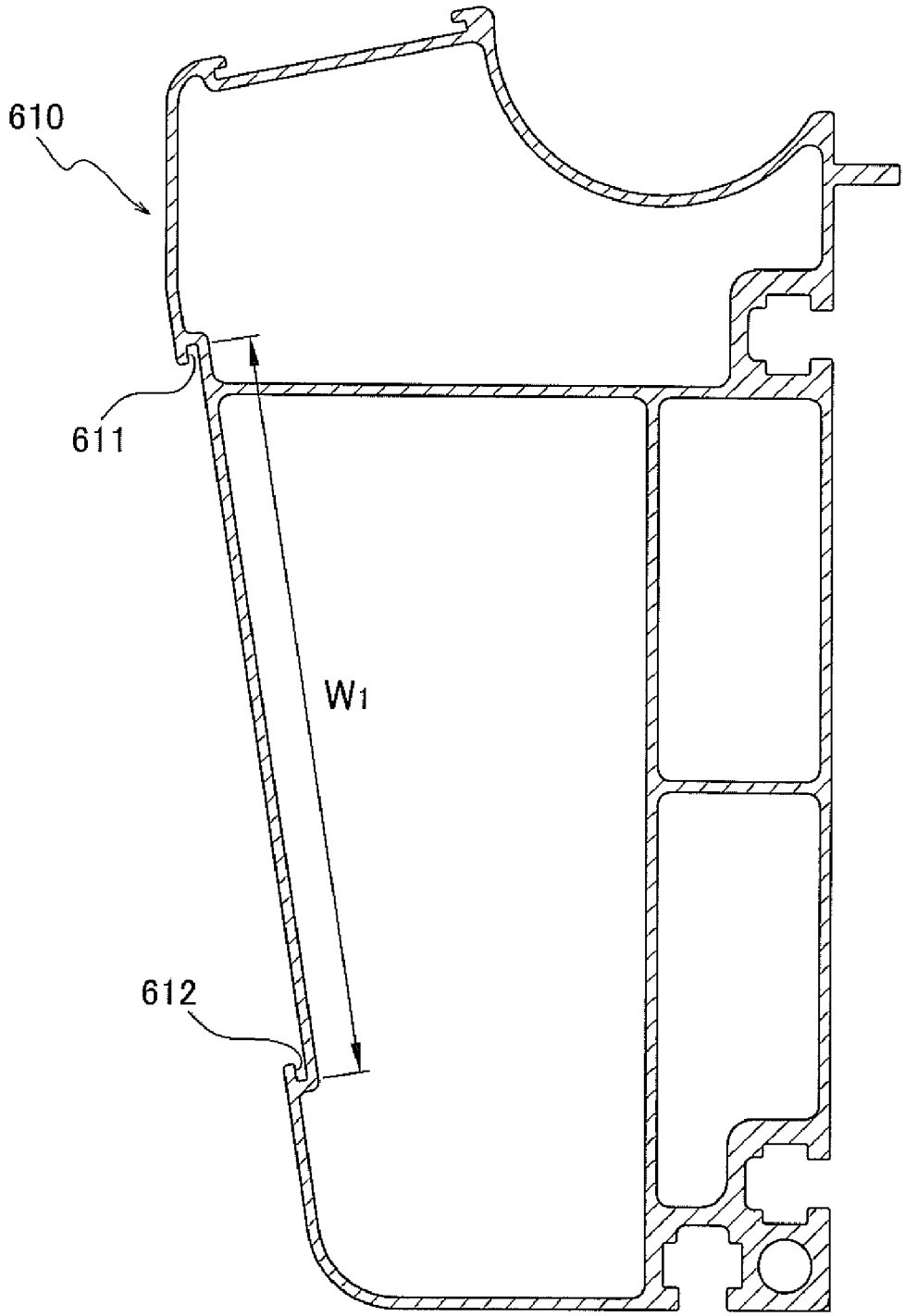
FIG. 44 is a cross sectional view of a side frame 600 (a cross sectional view taken by a line 44-44 in FIG. 43)
Figure 45A:
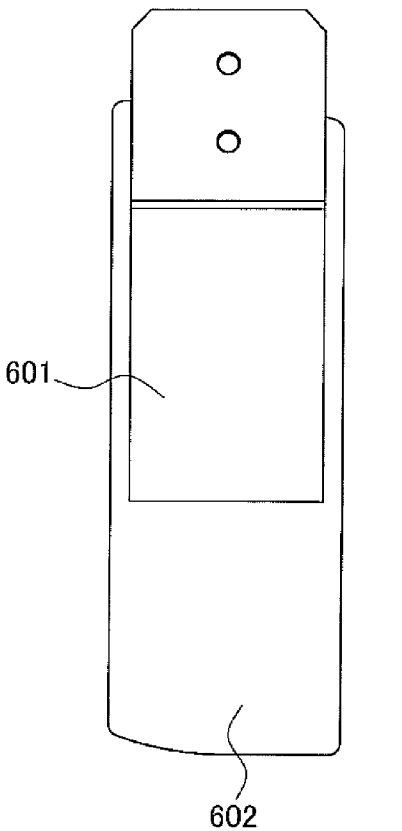
FIG. 45(*a*) is a front view of a bracket 600, FIG. 45(*b*) is a side view of the bracket 600, and FIG. 45(*c*) is a back view of the bracket 600.
Figure 45B:
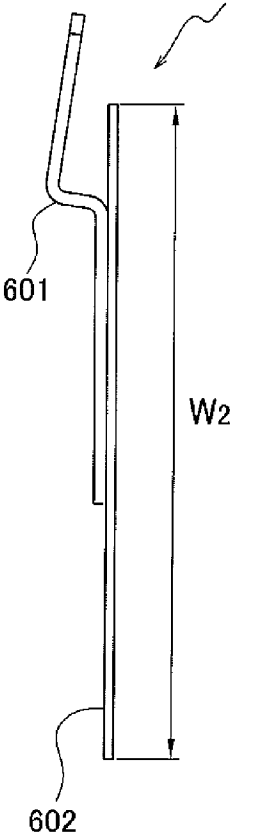
Figure 45C:
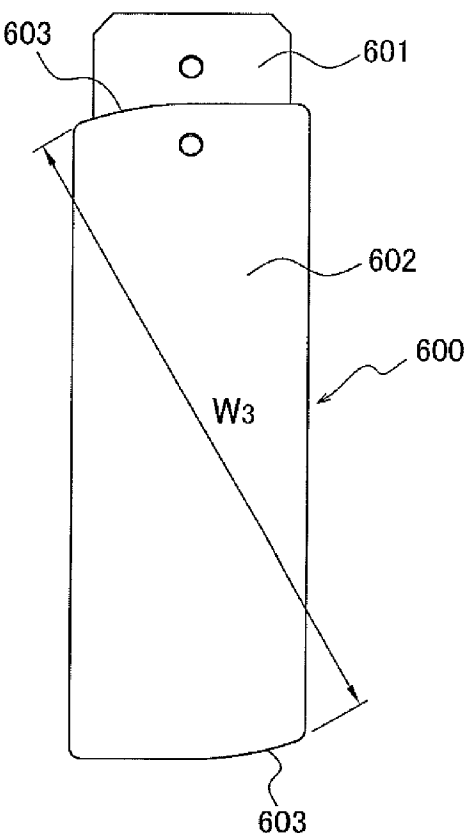
Figure 46:
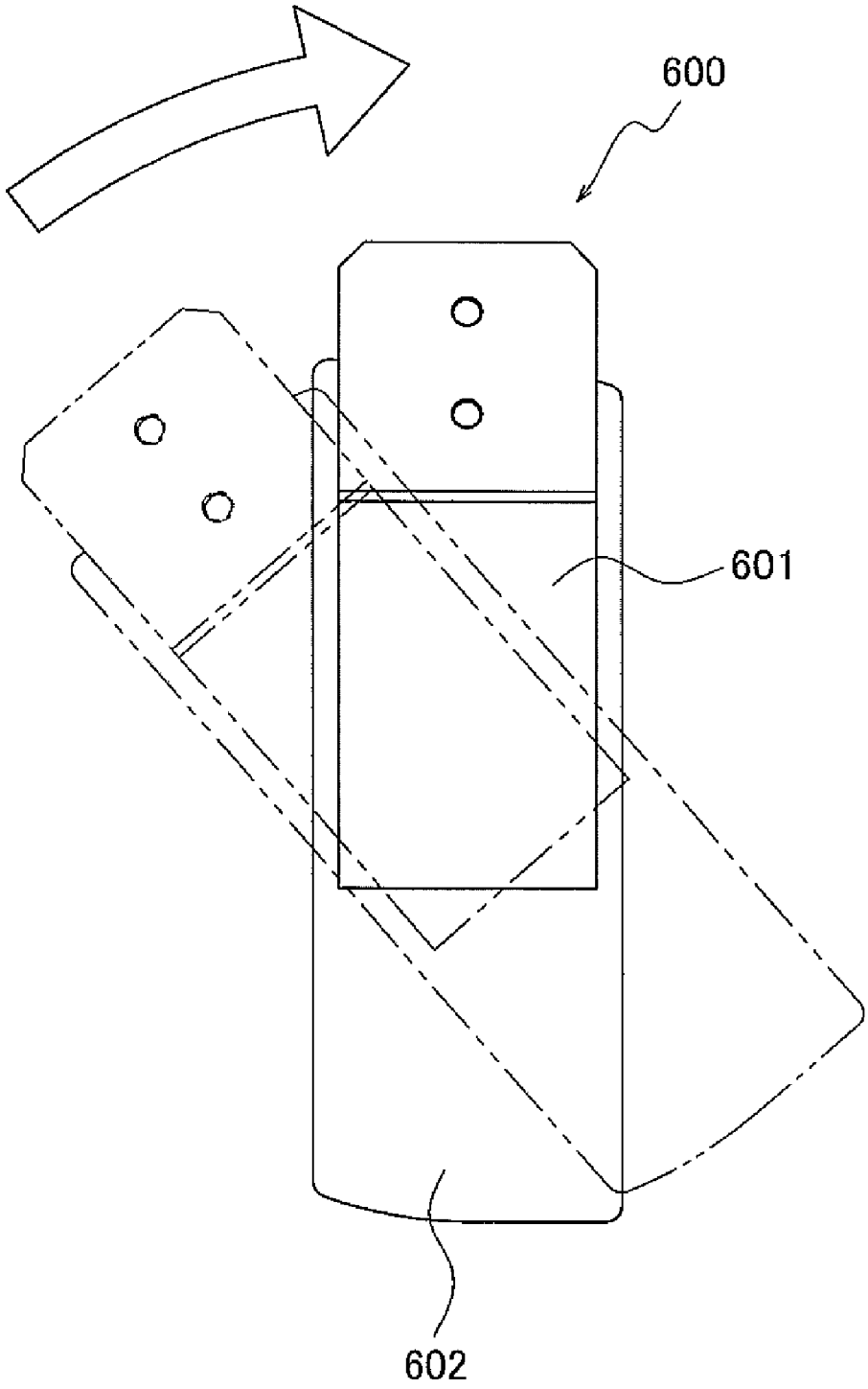
FIG. 46 is an explanatory view for mounting the bracket 600.
Figure 47:
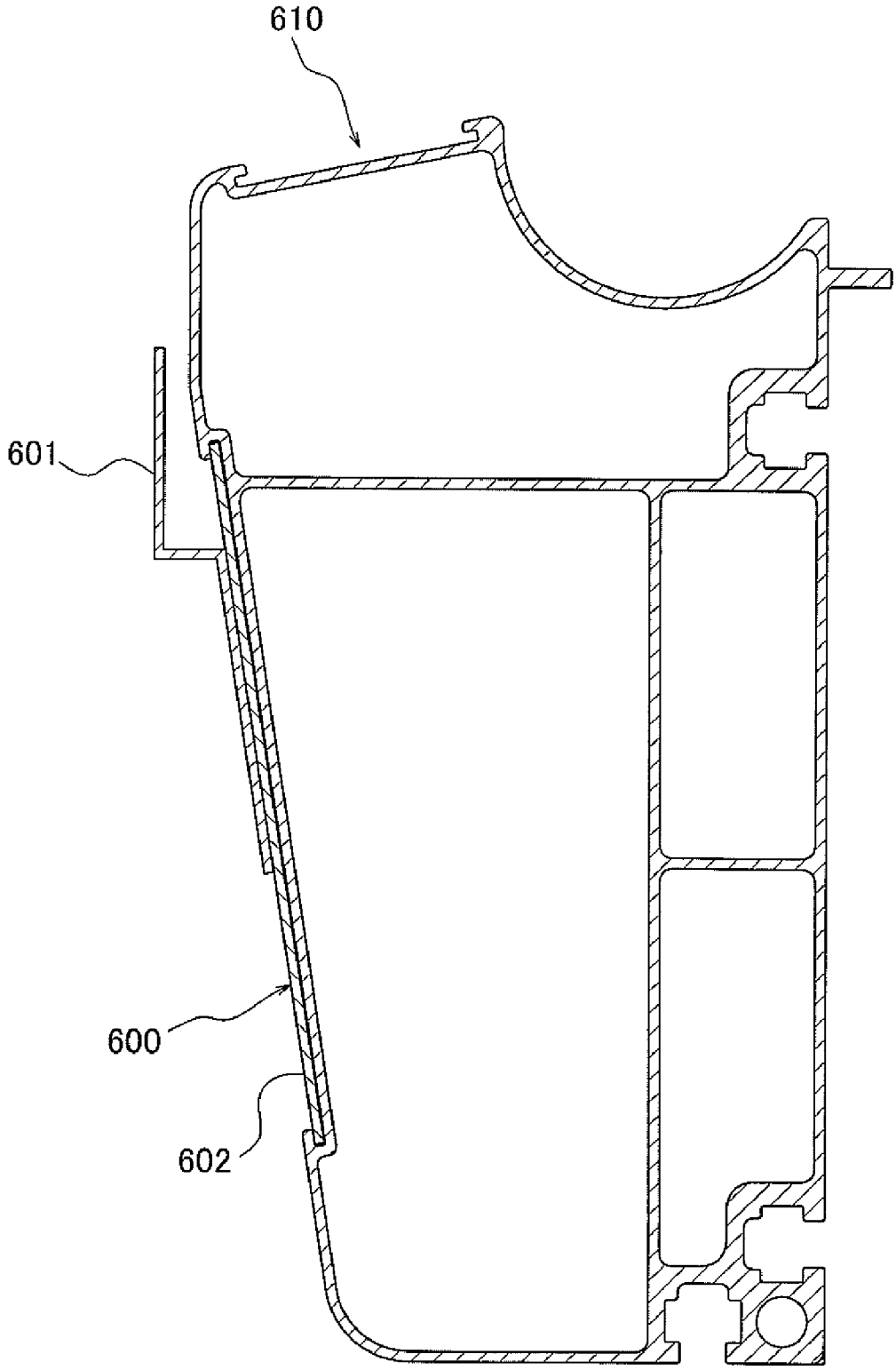
FIG. 47 is a cross sectional view (a cross sectional view taken by a line 47-47 in FIG. 43) of the bracket 600 mounted on the side frame 610.

FIG. 43 is an external side view of the bowling game machine 1. FIG. 44 is a cross sectional view of a side frame 610 (a cross sectional view taken by a line 44-44 in FIG. 43). FIG. 45(*a*) is a front view of the bracket 600, FIG. 45(*b*) is a side view of the bracket 600, and FIG. 45(*c*) is a back view of the bracket 600. FIG. 46 is an explanatory view for mounting the bracket 600. FIG. 47 is a cross sectional view (a cross sectional view taken by a line 47-47 in FIG. 43) of the bracket 600 mounted on the side frame 610.

In the bowling game machine 1, as shown in FIG. 43, the side frame 610 extending in parallel to a longitudinal direction of the lane 3 is provided on the side surface of the lane 3. In a region on which the bracket 600 is mounted of the side frame 610, a pair of grooves 611 and 612 are provided facing each other at predetermined intervals, as shown in FIG. 44.

In the present embodiment, the pair of grooves 611 and 612 also extend in the same direction with the side frame 610. Also, these grooves 611 and 612, together with the side frame 610, are integrally molded by extrusion or cupping of a metallic material such as aluminum.

The bracket 600, as shown in FIG. 45(*a*), mainly includes a mount 601 and a fitting plate 602. Various components are mounted on the mount 601. The fitting plate 602 fits in and engages with the pair of grooves 611 and 612. The mount 601 is provided on the fitting plate 602.

A dimension (hereinafter, referred to as a height dimension) W2 between portions of the fitting plate 602 which fit in the grooves 611 and 612 is set to be slightly smaller than a dimension W1 (see FIG. 44) between the pair of grooves 611 and 612. Also as shown in FIG. 45(*c*), a chamfering portion 603 is provided in a diagonal portion of the fitting plate 602 such that a diagonal dimension W3 is substantially the same with the height dimension W2.

Accordingly, upon mounting the bracket 600 on the side frame 610, the bracket 600 is rotated from a state in which the bracket 600 is inclined so that the chamfering portion 603 is substantially parallel to the grooves 611 and 612 (a state shown in a double-dashed line) to a state shown in a solid line, as shown in FIG. 46. Thereby, the fitting plate 602 can fit in the grooves 611 and 612.

In the present embodiment, the height dimension W2 of the fitting plate 602 is set to be slightly smaller than the dimension W1 between the pair of grooves 611 and 612. Thus, the bracket 600 can move along the grooves 611 and 612 in its longitudinal direction.

In the present embodiment, on both sides of the bracket 600 mounted on the side frame 610, a squeezing plate 630 fits in between the pair of grooves 611 and 612, as shown in FIG. 43. The squeezing plate 630 controls the bracket 600 so as not to move in a longitudinal direction of the side frame 610.

The squeezing plate 630 also serves as a positioning member of the bracket 600. Thus, it is preferable that the bracket 600 fits in between the grooves 611 and 612 after the squeezing plate 630 fits in between the grooves 611 and 612. However, since the control plate 630 according to the present embodiment is formed from an elastically deformable member such as resin, the squeezing plate 630 can fit in between the grooves 611 and 612 even after the bracket 600 is mounted on the side frame 610.

Fifth Embodiment

Figure 48:
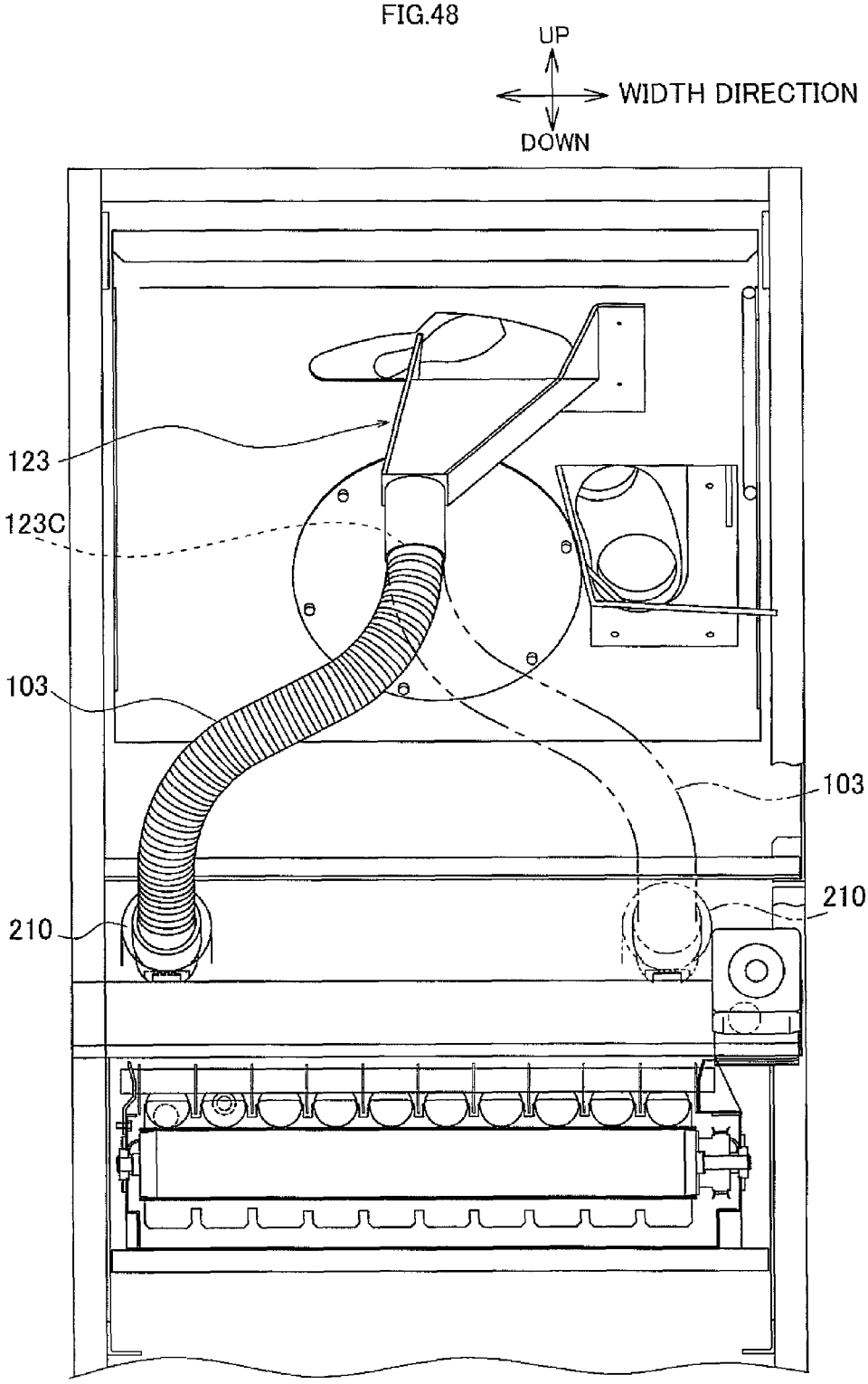
FIG. 48 is a view showing characteristics of a fifth embodiment of the invention.

In the present embodiment, as shown in FIG. 48, the outlet 123C of the guide member 123 is arranged substantially in the middle in a width direction (horizontal direction). Also, when viewed from backward, an opening direction of the outlet 123C is set to almost coincide with a vertical direction (up and down direction).

More particularly, in the above-described embodiment, as shown in FIG. 12, the opening direction of the outlet 123C does not coincide with the vertical direction (up and down direction), when viewed from backward. In the present embodiment, however, the opening direction of the outlet 123C almost coincides with a vertical direction (up and down direction).

Thereby, in the present embodiment, the pin shooter 103 can be refrained from being forcedly deformed. The pin P can smoothly drop to the distribution mechanism 210.

Also, since the opening direction of the outlet 123C coincides with the vertical direction (up and down direction), a mold for forming the guide member 123 can be split into an upper portion and a lower portion upon molding the guide member 123. Thus, a mold structure can be simple. Productivity of the guide member 123 can be improved.

Sixth Embodiment

Figure 49:
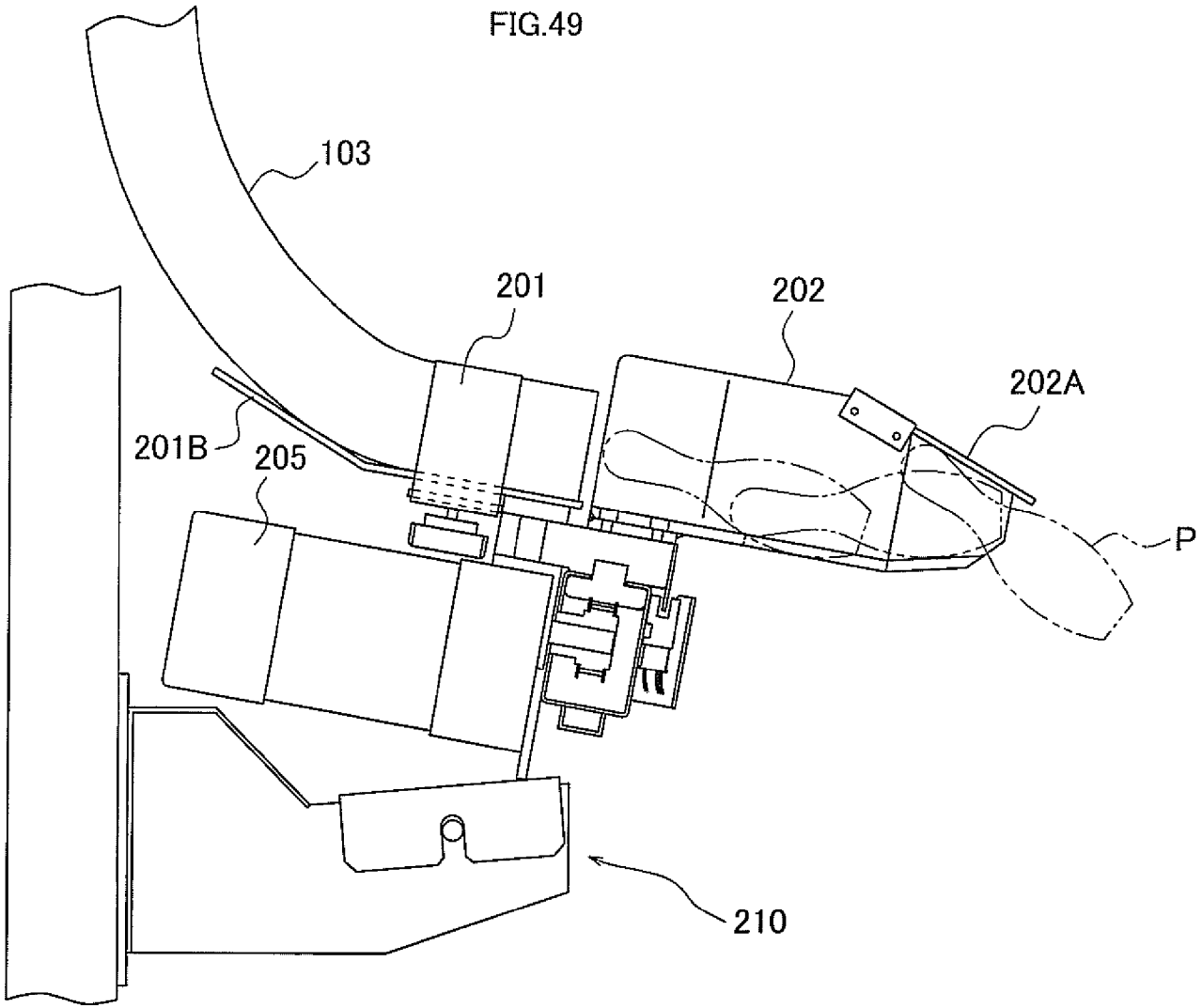
FIG. 49 is a view showing characteristics of a sixth embodiment of the invention.

In the present embodiment, as shown in FIG. 49, a shooter damping plate 201B which forcibly damps oscillation of the pin shooter 103 is provided in the shooter fixture 201. Also, on top on the outlet side of the mount nozzle 202, a leap-up damping plate 202A is provided which inhibits leaping up of the pin P.

As above, in the present embodiment, the shooter damping plate 201B keeps the pin shooter 103 from oscillating more than necessary. Thus, occurrence of trouble can be inhibited such that the pin P stops inside the pin shooter 103.

Also, since the leap-up damping plate 202A is provided on top on the outlet side of the mount nozzle 202, the pin P is inhibited from unnecessarily oscillating as if to dance upon dropping to the conveyance unit 230.

In the present embodiment, the shooter damping plate 201B is formed by bringing a metallic plate into contact with an underside of the pin shooter 103. The leap-up damping plate 202A is formed by attaching an elastic plate member such as rubber to the top on the outlet side of the mount nozzle 202. However, structures of the damping plate 201B and 202A are not limited to those described above.

Seventh Embodiment

Figure 50A:
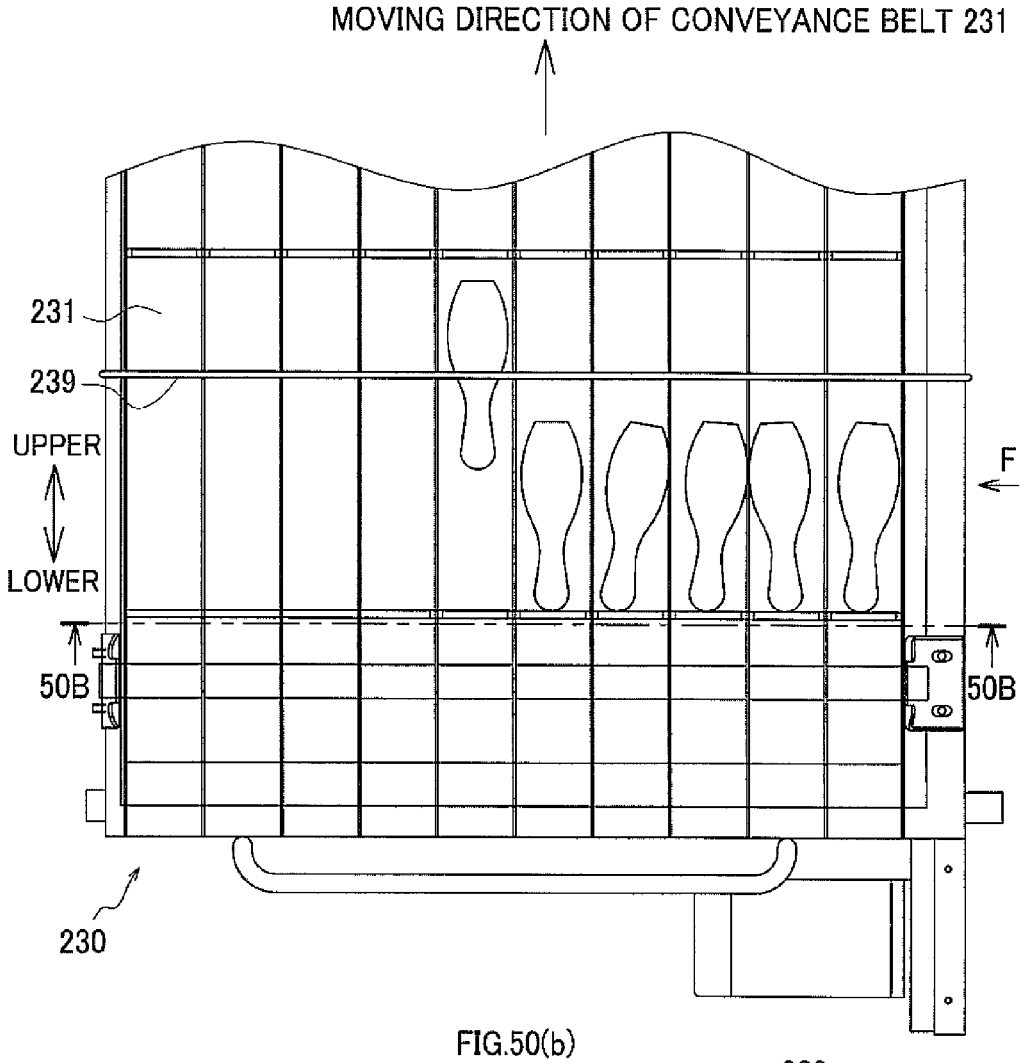
FIGS. 50(*a*) and 50(*b*) are views showing characteristics of a seventh embodiment of the invention.
Figure 50B:
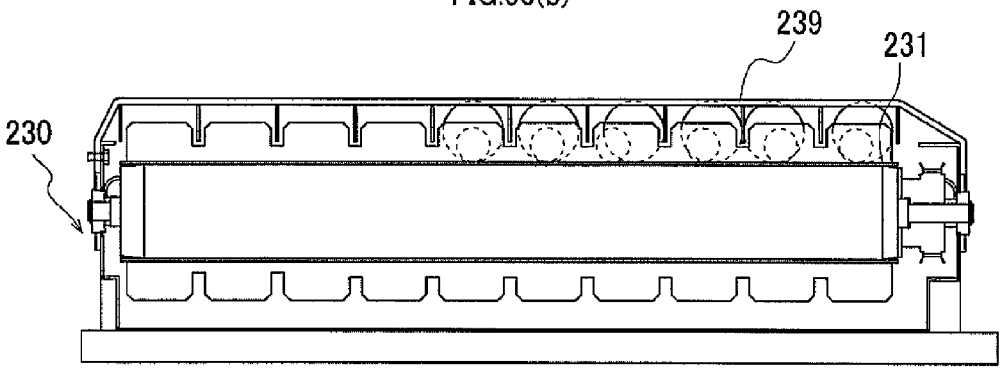

In the present embodiment, as shown in FIGS. 50(*a*) and 50(*b*), a pin damping member 239 which keeps the pin P from leaping in such a manner as to be spaced from the conveyance belt 231 is provided in the conveyance unit 230. The damping member 239 according to the present embodiment is formed from an elastic member such as ropelike rubber which extends in a direction orthogonal to a conveyance direction of the pin P.

Figure 51:
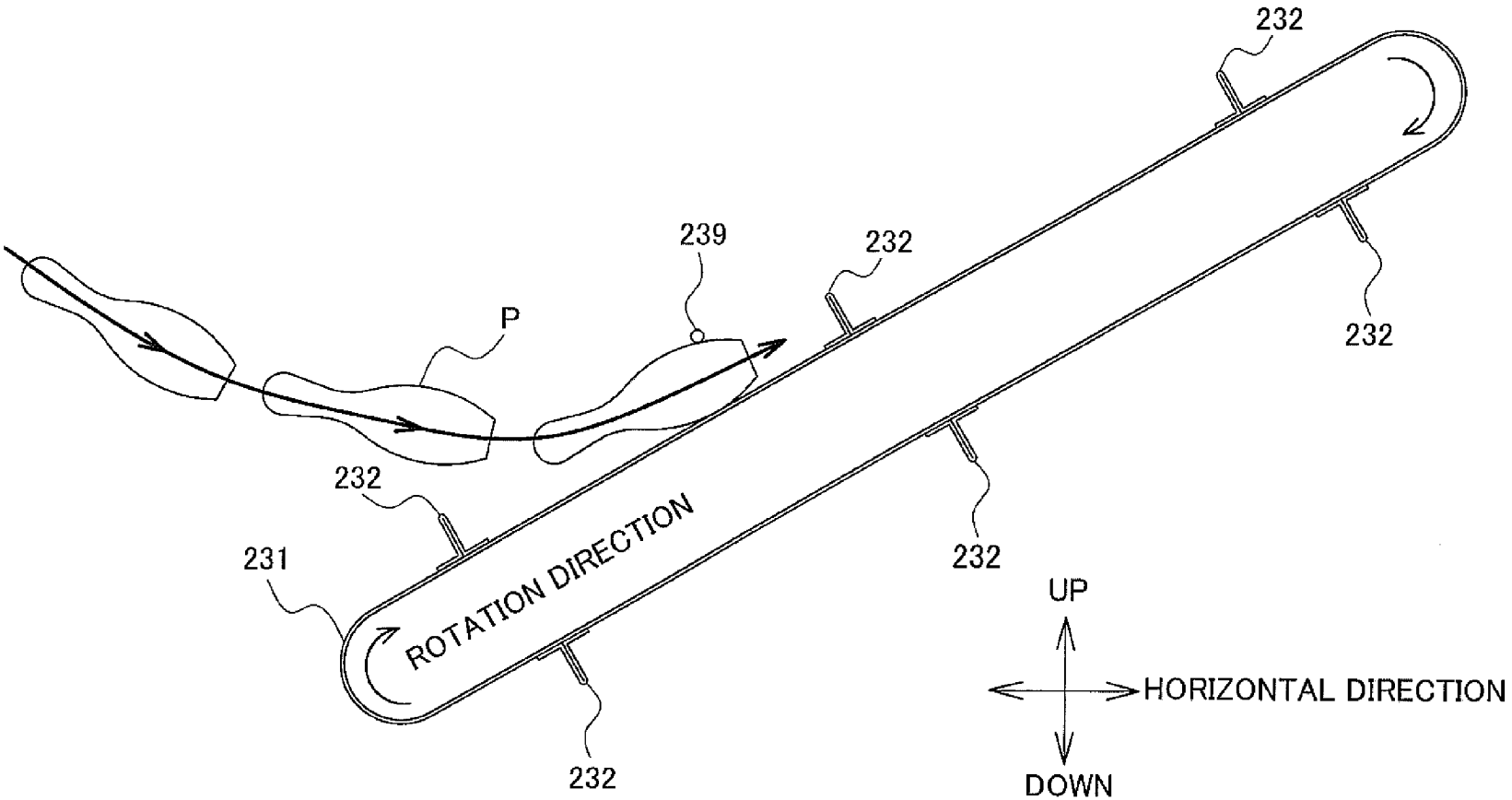
FIG. 51 is a view showing an effect of the seventh embodiment of the invention.

FIG. 50(*a*) is a view of the conveyance unit 230 viewed from its top side. FIG. 50(*b*) is a cross sectional view taken by a line 50B-50B in FIG. 50(*a*). FIG. 51 is a view of the conveyance belt 231 viewed from a direction of an arrow F in FIG. 50(*a*).

Accordingly in the present embodiment, as shown in FIG. 51, even if the pin P discharged from the mount nozzle 202 hits the conveyance belt 231, the pin P is kept from leaping up in the conveyance unit 230. Thus, the pin P can be conveyed in a stable manner.

Eighth Embodiment

In the present embodiment, the belt of the belt conveyer 101 is made to reciprocate in the conveyance direction without being rotated. Also, a displacement speed upon displacement toward a backward side in the conveyance direction is set to be larger than a displacement speed upon displacement toward a forward side in the conveyance direction.

Figure 52:
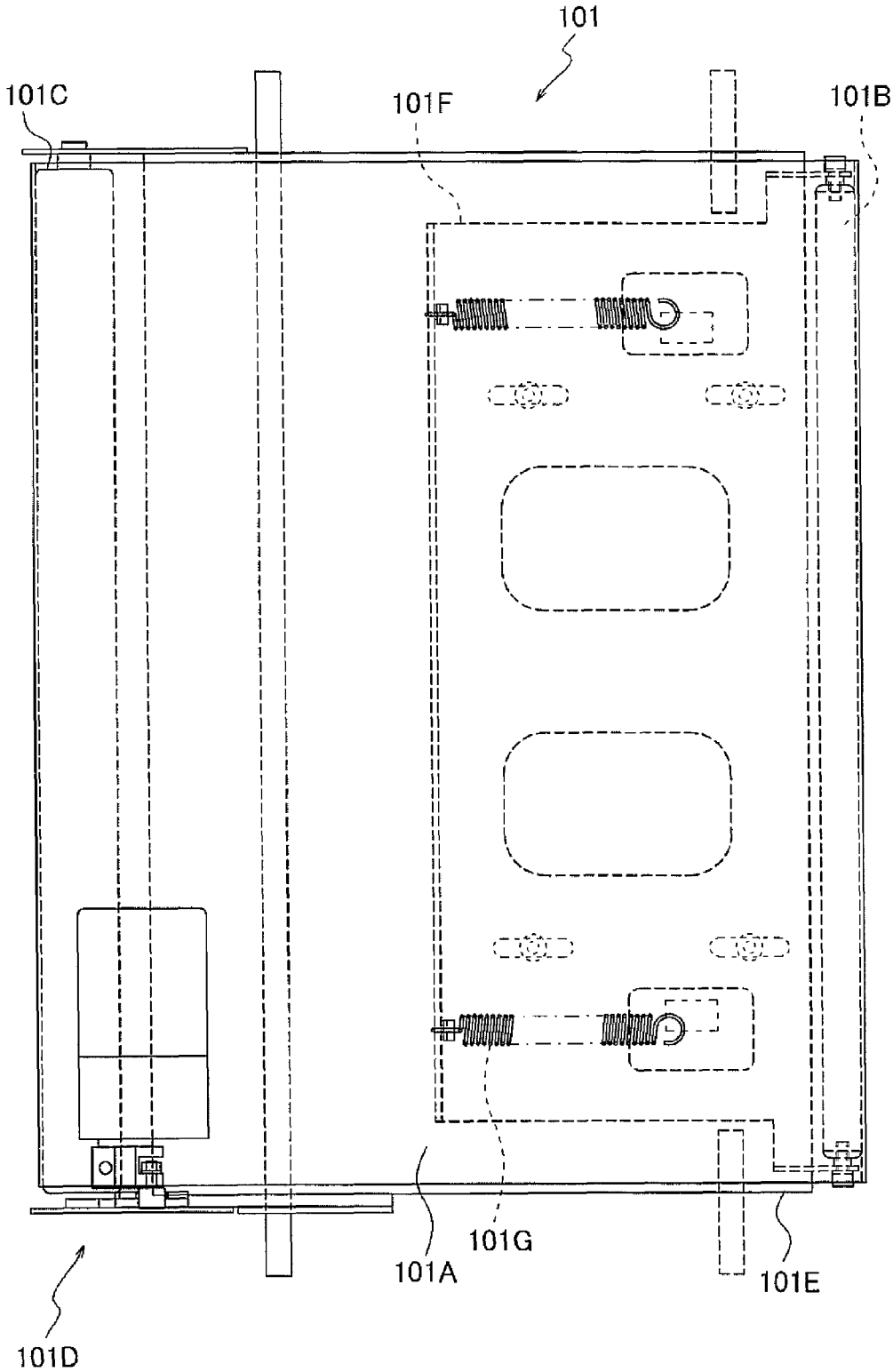
FIG. 52 is a view showing characteristics of an eighth embodiment of the invention.
Figure 53:
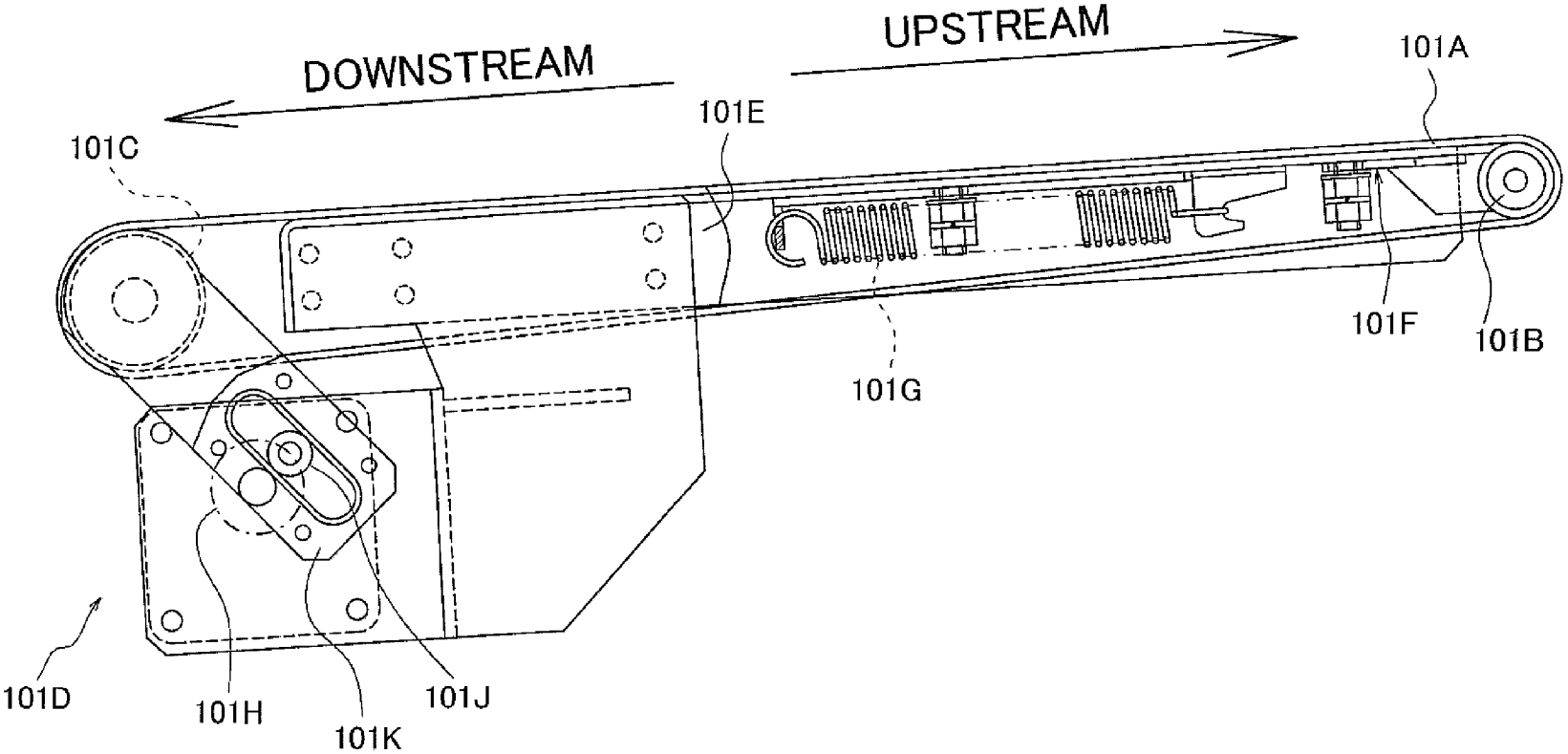
FIG. 53 is a side view (a partial cross sectional view) in FIG. 52.
Figure 54:
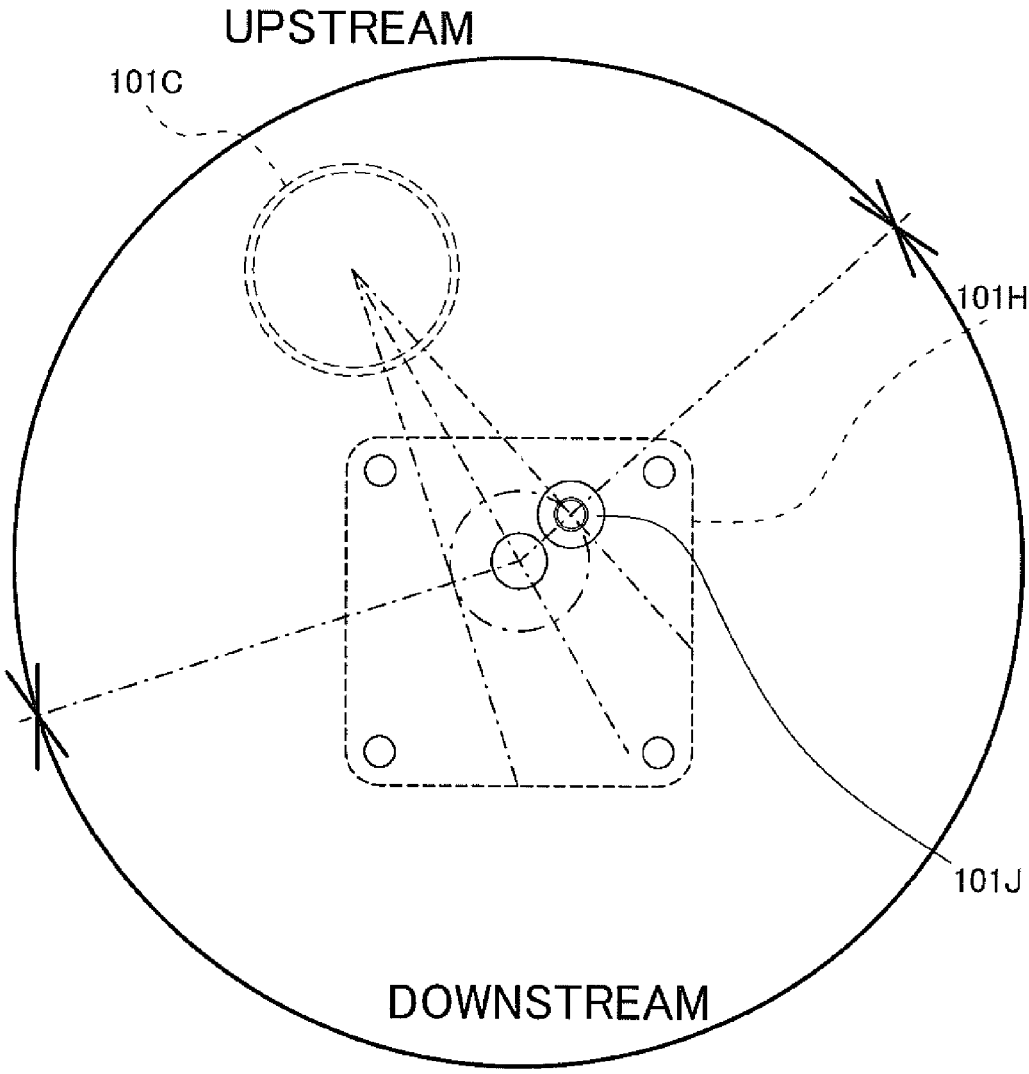
FIG. 54 is an operation explanatory view of a driving mechanism 101D.

More particularly, FIG. 52 is a top view of the belt conveyer 101 according to the present embodiment. FIG. 53 is a side view of the belt conveyor 101 according to the present embodiment. FIG. 54 is a diagram showing an operating principle of a reciprocating mechanism.

As shown in FIGS. 52 and 53, the belt conveyor 101 mainly includes the endless belt 101A, a tension roller 101B, a driving roller 101C, and a driving mechanism 101D. The tension roller 101B applies a predetermined tension to the belt 101A. The driving roller 101C applies a driving force to the belt 101A. The driving mechanism 101D swings the driving roller 101C. In the present embodiment, the belt 101A is fixed to the driving roller 101C by a fixture such as a bolt 101L (see FIG. 53).

The tension roller 101B is displaceable with respect to a frame 101E via a tensioner 101F. A spring 101G of the tensioner 101F makes a force to separate the tension roller 101B from the driving roller 101C act on the tension roller 101B via the tensioner 101F. The driving roller 101C is rotatably attached to the frame 101E in a nondisplaceable manner.

As shown in FIG. 53, the driving mechanism 101D mainly includes an electric motor 101H, a crank 101J, and a slider rod 101K. The electric motor 101H generates a rotational force. The crank 101J is rotated by the electric motor 101H and revolves (orbits) on a rotation center of the electric motor 101H. The slider rod 101K converts revolving motion of the crank 101J to swinging motion and transmit the swinging motion to the driving roller 101C.

In a revolving range shown by an indication "downstream" in FIG. 54, the driving roller 101C moves to the forward side in the conveyance direction. In a revolving range shown by an indication "upstream" in FIG. 54, the driving roller 101C moves to the backward side in the conveyance direction. In the present embodiment, the electric motor 101H rotates to the left (counterclockwise) as shown by arrows in FIG. 54.

In this case, the crank 101J revolves at an equiangular speed. Thus, the displacement speed upon displacing the belt 101A toward the backward side in the conveyance direction becomes larger than the displacement speed upon displacing the belt 101A toward the forward side in the conveyance direction. The pin P can be conveyed while oblique move of the belt 101A is avoided.

More particularly, generally in a belt conveyor, if a dimension in a conveyance direction of a belt is equal to or less than ⅔ of a dimension in a width direction (axial direction of the driving roller 101C), the belt moves obliquely. Thus, such a belt conveyer rarely works.

In the present embodiment, the belt 101A is made to reciprocate in the conveyance direction without being rotated. Thus, oblique move of the belt 101A does not occur in principle. However, the pin P is unable to be conveyed by simply making the belt 101A reciprocate.

More particularly, in the present embodiment, when the belt 101A is displaced toward the forward side in the conveyance direction, the displacement speed of the belt 101A is relatively small. Thus, the pin P moves forward in a unified manner with the belt 101A.

On the other hand, when the belt 101A is displaced toward the backward side in the conveyance direction, the belt 101A is displaced at a large variable speed. Thus, an inertial force acting on the pin P exceeds a frictional force which occurs in a contact portion between the belt and the pin P. The pin P stops on the spot due to its inertial mass. Only the belt 101A moves backward.

More particularly, in the present embodiment, when the belt 101A is displaced to the forward side in the conveyance direction, the pin P is displaced with displacement of the belt 101A. When the belt 101A is displaced to the backward side in the conveyance direction, only the belt 101A is displaced to the backward side. Therefore, the pin P can be conveyed while oblique move of the belt 101A is avoided.

If an oblique move inhibition function is provided in the belt 101A, the pin P can be conveyed by simply rotating the belt 101A without reciprocating the belt 101A. However, when a diameter of the tension roller 101B is as small as in the present embodiment, it is difficult for the belt 101A to be provided with the oblique move inhibition function. Accordingly, the present embodiment is especially effective if applied to a belt conveyor having the tension roller 101B and the driving roller 101C with small diameters.

Also in the present embodiment, the belt 101A is line-symmetrical with a center line which connects a center of the tension roller 101B and a center of the driving roller 101C. Thus, dynamic balance upon reciprocating the belt 101A can be set off. Accordingly, a load on the electric motor 101H which drives the driving roller 101C can be inhibited from increasing more than necessary.

In the present embodiment, the belt 101A is fixed to the driving roller 101C. However, the present embodiment is not limited to the structure. The belt 101A may be fixed to at least one of the tension roller 101B and the driving roller 101C. Alternatively, such fixture may be disposed of by sufficiently increasing a frictional force which occurs to a contact surface between the belt 101A and the driving roller 101C.

Other Embodiments

In the above-described embodiments, the present invention is applied to BilliBow®. Application of the present invention is not limited to BilliBow® and may be applied to an ordinary bowling game machine.

Also in the above-described embodiments, the recess 113 of the rotating drum 111 is formed into a through hole. The present invention is not limited to such structure and the recess 113 may be formed into a nonthrough hole.

Also in the above-described embodiments, the rotating drum 111 and the stationary plate 120 are inclined with respect to a vertical direction. The present invention is not limited to such structure. The rotating drum 111 and the stationary plate 120 may be parallel to the vertical direction.

Also in the above-described embodiments, the pins P collected using the odd-shaped slit 121 are oriented to the same direction. The present invention is not limited to such structure.

The distribution mechanism 210, the conveyance unit 230, the pin setter 300 and the pin guide elevation mechanism 350 are not limited to mechanisms shown in the above-described embodiments.

The present invention can take any modes which conform to the gist of the invention described in claims. The present invention is not limited to the above-described embodiments.

What is claimed is:

1. A pin setter applied to a bowling game machine in which a player rolls a ball toward a plurality of pins arranged in a standing manner on a lane thereby to knock down the plurality of pins arranged in the standing manner, the pin setter arranging the pins at predetermined positions on the lane comprising:

a distribution shooter through which the plurality of pins are dropped in a sliding manner and guided to predetermined positions; and a pin lifter that lifts standing pins up onto the lane; and wherein the pin lifter is configured to include a plurality of cylindrically formed cylinder portions into which the pins are loaded in a standing manner, and an ascending mechanism that lifts up the cylinder portions, and wherein a piston is provided which is displaceable inside the cylinder portion, and when the cylinder portion and the piston move up in a unified manner by a predetermined amount, only the piston moves up so as to push up the pin onto the lane through a hole provided in the lane.

2. The pin setter according to claim 1, wherein the same number of distribution shooters are provided as the pins arranged in a standing manner on the lane, and a feeder is provided which feeds the pins to the plurality of distribution shooters, and wherein the feeder is able to feed the pins simultaneously to the plurality of distribution shooters.

3. The pin setter according to claim 2, wherein pin feeding gates of the plurality of distribution shooters are arranged substantially in a straight line, and wherein the pins are fed by the feeder to the respective pin feeding gates in a state in which the plurality of pins are arranged substantially in a straight line.

4. The pin setter according to claim 1 comprising:

a pin guide that keeps the pin lifted on the lane from falling down; and an evacuation mechanism that evacuates the pin guide from the lane.

5. The pin setter according to claim 4 wherein:

a loading gate through which the pins are loaded is provided on a side surface of the cylinder portion.

6. The pin setter according to claim 1, wherein the hole in the lane is configured to be shut by the piston.

7. The pin setter according to claim 6, wherein the piston is configured to include:

a seat portion that comes into contact with the pin and shuts the hole; and a first elastic displacement portion that transmits to the seat portion an ascending force from the ascending mechanism and is elastically deformable in a displacement direction of the piston.

8. The pin setter according to claim 4, wherein the pin guide is provided with a clamping portion that clamps the pin.

9. The pin setter according to claim 8, wherein the pin guide is provided with a detector that detects presence/absence of the pin.

10. The pin setter according to claim 4, wherein the evacuation mechanism is configured to:

switch between a case where the pin guide is displaced in a vertical direction to keep the pin from falling down and a case where the pin guide is evacuated from the lane, and include a elastic displacement portion that interconnects the evacuation mechanism and the pin guide, and is elastically displaceable in a vertical direction.

* * * * *